US008622618B2

(12) United States Patent
Moehlenbrock

(10) Patent No.: US 8,622,618 B2
(45) **Date of Patent: *Jan. 7, 2014**

(54) EASY OPEN AND RECLOSABLE PACKAGE WITH DISCRETE LAMINATE HAVING PANEL SECTION WITH EASY-OPEN SEALANT

(75) Inventor: Andrew W. Moehlenbrock, Simpsonville, SC (US)

(73) Assignee: Cryovac, Inc., Duncan, SC (US)

( * ) Notice: Subject to any disclaimer, the term of this patent is extended or adjusted under 35 U.S.C. 154(b) by 494 days.

This patent is subject to a terminal disclaimer.

(21) Appl. No.: 12/845,054

(22) Filed: Jul. 28, 2010

(65) Prior Publication Data

US 2011/0036741 A1 Feb. 17, 2011

Related U.S. Application Data

(60) Provisional application No. 61/274,255, filed on Aug. 14, 2009.

(51) Int. Cl.
*B65D 85/00* (2006.01)

(52) U.S. Cl.
USPC ..... 383/203

(58) Field of Classification Search
USPC ..... 383/203, 204, 210, 210.1, 211, 61.1, 383/84, 85, 86
See application file for complete search history.

(56) References Cited

U.S. PATENT DOCUMENTS 2,719,663 A 10/1955 Meyer-Jagenberg
3,259,303 A 7/1966 Repko
3,595,468 A 7/1971 Repko
3,613,874 A 10/1971 Miller
3,942,713 A 3/1976 Olson et al.
4,156,493 A 5/1979 Julius
4,318,506 A * 3/1982 Hirsch ..... 383/89
4,709,399 A 11/1987 Sanders
4,785,940 A * 11/1988 Wilson ..... 383/204
4,786,190 A 11/1988 Van Erden et al.
4,902,142 A 2/1990 Lammert et al.

(Continued)

FOREIGN PATENT DOCUMENTS

EP 0179624 A2 4/1986
EP 1254846 A1 11/2002

(Continued)

OTHER PUBLICATIONS

"Amcor E-close", on or about Apr. 2008 (document undated), 2 pages.

(Continued)

*Primary Examiner* — Steven A. Reynolds
*Assistant Examiner* — King M Chu
(74) *Attorney, Agent, or Firm* — Mark B. Quatt

(57) ABSTRACT

An easy-open and reclosable package includes a pouch including a discrete laminate including a tape including a base strip coated with a pressure sensitive adhesive, and a panel section, the inner surface of the panel section having an easy-open sealant, the panel section adhered by the PSA to the base strip; the discrete laminate anchored to a first side panel; and a product in the pouch. When the package is opened, the package can be reclosed by adhering the first or second side panel to the pressure sensitive adhesive. Methods for making the package, and a pouch, are also disclosed.

10 Claims, 35 Drawing Sheets

(56) References Cited

U.S. PATENT DOCUMENTS

| | | | | |
|---|---|---|---|---|
| 4,934,535 | A | 6/1990 | Muckenfuhs et al. | |
| 4,946,038 | A | 8/1990 | Eaton | |
| 5,044,772 | A | 9/1991 | Larson | |
| 5,044,776 | A | 9/1991 | Schramer et al. | |
| 5,077,001 | A * | 12/1991 | Makowka | 383/5 |
| 5,167,455 | A | 12/1992 | Forman | |
| 5,346,301 | A | 9/1994 | Scarberry et al. | |
| 5,476,323 | A | 12/1995 | Gold | |
| 5,564,834 | A | 10/1996 | Porchia et al. | |
| 5,836,697 | A | 11/1998 | Chiesa | |
| 5,855,434 | A * | 1/1999 | Hagen | 383/89 |
| 5,855,435 | A * | 1/1999 | Chiesa | 383/204 |
| 5,882,749 | A | 3/1999 | Jones et al. | |
| 5,882,789 | A | 3/1999 | Jones et al. | |
| 6,048,100 | A | 4/2000 | Thrall et al. | |
| 6,056,141 | A | 5/2000 | Navarini et al. | |
| 6,106,153 | A | 8/2000 | Toshima | |
| 6,131,248 | A | 10/2000 | Tomic | |
| D447,054 | S | 8/2001 | Hill | |
| 6,461,044 | B1 | 10/2002 | Anderson | |
| 6,502,986 | B1 * | 1/2003 | Bensur et al. | 383/211 |
| 6,589,622 | B1 | 7/2003 | Scott | |
| 6,659,645 | B1 | 12/2003 | Schulz | |
| 6,662,843 | B1 | 12/2003 | Johnson | |
| 6,688,078 | B2 * | 2/2004 | Mauclair et al. | 53/412 |
| 6,793,077 | B1 | 9/2004 | Kancsar et al. | |
| 6,865,860 | B2 | 3/2005 | Arakawa et al. | |
| 6,925,779 | B2 | 8/2005 | Thieman | |
| 7,041,042 | B2 | 5/2006 | Chertkow et al. | |
| 7,073,309 | B2 | 7/2006 | Van Driesten | |
| 7,216,764 | B2 | 5/2007 | Forman | |
| 7,217,033 | B2 | 5/2007 | Pritchard | |
| 7,305,805 | B2 * | 12/2007 | Dierl et al. | 53/412 |
| 7,314,312 | B2 | 1/2008 | Soderholm | |
| 7,322,473 | B2 | 1/2008 | Fux | |
| 7,395,642 | B2 | 7/2008 | Plourde et al. | |
| 7,406,810 | B2 * | 8/2008 | Clune et al. | 53/412 |
| 7,422,782 | B2 | 9/2008 | Haedt et al. | |
| 7,527,839 | B2 | 5/2009 | Busche et al. | |
| D597,857 | S | 8/2009 | Lin | |
| 7,681,732 | B2 | 3/2010 | Moehlenbrock et al. | |
| 2004/0013322 | A1 | 1/2004 | Taylor | |
| 2004/0179753 | A1 | 9/2004 | Schneider | |
| 2005/0025395 | A1 | 2/2005 | Howell et al. | |
| 2006/0062496 | A1 | 3/2006 | Clune | |
| 2006/0083446 | A1 | 4/2006 | Sampaio Camacho | |
| 2006/0093765 | A1 | 5/2006 | Mueller | |
| 2006/0141196 | A1 | 6/2006 | Utz | |
| 2006/0246184 | A1 | 11/2006 | Rietjens et al. | |
| 2006/0251341 | A1 | 11/2006 | Sampaio Camacho | |
| 2006/0251342 | A1 | 11/2006 | Forman | |
| 2006/0257611 | A1 | 11/2006 | Chiesa | |
| 2007/0104395 | A1 * | 5/2007 | Kinigakis et al. | 383/61.1 |
| 2007/0104398 | A1 | 5/2007 | Ours | |
| 2007/0114144 | A1 | 5/2007 | Suzuki et al. | |
| 2007/0140599 | A1 | 6/2007 | Dalgleish et al. | |
| 2007/0141287 | A1 | 6/2007 | Laaksonen et al. | |
| 2008/0105572 | A1 * | 5/2008 | Cappel et al. | 206/231 |
| 2008/0131035 | A1 | 6/2008 | Rogers | |
| 2008/0260305 | A1 | 10/2008 | Shah et al. | |
| 2009/0053372 | A1 | 2/2009 | Hambrick et al. | |
| 2009/0127281 | A1 | 5/2009 | Hickey | |
| 2009/0148081 | A1 | 6/2009 | Rogers | |
| 2009/0152139 | A1 * | 6/2009 | Roesink et al. | 206/260 |
| 2009/0202183 | A1 | 8/2009 | Hagino | |
| 2009/0226117 | A1 | 9/2009 | Davis et al. | |
| 2009/0257686 | A1 | 10/2009 | Anzini | |
| 2009/0279813 | A1 | 11/2009 | Pokusa et al. | |
| 2009/0304874 | A1 | 12/2009 | Stephens et al. | |
| 2009/0311454 | A1 | 12/2009 | Stephens | |
| 2010/0111453 | A1 | 5/2010 | Dierl | |
| 2010/0113239 | A1 | 5/2010 | Peterson | |
| 2010/0209551 | A1 | 8/2010 | Mitra-Shah et al. | |
| 2010/0278454 | A1 | 11/2010 | Huffer | |
| 2010/0290719 | A1 | 11/2010 | Yeager | |
| 2010/0327046 | A1 | 12/2010 | Mohda et al. | |
| 2011/0038569 | A1 | 2/2011 | Huffer et al. | |

FOREIGN PATENT DOCUMENTS

| | | | |
|---|---|---|---|
| EP | 1584562 | A1 | 10/2005 |
| EP | 1676 785 | A1 | 7/2006 |
| EP | 1714894 | B1 | 10/2006 |
| EP | 1842785 | A1 | 10/2007 |
| EP | 1908696 | A1 | 4/2008 |
| EP | 1930252 | A1 | 6/2008 |
| EP | 2108507 | A1 | 10/2009 |
| EP | 2108596 | A1 | 10/2009 |
| GB | 2438393 | A | 11/2007 |
| IT | 01319964 | | 11/2003 |
| JP | 2006/224984 | A | 8/2006 |
| JP | 2007/246137 | A | 9/2007 |
| JP | 2008/230666 | A | 2/2008 |
| WO | WO 96/40504 | | 12/1996 |
| WO | 0002782 | A2 | 1/2000 |
| WO | WO 02/066341 | A1 | 8/2002 |
| WO | WO 2008/022308 | A2 | 2/2006 |
| WO | WO 2007/073895 | A1 | 7/2007 |
| WO | WO 2008/030924 | A2 | 3/2008 |

OTHER PUBLICATIONS

"Amcor EasyPack²", on or about Apr. 2008 (document undated), 2 pages.
"Curwood Introduces Next-Generation Peel-Reseal Technology for Tray & Lid Systems", Nov. 5, 2008, 2 pages.
"Dole's Easy-Open Bags . . . ", May 15, 2009, 7pages.
"EZ Zip Reclosable Zipper", 2 pages.
"Inno-Lok® pre-zippered film", Jun. 2005, 4 pages.
"Label-aire", Apr. 27, 2009, 4 pages.
"Milk Link Launches New 'Grip Strip' Cheese Packaging", Jun. 7, 2010, 5 pages.
Mondi Consumer Flexibles sets new standard in convenience, Feb. 23, 2010, 2 pages.
Mondi/Innovative and Flexible Packaging Solutions, 8 pages.
Mondi/SwiftUp-innovative easy opening solution for flexible packaging, Jun. 7, 2010, 2 pages.
"New choices in flexible packaging: new material options for flexible packaging", Pira Acc. Num. 20294555, from Pharm.Med. Packag. News, vol. 14, No. 10, Oct. 2006, 1 page.
"New Opportunities in cheese packaging", from *Dairy Foods*, May 2007, 2 pages.
"New Peelable Seal Technology for Easy-Open Packaging", (McKenna et al.), Polyolefins 2007 Conference, on or about Feb. 26, 2007, 5 pages.
"Packaging Machinery/The world of cheese", 17 pages.
PCT International Search Report, mailed Oct. 5, 2010, re: PCT/US2010/043457 (3 pages).
PCT International Search Report, mailed Mar. 28, 2011, re: PCT/US2010/043618 (4 pages).
PCT International Search Report, mailed Oct. 5, 2010, re: PCT/US2010/043815 (3 pages).
"Perfecting the Breakable Seal", Packaging Digest, Jun. 1990, 1 page.
"PFM Zenith Inox", 13 pages.
"Pour & Lok™ Resealable Packaging", on or about Nov. 2008, 2 pages.
"Pressure Sensitive Adhesives (PSA) and Contact Adhesives", Mar. 13, 2007, 3 pages.
"QuickSeals™—Add Reclosable Seals to Most Packag . . . ", Oct. 5, 2009, 4 pages.
"Sealed Air adds resealable applicator to line-up", Mar. 11, 2005, 1 page.
"Snack brand gets turned on its side", Packaging World, May 2008, pp. 18-19.
US Office Action, mailed Aug. 3, 2010, re: U.S. Appl. No. 11/788,544 (11 pages).

(56) References Cited

OTHER PUBLICATIONS

"Virtually unlimited applications for unique packaging design—Mondi", May 19, 2010, 4 pages.
Wausau Coated, Custom Retail Packaging, color brochure, on or about Sep. 2006, (document undated), 4 pages.
Wausau Coated, Custom Sheets, color brochure, on or about Sep. 2006, (document undated), 4 pages.
Wausau Coated, Innovation, color brochure, on or about Sep. 2006, (document undated), 4 pages.
Wausau Coated, Liners, color brochure, on or about Sep. 2006, (document undated), 4 pages.
Wausau Coated, Offering You the Perfect Blend of Products and Services, color brochure, on or about Sep. 2006, (document undated), 6 pages.
Wausau Coated, Products for HP Indigo Digital Presses, color brochure, 4 pages, Jun. 2005.
"Welcome to Sealstrip.com", 2005, 11 pages.
"Zip-Pak and Paramount Packaging Launch New Flow Wrapper with Resealable Closure . . . ", Dec. 12, 2008, 3 pages.

* cited by examiner

EASY OPEN AND RECLOSABLE PACKAGE WITH DISCRETE LAMINATE HAVING PANEL SECTION WITH EASY-OPEN SEALANT

This application claims the benefit of U.S. Provisional Application No. 61/274,255, filed Aug. 14, 2009, that application incorporated herein by reference in its entirety.

FIELD OF THE INVENTION

This invention relates to an easy-open and reclosable package with a discrete laminate having a panel section with an easy-open sealant, and to methods of making the package.

BACKGROUND OF THE INVENTION

Food and non-food products, including produce, snack foods, cheese and the like have long been packaged in containers such as pouches, bags, or lidded trays or formed webs made from various thermoplastic materials such as polyethylene, polypropylene, or polyester (PET). These containers can be formed from a web or webs of thermoplastic material on packaging equipment, using various packaging processes, at a processing/packaging facility. Such equipment and processes includes horizontal form/fill/seal (HFFS), vertical form/fill/seal (VFFS), thermoforming/lidstock, and continuous horizontal packaging (sometimes referred to as Flow-wrap). In each case, the product is manually or automatically placed in a pouch, bag, formed web, tray, etc., the filled container is optionally vacuumized or gas flushed, and the mouth of the container is hermetically or non-hermetically sealed to close and finish the package.

Opening of the finished package (i.e. opening with the use of tools such as scissors or knives) can provide access to the product by the consumer.

Common in the industry is the use of plastic zipper closures; press-to-close or slide zippers; interlocking closures; reclosable fasteners with interlockable fastener elements; interlocking rib and groove elements having male and female profiles; interlocking alternating hook-shaped closure members, and the like. These terms appear in the patent literature, and to some extent may overlap in meaning. These features provide reclosability, and in some cases may provide an easy-open feature to the package. However, such features are not always easy to open or reclose.

Also relatively common is the use of pressure sensitive adhesive to provide a reclosability feature to a package. However, based on the position of the adhesive relative to the package, the adhesive can sometimes be contaminated by the contained product before the package is opened, or once the package is opened, when product is removed from the package and comes in contact with the adhesive. This phenomenon can compromise the reclosability of the package.

There is need in the marketplace for a package, and methods of packaging that can be used in a manner that requires little or no modification to the packager's packaging equipment, while providing a manually (i.e. by hand, without the need for tools such as scissors or knives) openable and easy to reclose feature, optionally while maintaining hermeticity of the package when made, and without the use of a plastic zipper closure; press-to-close or slide zipper; interlocking closure; reclosable fastener with interlockable fastener elements; interlocking rib and groove elements having male and female profiles; interlocking alternating hook-shaped closure members, and the like.

Some retail packages currently do not offer an easy-open and/or reclosable feature. Examples are some produce bags and snack food bags. In the produce market, there is a need for a cost-effective way to manually open, and repeatably reclose, retail produce bags, e.g. a package made in HFFS, VFFS, thermoforming/lidstock, or continuous horizontal packaging processes.

The present invention relates to a package, and methods of making the package, which package is manually openable, and reclosable, i.e. can be opened and reclosed a number of times and adapted to package non-food products, as well as food products such as e.g. produce, snack foods, cheese, luncheon meat, sausage, culinary nuts, trail mix, etc. The package optionally maintains a hermetic seal until the package is opened.

There is also a need in the marketplace for a discrete laminate that can be anchored to a processor's packaging material of choice to provide easy-open and reclosable functionalities to a package made from that web/laminate combination, with only relatively minor modifications to the processor's packaging material, packaging process or equipment.

SUMMARY OF THE INVENTION

Statement of Invention/Embodiments of the Invention

In a first aspect, an easy-open and reclosable package comprises:

- a pouch comprising
  - a first and second side panel each comprising an outer and inner surface, a first and second side edge, and a first and second end, the first and second side panels joined together along their respective first and second side edges with a seal;
  - a first end;
  - a second end defined by the second ends of the first and second side panels respectively; and
  - a discrete laminate having a first and second end, the discrete laminate comprising
    - a tape comprising
      - a base strip comprising a first and second surface, a first and second side edge, and a first and second end, at least one of the first and second surfaces of the base strip comprising a sealant, and a pressure sensitive adhesive coated on at least a first portion of the first surface of the base strip, and
      - a panel section comprising an outer and inner surface, a first and second side edge, and a first and second end, the inner surface comprising an easy-open sealant, wherein
        - the at least first portion of the first surface of the base strip is adhered by the pressure sensitive adhesive to a first part of the inner surface of the panel section,
        - the panel section and the second side panel are joined together along at least a portion of their respective first and second side edges with an easy-open seal;
        - the first end of the panel section is joined to the second side panel with an easy-open seal;
        - the first end of the panel section extends beyond the first end of the base strip;
        - the discrete laminate is anchored to the first side panel, and when the package is opened, the package can thereafter be reclosed by adhering the first or second side panel to the pressure sensitive adhesive; and a product disposed in the pouch.

Optionally, according to various embodiments of the first aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the inner surface of the first or second side panel respectively with an easy-open seal.

the first surface of the base strip is sealed to the inner surface of the panel section.

a second part of the outer surface of the panel section is anchored to the inner surface of the first side panel.

a second portion of the first surface of the base strip is anchored to the inner surface of the first side panel.

a second portion of the first surface of the base strip is anchored to the inner surface of the first side panel, and a second part of the inner surface of the panel section is anchored to the outer surface of the first side panel.

a second part of the inner surface of the panel section is anchored to the outer surface of the first side panel.

a second portion of the second surface of the base strip is anchored to the outer surface of the first side panel.

the first end of the panel section, and the first end of the second side panel, are joined together with an easy-open seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package is absent a die cut in the panel section.

the package is absent a die cut in the first side panel.

the package can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and second side panel respectively, and the second side edge of the base strip is disposed between and sealed to the second side edge of the panel section and second side panel respectively.

In a second aspect, an easy-open and reclosable package comprises a pouch comprising a folded web comprising an exterior surface and an interior surface, and a first edge and a second edge, a first transverse seal at a first end of the folded web, a second transverse seal at a second end of the folded web, and a longitudinal seal extending along the length of the folded web;

a discrete laminate comprising a tape comprising a base strip comprising a first and second surface, a first and second side edge, and a first and second end, at least one of the first and second surfaces of the base strip comprising a sealant, a pressure sensitive adhesive coated on at least a first portion of the first surface of the base strip, and a panel section comprising an outer and inner surface, a first and second edge, and a first and second side end, the inner surface comprising an easy-open sealant, wherein the at least first portion of the first surface of the base strip is adhered by the pressure sensitive adhesive to a first part of the inner surface of the panel section, and when the package is opened, the package can thereafter be reclosed by adhering the folded web to the pressure sensitive adhesive;

wherein the discrete laminate is sealed at the longitudinal seal to the folded web;

wherein the first end of the panel section extends beyond the first end of the base strip; and wherein the discrete laminate is anchored to the folded web; and a product disposed in the pouch.

Optionally, according to various embodiments of the second aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the interior surface of the folded web with an easy-open seal.

the first surface of the base strip is sealed to the inner surface of the panel section.

a second part of the outer surface of the panel section is anchored to the interior surface of the folded web.

a second portion of the first surface of the base strip is anchored to the interior surface of the folded web.

a second portion of the first surface of the base strip is anchored to the interior surface of the folded web, and a second part of the inner surface of the panel section is anchored to the exterior surface of the folded web.

a second part of the inner surface of the panel section is anchored to the exterior surface of the folded web.

a second portion of the second surface of the base strip is anchored to the exterior surface of the folded web.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package is absent a die cut in the panel section.

the package can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

In a third aspect, a method of making an easy-open and reclosable package in a horizontal form/fill/seal process comprises providing a lay-flat web comprising a first and second surface;

providing a discrete laminate comprising a tape comprising a base strip comprising a first and second surface, a first and second side edge, and a first and second end, at least one of the first and second surfaces of the base strip comprising a sealant, and a pressure sensitive adhesive coated on at least a first portion of the first surface of the base strip, and a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section;

advancing the lay-flat web to a forming device to convert the lay-flat web to a folded web;

advancing the discrete laminate such that when the package is made, the discrete laminate is part of the package;

making side seals in the folded web and the discrete laminate;

cutting the folded web and the discrete laminate to produce an open pouch comprising a first and second side panel each comprising an outer and inner surface, a first and second side edge, and a first and second end, the first and second side panels joined together along their respective first and second side edges by a seal, the panel section and the second side panel joined together along at least a portion of their respective first and second side edges with an easy-open seal, the first end of the panel section joined to the second side panel by an easy-open seal, and the first end of the panel section extending beyond the first end of the base strip;

putting a product in the open pouch; and sealing a first end of the pouch to close the pouch;

wherein when the package is opened, the package can thereafter be reclosed by adhering any one of the first or second side panel to the pressure sensitive adhesive; and wherein, at any time before or during putting a product in the open pouch, the discrete laminate is anchored to the lay-flat web, the folded web, or the first side panel.

Optionally, according to various embodiments of the third aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the inner surface of the first or second side panel respectively with an easy-open seal.

the first surface of the base strip is sealed to the inner surface of the panel section.

a second part of the outer surface of the panel section is anchored to the inner surface of the first side panel.

a second portion of the first surface of the base strip is anchored to the inner surface of the first side panel.

a second portion of the first surface of the base strip is anchored to the inner surface of the first side panel, and a second part of the inner surface of the panel section is anchored to the outer surface of the first side panel.

a second part of the inner surface of the panel section is anchored to the outer surface of the first side panel.

a second portion of the second surface of the base strip is anchored to the outer surface of the first side panel.

the first end of the panel section, and the first end of the second side panel, are joined together with an easy-open seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package is absent a die cut in the panel section.

the package is absent a die cut in the first side panel.

the package can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and second side panel respectively, and the second side edge of the base strip is disposed between and sealed to the second side edge of the panel section and second side panel respectively.

In a fourth aspect, a method of making an easy-open and reclosable package in a horizontal form/fill/seal process comprises providing a lay-flat web comprising a first and second surface;

providing a discrete laminate having a first and second end, the discrete laminate comprising a tape comprising a base strip comprising a first and second surface, a first and second side edge, and a first and second end, at least one of the first and second surfaces of the base strip comprising a sealant, and a pressure sensitive adhesive coated on at least a first portion of the first surface of the base strip, and a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section;

wherein the discrete laminate is anchored to the lay-flat web;

advancing the lay-flat web with the discrete laminate anchored thereto to a forming device to convert the lay-flat web to a folded web;

making side seals in the folded web and the discrete laminate;

cutting the folded web and the discrete laminate to produce an open pouch comprising a first and second side panel each comprising an outer and inner surface, a first and second side edge, and a first and second end, the first and second side panels joined together along their respective first and second side edges by a seal, the panel section and the second side panel joined together along at least a portion of their respective first and second side edges with an easy-open seal, the first end of the panel section joined to the second side panel with an easy-open seal, the first end of the panel section extending beyond the first end of the base strip; and the discrete laminate anchored to the first side panel;

putting a product in the open pouch; and sealing a first end of the pouch to close the pouch;

wherein when the package is opened, the package can thereafter be reclosed by adhering the first or second side panel to the pressure sensitive adhesive.

Optionally, according to various embodiments of the fourth aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the inner surface of the first or second side panel respectively with an easy-open seal.

the first surface of the base strip is sealed to the inner surface of the panel section.

a second part of the outer surface of the panel section is anchored to the inner surface of the first side panel.

a second portion of the first surface of the base strip is anchored to the inner surface of the first side panel.

a second portion of the first surface of the base strip is anchored to the inner surface of the first side panel, and a second part of the inner surface of the panel section is anchored to the outer surface of the first side panel.

a second part of the inner surface of the panel section is anchored to the outer surface of the first side panel.

a second portion of the second surface of the base strip is anchored to the outer surface of the first side panel.

the first end of the panel section, and the first end of the second side panel, are joined together with an easy-open seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package is absent a die cut in the panel section.

the package is absent a die cut in the first side panel.

the package can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and second side panel respectively, and the second side edge of the base strip is disposed between and sealed to the second side edge of the panel section and second side panel respectively.

In a fifth aspect, a method of making an easy-open and reclosable package in a vertical form/fill/seal process comprises providing a lay-flat web comprising a first and second surface;

providing a discrete laminate comprising a tape comprising a base strip comprising a first and second surface, a first and second side edge, and a first and second end, at least one of the first and second surfaces of the base strip comprising a sealant, and a pressure sensitive adhesive coated on at least a first portion of the first surface of the base strip, and a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section;

advancing the lay-flat web over a forming device to convert the lay-flat web to a folded web having an inner surface;

advancing the discrete laminate such that when the package is made, the discrete laminate is part of the package;

making a longitudinal seal in the folded web and the discrete laminate;

transversely sealing the folded web and the discrete laminate to produce a first transverse seal to define a first pouch, wherein the first transverse seal is a bottom transverse seal of the first pouch;

putting a product in the first pouch;

advancing the folded web and the discrete laminate, with the first pouch, downward a predetermined distance;

transversely sealing the first pouch to produce a top transverse seal in the first pouch, and a bottom transverse seal in a second pouch, the second pouch disposed above the first pouch; and transversely cutting the folded web and the discrete laminate to separate the first pouch from the second pouch to make a package, the package comprising a first and second side panel each comprising an outer and inner surface, a first and second side edge, and a first and second end, the first and second side panels joined together along their respective first and second side edges with a seal, the panel section and the second side panel joined together along at least a portion of their respective first and second side edges with an easy-open seal, the first end of the panel section joined to the second side panel with an easy-open seal, the first end of the panel section extending beyond the first end of the base strip; and the discrete laminate anchored to the first side panel;

wherein when the package is opened, the package can thereafter be reclosed by adhering any one of the first or second side panel to the pressure sensitive adhesive; and wherein, at any time before or during the step of making the longitudinal seal, the discrete laminate is anchored to the lay-flat web or the folded web.

Optionally, according to various embodiments of the fifth aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the inner surface of the first or second side panel respectively with an easy-open seal.

the first surface of the base strip is sealed to the inner surface of the panel section.

a second part of the outer surface of the panel section is anchored to the inner surface of the first side panel.

a second portion of the first surface of the base strip is anchored to the inner surface of the first side panel.

a second portion of the first surface of the base strip is anchored to the inner surface of the first side panel, and a second part of the inner surface of the panel section is anchored to the outer surface of the first side panel.

a second part of the inner surface of the panel section is anchored to the outer surface of the first side panel.

a second portion of the second surface of the base strip is anchored to the outer surface of the first side panel.

the first end of the panel section, and the first end of the second side panel, are joined together with an easy-open seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package is absent a die cut in the panel section.

the package is absent a die cut in the first side panel.

the package can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and second side panel respectively, and the second side edge of the base strip is disposed between and sealed to the second side edge of the panel section and second side panel respectively.

In a sixth aspect, a method of making an easy-open and reclosable package in a vertical form/fill/seal process comprises providing a lay-flat web comprising a first and second surface;

providing a discrete laminate comprising a tape comprising a base strip comprising a first and second surface, a first and second side edge, and a first and second end, at least one of the first and second surfaces of the base strip comprising a sealant, and a pressure sensitive adhesive coated on at least a first portion of the first surface of the base strip, and a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section;

wherein the discrete laminate is anchored to the lay-flat web;

advancing the lay-flat web with the discrete laminate anchored thereto over a forming device to convert the lay-flat web to a folded web;

making a longitudinal seal in the folded web and the discrete laminate;

transversely sealing the folded web and the discrete laminate to produce a first transverse seal to define a first pouch, wherein the first transverse seal is a bottom transverse seal of the first pouch;

putting a product in the first pouch;

advancing the folded web and the discrete laminate, with the first pouch, downward a predetermined distance;

transversely sealing the first pouch to produce a top transverse seal in the first pouch, and a bottom transverse seal in a second pouch, the second pouch disposed above the first pouch; and transversely cutting the folded web and the discrete laminate to separate the first pouch from the second pouch to make a package, the package comprising a first and second side panel each comprising an outer and inner surface, a first and second side edge, and a first and second end, the first and second side panels joined together along their respective first and second side edges with a seal, the panel section and the second side panel joined together along at least a portion of their respective first and second side edges with an easy-open seal, the first end of the panel section joined to the second side panel with an easy-open seal, and the first end of the panel section extending beyond the first end of the base strip; the discrete laminate anchored to the first side panel;

wherein when the package is opened, the package can thereafter be reclosed by adhering the first or second side panel to the pressure sensitive adhesive.

Optionally, according to various embodiments of the sixth aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the inner surface of the first or second side panel respectively with an easy-open seal.

the first surface of the base strip is sealed to the inner surface of the panel section.

a second part of the outer surface of the panel section is anchored to the inner surface of the first side panel.

a second portion of the first surface of the base strip is anchored to the inner surface of the first side panel.

a second portion of the first surface of the base strip is anchored to the inner surface of the first side panel, and a second part of the inner surface of the panel section is anchored to the outer surface of the first side panel.

a second part of the inner surface of the panel section is anchored to the outer surface of the first side panel.

a second portion of the second surface of the base strip is anchored to the outer surface of the first side panel.

the first end of the panel section, and the first end of the second side panel, are joined together with an easy-open seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package is absent a die cut in the panel section.

the package is absent a die cut in the first side panel.

the package can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and second side panel respectively, and the second side edge of the base strip is disposed between and sealed to the second side edge of the panel section and second side panel respectively.

In a seventh aspect, a method of making an easy-open and reclosable package having a formed web comprises providing a formed web comprising a first and second end, and a product cavity;

providing a product;

providing a lidstock comprising an outer and inner surface, and a first and second end, comprising a lay-flat web comprising an outer and inner surface, and a discrete laminate comprising a tape comprising a base strip comprising a first and second surface, a first and second side edge, and a first and second end, at least one of the first and second surfaces of the base strip comprising a sealant, and a pressure sensitive adhesive coated on at least a first portion of the first surface of the base strip, a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section, the first end of the panel section extending beyond the first end of the base strip;

placing the product in the product cavity;

sealing the inner surface of the lidstock to the formed web; and cutting the lidstock and formed web to make the package, wherein when the package is opened, the package can thereafter be reclosed by adhering the formed web to the pressure sensitive adhesive, and at any time before or during the step of sealing the inner surface of the lidstock to the formed web, the discrete laminate is anchored to the lay-flat web.

Optionally, according to various embodiments of the seventh aspect of the invention, taken alone or in any suitable combination of these embodiments:

both the first and second surfaces of the base strip comprise a sealant.

at least one of the first and second surfaces of the base strip comprises an easy-open sealant.

the first surface of the base strip is sealed to the inner surface of the panel section.

a second part of the outer surface of the panel section is anchored to the inner surface of the lay-flat web.

a second portion of the first surface of the base strip is anchored to the inner surface of the lay-flat web.

a second portion of the first surface of the base strip is anchored to the inner surface of the lay-flat web, and a second part of the inner surface of the panel section is anchored to the outer surface of the lay-flat web.

a second part of the inner surface of the panel section is anchored to the outer surface of the lay-flat web.

a second portion of the second surface of the base strip is anchored to the outer surface of the lay-flat web.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package is absent a die cut in the panel section.

the package is absent a die cut in the lay-flat web.

the package can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and formed web respectively, and the second side edge of the base strip is disposed between and sealed to the second side edge of the panel section and formed web respectively.

In an eighth aspect, a method of making an easy-open and reclosable package having a formed web comprises providing a formed web comprising a first and second end, and a product cavity;

providing a product;

providing a lidstock comprising an outer and inner surface, and a first and second end, comprising a lay-flat web comprising an outer and inner surface, and
a discrete laminate comprising
a tape comprising
a base strip comprising a first and second surface, a first and second side edge, and a first and second end, at least one of the first and second surfaces of the base strip comprising a sealant, and a pressure sensitive adhesive coated on at least a first portion of the first surface of the base strip,
a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section, the first end of the panel section extending beyond the first end of the base strip;
wherein the discrete laminate is anchored to the lay-flat web;
placing the product in the product cavity;
sealing the inner surface of the lidstock to the formed web; and
cutting the lidstock and formed web to make the package,
wherein when the package is opened, the package can thereafter be reclosed by adhering the formed web to the pressure sensitive adhesive.

Optionally, according to various embodiments of the eighth aspect of the invention, taken alone or in any suitable combination of these embodiments:

both the first and second surfaces of the base strip comprise a sealant.
at least one of the first and second surfaces of the base strip comprises an easy-open sealant.
the first surface of the base strip is sealed to the inner surface of the panel section.
a second part of the outer surface of the panel section is anchored to the inner surface of the lay-flat web.
a second portion of the first surface of the base strip is anchored to the inner surface of the lay-flat web.
a second portion of the first surface of the base strip is anchored to the inner surface of the lay-flat web, and a second part of the inner surface of the panel section is anchored to the outer surface of the lay-flat web.
a second part of the inner surface of the panel section is anchored to the outer surface of the lay-flat web.
a second portion of the second surface of the base strip is anchored to the outer surface of the lay-flat web.
the second end of the base strip extends beyond the second end of the panel section.
the second end of the panel section extends beyond the second end of the base strip.
the second end of the panel section is co-extensive with the second end of the base strip.
the package is absent any zipper.
the package is absent a discrete release liner for a PSA layer or coating.
the package is absent a die cut in the panel section.
the package is absent a die cut in the lay-flat web.
the package can be opened with a peel force of from 25 grams/inch to 5 pounds/inch.
when the package is opened, the base strip is not torn through the entire thickness of the base strip.
the second surface of the base strip is substantially free from PSA.
the package is absent a discrete thread or tear strip.
a supplemental seal seals the panel section to the first end of the base strip.
the first side edge of the base strip is disposed between and sealed to the first side edge of the panel section and formed web respectively, and the second side edge of the base strip is disposed between and sealed to the second side edge of the panel section and formed web respectively.

In a ninth aspect, a method of making an easy-open and reclosable package in a continuous horizontal packaging process comprises providing a lay-flat web comprising a first and second surface;
providing a discrete laminate comprising
a tape comprising
a base strip comprising a first and second surface, a first and second side edge, and a first and second end, at least one of the first and second surfaces of the base strip comprising a sealant, and a pressure sensitive adhesive coated on at least a first portion of the first surface of the base strip, and
a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section;
advancing the lay-flat web to a forming device to convert the lay-flat web to a folded web having an inner surface;
advancing the discrete laminate such that when the package is made, the discrete laminate is part of the package;
advancing a product to the forming device such that the folded web and the discrete laminate envelop the product;
making a longitudinal seal in the folded web and the discrete laminate;
transversely sealing the folded web and the discrete laminate, with the product therein, to produce a leading transverse seal to define a first pouch;
advancing the folded web and the discrete laminate, with the leading transverse seal, forward a predetermined distance;
transversely sealing the first pouch to produce a trailing transverse seal in the first pouch, and a leading transverse seal in a second pouch, the second pouch disposed upstream of the first pouch; and
transversely cutting the folded web and the discrete laminate to separate the first pouch from the second pouch to make a package, the package comprising a first and second side panel each comprising an outer and inner surface, a first and second side edge, and a first and second end, the first and second side panels joined together along their respective first and second side edges with a seal, the panel section and the second side panel joined together along at least a portion of their respective first and second side edges with an easy-open seal, the first end of the panel section joined to the second side panel with an easy-open seal, the first end of the panel section extending beyond the first end of the base strip; and the discrete laminate anchored to the first side panel;

wherein when the package is opened, the package can thereafter be reclosed by adhering the first or second side panel to the pressure sensitive adhesive, and wherein, at any time before or during the step of making the longitudinal seal, the discrete laminate is anchored to the lay-flat web or the folded web.

Optionally, according to various embodiments of the ninth aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the inner surface of the first or second side panel respectively with an easy-open seal.

the first surface of the base strip is sealed to the inner surface of the panel section.

a second part of the outer surface of the panel section is anchored to the inner surface of the first side panel.

a second portion of the first surface of the base strip is anchored to the inner surface of the first side panel.

a second portion of the first surface of the base strip is anchored to the inner surface of the first side panel, and a second part of the inner surface of the panel section is anchored to the outer surface of the first side panel.

a second part of the inner surface of the panel section is anchored to the outer surface of the first side panel.

a second portion of the second surface of the base strip is anchored to the outer surface of the first side panel.

the first end of the panel section, and the first end of the second side panel, are joined together with an easy-open seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package is absent a die cut in the panel section.

the package is absent a die cut in the first side panel.

the package can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and second side panel respectively, and the second side edge of the base strip is disposed between and sealed to the second side edge of the panel section and second side panel respectively.

In a tenth aspect, a method of making an easy-open and reclosable package in a continuous horizontal packaging process comprises providing a lay-flat web comprising a first and second surface;

providing a discrete laminate comprising a tape comprising a base strip comprising a first and second surface, a first and second side edge, and a first and second end, at least one of the first and second surfaces of the base strip comprising a sealant, and a pressure sensitive adhesive coated on at least a first portion of the first surface of the base strip, and a panel section comprising an outer and inner surface, a first and second side edge, and a first and second end, the inner surface comprising an easy-open sealant, wherein the at least first portion of the first surface of the base strip is adhered, by the pressure sensitive adhesive, to the inner surface of the panel section, wherein the discrete laminate is anchored to the lay-flat web;

advancing the lay-flat web with the discrete laminate anchored thereto to a forming device to convert the lay-flat web to a folded web having an inner surface;

advancing a product to the forming device such that the folded web and the discrete laminate envelop the product;

making a longitudinal seal in the folded web and the discrete laminate;

transversely sealing the folded web and the discrete laminate, with the product therein, to produce a leading transverse seal to define a first pouch;

advancing the folded web and the discrete laminate, with the leading transverse seal, forward a predetermined distance;

transversely sealing the first pouch to produce a trailing transverse seal in the first pouch, and a leading transverse seal in a second pouch, the second pouch disposed upstream of the first pouch; and transversely cutting the folded web and the discrete laminate to separate the first pouch from the second pouch to make a package, the package comprising a first and second side panel each comprising an outer and inner surface, first and second side edges, and a first and second end, the first and second side panels joined together along their respective first and second side edges with a seal, the panel section and second side panel joined along at least a portion of their respective first and second side edges with an easy-open seal, the first end of the panel section joined to the second side panel with an easy-open seal, the first end of the panel section extending beyond the first end of the base strip, and the discrete laminate anchored to the first side panel;

wherein when the package is opened, the package can thereafter be reclosed by adhering the first or second side panel to the pressure sensitive adhesive.

Optionally, according to various embodiments of the tenth aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the inner surface of the first or second side panel respectively with an easy-open seal.

the first surface of the base strip is sealed to the inner surface of the panel section.

a second part of the outer surface of the panel section is anchored to the inner surface of the first side panel.

a second portion of the first surface of the base strip is anchored to the inner surface of the first side panel.

a second portion of the first surface of the base strip is anchored to the inner surface of the first side panel, and a second part of the inner surface of the panel section is anchored to the outer surface of the first side panel.

a second part of the inner surface of the panel section is anchored to the outer surface of the first side panel.

a second portion of the second surface of the base strip is anchored to the outer surface of the first side panel.

the first end of the panel section, and the first end of the second side panel, are joined together with an easy-open seal.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the package is absent any zipper.

the package is absent a discrete release liner for a PSA layer or coating.

the package is absent a die cut in the panel section.

the package is absent a die cut in the first side panel.

the package can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and second side panel respectively, and the second side edge of the base strip is disposed between and sealed to the second side edge of the panel section and second side panel respectively.

In an eleventh aspect, a pouch comprises a first and second side panel each comprising an outer and inner surface, a first and second side edge, and a first and second end, the first and second side panels joined together along their respective first and second side edges with a seal;

a first end;

a second end defined by the second ends of the first and second side panels respectively; and a discrete laminate having a first and second end, the discrete laminate comprising a tape comprising a base strip comprising a first and second surface, a first and second side edge, and a first and second end, at least one of the first and second surfaces of the base strip comprising a sealant, and a pressure sensitive adhesive coated on at least a first portion of the first surface of the base strip, and a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section, the first end of the panel section is joined to the second side panel with an easy-open seal;

the panel section and the second side panel are joined together along at least a portion of their respective first and second side edges with an easy-open seal;

the first end of the panel section extends beyond the first end of the base strip;

the discrete laminate is anchored to the first side panel, and when the package is opened, the package can thereafter be reclosed by adhering the first or second side panel to the pressure sensitive adhesive.

Optionally, according to various embodiments of the eleventh aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the inner surface of the first or second side panel respectively with an easy-open seal.

the first surface of the base strip is sealed to the inner surface of the panel section.

a second part of the outer surface of the panel section is anchored to the inner surface of the first side panel.

a second portion of the first surface of the base strip is anchored to the inner surface of the first side panel.

a second portion of the first surface of the base strip is anchored to the inner surface of the first side panel, and a second part of the inner surface of the panel section is anchored to the outer surface of the first side panel.

a second part of the inner surface of the panel section is anchored to the outer surface of the first side panel.

a second portion of the second surface of the base strip is anchored to the outer surface of the first side panel.

the second end of the first side panel, and the second end of the second side panel, are joined together with a seal.

the second end of the first side panel, and the second end of the second side panel, are joined together with a fold.

the second end of the base strip extends beyond the second end of the panel section.

the second end of the panel section extends beyond the second end of the base strip.

the second end of the panel section is co-extensive with the second end of the base strip.

the pouch, and a package made from the pouch, is absent any zipper.

the pouch, and a package made from the pouch, is absent a discrete release liner for a PSA layer or coating.

the pouch, and a package made from the pouch, is absent a die cut in the panel section.

the pouch, and a package made from the pouch, is absent a die cut in the first side panel.

a package made from the pouch can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and second side panel respectively, and the second side edge of the base strip is disposed between and sealed to the second side edge of the panel section and second side panel respectively.

In a twelfth aspect, a method of making a bag with a discrete laminate disposed thereon comprises extruding a thermoplastic tube to make a bag tubing;

providing a discrete laminate having a first and second end, the discrete laminate comprising a tape comprising a base strip comprising a first and second surface, a first and second side edge, and a first and second end, at least one of the first and second surfaces of the base strip comprising a sealant, and a pressure sensitive adhesive coated on at least a first portion of the first surface of the base strip, a panel section comprising an outer and inner surface, a first and second side edge, and a first and second end, the inner surface comprising a sealant, wherein the at least first portion of the first surface of the base strip is adhered by the pressure sensitive adhesive to a first part of the inner surface of the panel section;

slitting the tubing at a longitudinal edge thereof to make a slit bag tubing;

anchoring the discrete laminate to the slit bag tubing; and transversely cutting and sealing the slit bag tubing at predetermined intervals to make a plurality of individual bags, each bag comprising a first and second side panel each comprising an outer and inner surface, first and second side edges, and a first and second end, the first and second side panels joined together along their respective first and second side edges by a seal, a first end defined by the first ends of the first and second side panels respectively, an end fold defined by the second ends of the first and second side panels respectively, the panel section and second side panel joined along at least a portion of their respective first and second side edges with an easy-open seal, the first end of the panel section joined to the second side panel with an easy-open seal, the first end of the panel section extending beyond the first end of the base strip; and the discrete laminate anchored to the first side panel;

wherein at any time before or during the step of slitting the bag tubing, the at least first portion of the first surface of the base strip is adhered, by the pressure sensitive adhesive, to a part of the inner surface of the panel section; and wherein when the bag is sealed to make a package, and the package is then opened, the package can thereafter be reclosed by adhering the first or second panel to the pressure sensitive adhesive.

Optionally, according to various embodiments of the twelfth aspect of the invention, taken alone or in any suitable combination of these embodiments:

both the first and second surfaces of the base strip comprise a sealant.

at least one of the first and second surfaces of the base strip comprises an easy-open sealant.

at least one of the first and second surfaces of the base strip is sealed to the inner surface of the first or second side panel respectively with an easy-open seal.

the first surface of the base strip is sealed to the inner surface of the panel section.

a second part of the outer surface of the panel section is anchored to the inner surface of the first side panel.

a second portion of the first surface of the base strip is anchored to the inner surface of the first side panel.

a second portion of the first surface of the base strip is anchored to the inner surface of the first side panel, and a second part of the inner surface of the panel section is anchored to the outer surface of the first side panel.

a second part of the inner surface of the panel section is anchored to the outer surface of the first side panel.

a second portion of the second surface of the base strip is anchored to the outer surface of the first side panel.

the second end of the base strip extends beyond the second end of the panel section.

the second end of the panel section extends beyond the second end of the base strip.

the second end of the panel section is co-extensive with the second end of the base strip.

the bag, and a package made from the bag, is absent any zipper.

the bag, and a package made from the bag, is absent a discrete release liner for a PSA layer or coating.

the bag, and a package made from the bag, is absent a die cut in the panel section.

the bag, and a package made from the bag, is absent a die cut in the first side panel a package made from the bag can be opened with a peel force of from 25 grams/inch to 5 pounds/inch.

when the package is opened, the base strip is not torn through the entire thickness of the base strip.

the second surface of the base strip is substantially free from PSA.

the package is absent a discrete thread or tear strip.

a supplemental seal seals the panel section to the first end of the base strip.

the first side edge of the base strip is disposed between and sealed to the first side edge of the panel section and second side panel respectively, and the second side edge of the base strip is disposed between and sealed to the second side edge of the panel section and second side panel respectively.

BRIEF DESCRIPTION OF THE DRAWINGS

The present invention is illustrated by reference to the following drawing figures, encompassing different views of various embodiments of the invention, wherein.

DEFINITIONS

Figure 1:
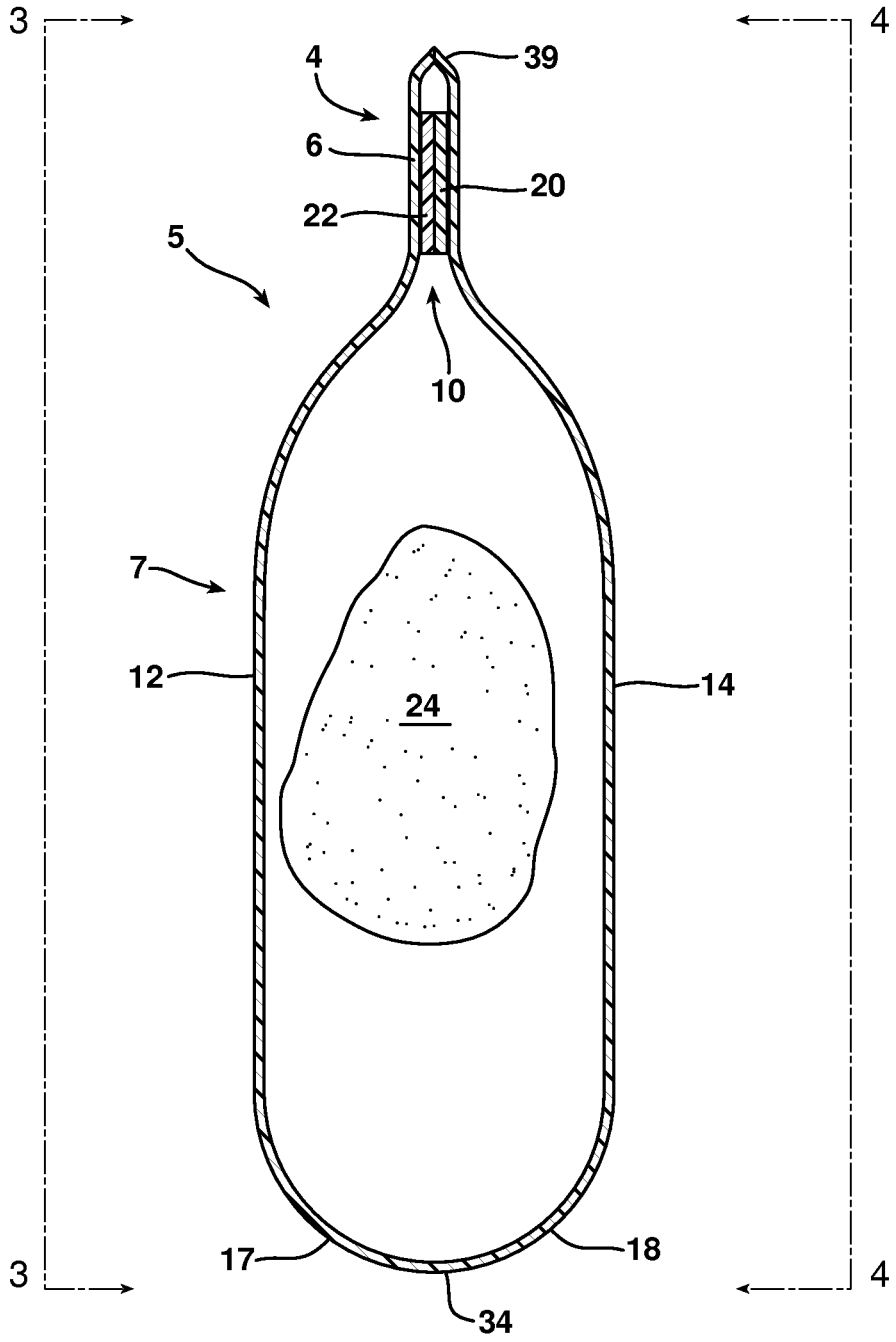
FIG. 1 is an elevational view of a package.

"Anchored", "anchoring" and the like herein refers to sealing or adhering two surfaces together, and refers to the resulting bond between surfaces. Sealing is done by means of a sealant. Adhering is done by means of PSA.

In processes described herein where a discrete laminate is anchored to a web or side panel, either during the process wherein the web and discrete laminate are advanced, or when a discrete laminate has been pre-anchored to the web before the start of the process, anchoring can be done by use of any suitable continuous or discontinuous sealing or adhesive material and method. Such anchoring is done to hold the discrete laminate to the web or panel during the relevant packaging process.

In some embodiments, wherein the anchor is already relatively strong or continuous, e.g. a heat seal that constitutes either a relatively strong heat seal, or an easy-open seal as defined herein, the anchor functions not only to hold the discrete laminate to the web or panel during the relevant packaging process, but also as a final seal of that surface of the discrete laminate to the web (lay-flat or folded) or panel made from the web.

Any subsequent disclosed or recited step in the process of sealing one of the surfaces (i.e. the anchored surface) of the discrete laminate to a web or panel, is already completed by the anchoring step. In these embodiments, then, contact of a seal device, e.g. a seal bar in the region of the anchor, in a subsequent step, may add no further or separate seal to that surface of the discrete laminate.

Any subsequent step in the process of sealing the other surface of the discrete laminate to a web or panel, then, may in some embodiments add no further or separate seal to the anchored surface of the discrete laminate.

In some embodiments where the bond is a relatively weak or discontinuous one, e.g. a discontinuous seal, spots or narrow stripes of adhesive. etc., in a subsequent step of sealing one of the surfaces of the discrete laminate to the web or panel, a seal bar that seals one of the surfaces of the discrete laminate to the web or panel can contact the web or panel in the region where the anchor is already disposed. The seal in that region may be either enhanced, or initially created, by the subsequent sealing step.

Sealing of a surface of the discrete laminate to a web or panel, as a process step disclosed or recited herein, should be understood in this light.

"Clear area" herein refers to a selected portion or portions of a first surface of the base strip that has substantially no PSA thereon. The clear area(s) can be provided by 1) not applying PSA to the selected portion(s), or 2) applying the PSA over the entire first surface of the strip, followed by removing most or all of the PSA in the selected portion(s), e.g. by scraping the PSA off the strip by suitable means such as a shim or scraper; removal of most or all of the PSA in this manner will typically be done before the PSA has been cured; or 3) applying the PSA relatively uniformly over the entire first surface of the base strip, as is done in the manufacture of labels, followed by masking or deadening the PSA in the selected portion(s) by any suitable means. Masking or deadening agents that are used will substantially reduce or nullify the adhesive effect of the PSA in the selected portion(s), compared with the adhesive effect of the PSA in portions of the first surface adjacent to the selected portion(s). In general, deadening or masking of the PSA is done after the PSA has been cured; removal of most or all of the PSA is done before the PSA has been cured.

"Die cut" herein refers to methods of cutting or scoring materials, including rotary die, steel rule die, platen die cutting, and laser cutting or scoring, and/or the resultant cut or score, other than a die cut used to create the perimeter of a lay-flat web, tape, base strip, or panel section of the invention, or to make a hole in the lay-flat web, tape, base strip, or panel section for a hang-tab, gusset or the like. A package of the invention in several embodiments is absent a die cut, absent a die cut in the panel section, and/or absent a die cut in the first side panel.

"Discrete" with respect to the discrete laminate is used herein to mean independently made (the discrete laminate is not an integral part of the web when the web is made,) or constituting a separate entity from the web, and from a first or second side panel made from the web.

"Easy-open" herein refers to a package that can be manually opened relatively easily. The physical mode of opening may include any one or more of a) actual peeling at the base strip/web interface (adhesive failure), or b) a sealant layer of the base strip breaking completely through, and peeling then occurring between the sealant layer and an adjacent layer within the strip (delamination failure), or c) breaking within a sealant layer by rupturing of the sealant material itself (cohesive failure), or d) simply peeling of a flap away from the PSA, the flap comprising the panel section. The peel force required to open the package can be measured by an evaluation of seal strength or peel strength in accordance with the test procedure set out in ASTM F88, incorporated herein by reference in its entirety, using a crosshead speed of 8 to 12 inches/minute and an initial jaw gap of from 1.00 inch to 2.00 inch. Typical peel forces for opening the package of the invention can range from e.g. 25 grams/inch to 3 pounds/inch, e.g. from 100 grams/inch to 2 pounds/inch, such as from 200 grams/inch to 1.5 pounds/inch. In some cases, the sealant may actually peel away from the surface to which it is adhered (adhesive failure), or breakage of the sealant and delamination along an adjacent layer interface may occur (delamination failure) or a rupture of the sealant can occur (cohesive failure). Depending on the design and geometry of the seal, peel forces can in some embodiments be higher than 3 pounds/inch, e.g. 3.5, 4.0, 4.5, or 5 pounds/inch, or values intermediate these values.

"Easy-open seal" herein refers to a seal involving the base strip or web or panel section in which materials and sealing conditions are chosen for the base strip or web or panel section such that the package is easy-open with a physical mode of opening that includes any one or more of adhesive failure, delamination failure, or cohesive failure as described herein.

"Easy-open sealant" herein refers to a material chosen for one or both surfaces of the base strip or web or panel section, such that when such surface is sealed, it provides a package that is easy-open with a physical mode of opening that includes any one or more of adhesive failure, delamination failure, or cohesive failure as described herein.

"Ethylene/alpha-olefin copolymer" (EAO) herein refers to copolymers of ethylene with one or more comonomers selected from $C_3$ to $C_{10}$ alpha-olefins such as propene, butene-1, hexene-1, octene-1, etc. EAO includes heterogeneous materials such as linear medium density polyethylene (LMDPE), linear low density polyethylene (LLDPE), and very low and ultra low density polyethylene (VLDPE and ULDPE); single-site catalyzed materials such as homogeneous linear ethylene/alpha olefin copolymers and long chain branched ethylene/alpha olefin copolymers; and multicomponent ethylene/alpha-olefin interpenetrating network resin (or "IPN resin").

"Ethylene homopolymer or copolymer" herein refers to polyethylene (PE) such as ethylene homopolymer such as low density polyethylene (LDPE), medium density polyethylene (MDPE), high density polyethylene (HDPE); ethylene/alpha olefin copolymer such as those defined herein; ethylene/vinyl acetate copolymer (EVA); ethylene/alkyl acrylate copolymer such as ethylene/methyl acrylate copolymer (EMA) or ethylene/ethyl acrylate copolymer (EEA), or ethylene/butyl acrylate copolymer (EBA); ethylene/(meth)acrylic acid copolymer; or ionomer resin (IO).

"Fig." and the like herein refers to a drawing figure; "Figs." and the like herein to drawing figures.

"Film" is used herein to mean a thermoplastic film, laminate, or web, either multi-layer or monolayer, that may be used in connection with the present invention. Film can be of any suitable thickness, e.g. between 0.1 and 30 mils, and can be of any suitable length and width.

"Fin seal" is used herein to mean, in the case of a single web, folding one edge of the web towards the opposite edge of the web, and sealing the facing inner surfaces together. In the case of two webs, a fin seal is a seal formed by sealing the inner surface of the edge of one web to the inner surface of a corresponding edge of another web.

"Lap seal" is used herein to mean a seal made by sealing an inside surface of a web to an outside surface of a web. The inside and outside surfaces can both be on a single web; or the inside surface can be of one web, and the outside surface of a second web.

"Lidstock" herein refers to a film used to cover a container or tray that carries a product, and can be sealed to the container or tray, typically as a perimeter heat seal. Lidstock typically is supplied to a food processor as a lay flat film rolled onto a roll.

"Longitudinal seal" herein refers to a fin seal or lap seal.

"Olefinic" and the like herein refers to a polymer or copolymer derived at least in part from an olefinic monomer.

"Oxygen barrier" and the like herein refers to materials having an oxygen permeability, of the barrier material, less than 500 $cm^3$ $O_2/m^2$·day·atmosphere (tested at 1 mil thick and at 25° C., 0% RH according to ASTM D3985), such as less than 100, less than 50, less than 25, less than 10, less than 5, and less than 1 $cm^3$ $O_2/m^2$·day·atmosphere. Examples of polymeric materials useful as oxygen barrier materials are ethylene/vinyl alcohol copolymer (EVOH), polyvinylidene dichloride (PVDC), vinylidene chloride/methyl acrylate copolymer, vinylidene chloride/vinyl chloride copolymer, polyamide (nylon), and polyester (PET).

"Polymer" and the like herein means a homopolymer, but also a copolymer thereof, including terpolymer, tetrapolymer, block copolymer, etc.

"Pouch" herein means a pouch or bag.

"Pressure sensitive adhesive" (PSA) herein refers to a repositionable adhesive that bonds firmly with the application of light pressure. It adheres to most surfaces with very slight pressure; is available in solvent and latex or water based forms, and is often based on non-crosslinked rubber adhesives, acrylics, or polyurethanes. PSA forms viscoelastic bonds that are aggressively and permanently tacky; adhere without the need for more than hand pressure; and require no activation by water, solvent, or heat. Some PSA materials are cured by hot air, electron beam, UV, or chemical (peroxide) means. They are available in a wide variety of chemical compositions and systems including acrylic and methacrylate adhesives, emulsion-based acrylic adhesive; rubber-based pressure sensitive adhesive, styrene copolymers (styrene/isoprene/styrene and styrene/butadiene/styrene block copolymers), and silicones. In some embodiments, hot melt adhesives may be useful as well, are included herein for those embodiments as "PSA"; a hot melt adhesive is a thermoplastic adhesive compound, usually solid at room temperature which becomes fluid on heating for use. Suitable commercial examples of PSA include PS-2000™ from Dow, and "acResin®", available from BASF, and comprising a UV-curable polyacrylate that can be applied by conventional hot-melt coaters at temperatures of about 120° C. Suitable tackifiers can be added to acResin® or like compositions to control the tackiness of the adhesive; examples are FORAL® 85 synthetic resin available from Pinova. Tackifiers can be added to the base adhesive composition in any suitable amount, e.g. from 15% to 25% by weight of the total composition of PSA and tackifier.

"Reclosable" herein refers to a feature or function of a package in accordance with the invention whereby a package can be reclosed by bringing a folded web, panel, or panel section, or portion of a folded web, panel, or panel section into contact with the PSA of the base strip.

"Registration device" herein refers to any mark, pattern, die cut or feature of a web or discrete laminate, that facilitates the advancement of the web or discrete laminate, or a component thereof, in a controlled manner, into a packaging machine, where the web and/or discrete laminate is used to make individual packages. The device can be e.g. printed or placed in uniformly spaced fashion along or near an edge of the web or discrete laminate, i.e. registration marks, or in an area near the middle of a web that does not interfere with decorative printed graphics. These marks are used in connection with appropriate sensors to controllably advance the web or discrete laminate. Where die cuts are used as a registration device, detected by sensors, it may not be necessary to print registration marks on the web or discrete laminate.

"Seal" herein means a bond between two thermoplastic surfaces, e.g. as produced by heat sealing, radio frequency (RF) sealing, ultrasonic sealing, or permanent adhesive, but excluding repositionable adhesive or PSA.

"Sealant" is a polymeric material or blend of materials, such as olefinic polymer or copolymer such as an ethylenic polymer or copolymer, that can form a surface of the base strip, panel, or panel section of the invention, or a web to which the base strip, panel, or panel section is sealed, and form a bond between two thermoplastic surfaces. A permanent adhesive can also be a sealant. "Sealant" herein, with respect to the base strip, panel, or panel section, or a web to which the base strip, panel, or panel section is adhered, excludes a repositionable adhesive or PSA. "Strip", "panel", and "panel section" herein refer to an elongate piece of thermoplastic material, typically longer in a first direction than in a direction perpendicular to the first direction, e.g. rectangular; but can also be square, round, oblong, elliptical, or any appropriate shape in plan view. The strip and panel section can be of any suitable thickness, e.g. between 0.1 and 30 mils.

"Tape" herein refers to a strip with PSA adhered to at least a portion of a first surface of the strip.

"Thermoplastic" herein includes plastic materials that when heated to a softening or melting point may be reshaped without significant thermal degradation (burning). Thermoplastic includes both materials that are not crosslinked, or that are crosslinked by chemical or radiation means.

"Tray" herein refers to a formed member that has a tray bottom, tray sides, and a tray flange around the upper perimeter of the tray, where the tray bottom and tray sides form an internal cavity within which a product can be placed. The cavity can be enclosed by a lidstock sealed to the tray flange.

"Web" is used herein to mean a thermoplastic film, laminate, or web, either multi-layer or monolayer, that may be used in connection with the present invention. The web can be of any suitable thickness, e.g. between 0.1 and 30 mils, and the web can be of any suitable length and width.

"Zipper" and the like herein refers to a plastic zipper closure; press-to-close or slide zipper; interlocking closure; reclosable fastener with interlockable fastener elements; interlocking rib and groove elements having male and female profiles; interlocking alternating hook-shaped closure, and the like.

All compositional percentages used herein are presented on a "by weight" basis, unless designated otherwise.

Drawings herein are not necessarily to scale, and certain features of the invention may be graphically exaggerated for clarity.

DETAILED DESCRIPTION OF THE INVENTION

1. Package

Referring to the drawings, a package 5 according to the invention is shown. Package 5 includes a pouch 7 that can be made from either a single web, or two webs, to form a first side panel 12, and a second side panel 14.

A. Web(s)

In either embodiment, the web or webs comprises a thermoplastic material of any suitable composition, including those having as at least one component olefinic materials such as ethylene or propylene polymers or copolymers, e.g. polyethylene or ethylene/alpha olefin copolymers; polyethylene terephthalate (PET); and including webs typically used in, or useful in, HFFS, VFFS, lidstock/tray, continuous horizontal packaging, and bag making apparatus and processes. The web or webs can be monolayer or multilayer in construction, can be coextruded, laminated, or made by any suitable film making process, and can have any suitable thickness.

Examples of web(s) that can be used with a discrete laminate of the invention include H7225B™, a barrier hybrid material used for products requiring a high oxygen barrier, such as shredded cheese; H7525B™, a barrier hybrid material used for products requiring a high oxygen barrier, such as bacon and smoked and processed meat; H7530B, like H7525B but having a thickness of about 3 mils; CP04140™, a low barrier (high OTR) material used in produce packaging, CPM4090, a microwaveable packaging film for fresh cut produce; and T7225B™, a barrier material used as lidstock (non-forming web) for products requiring a high oxygen barrier, such as luncheon meat. These are all commercial products produced by the Cryovac business unit of Sealed Air Corporation.

H7225B™ is a laminate having the construction PET//adhesive//coextruded barrier film, where the PET is a biaxially oriented polyester film, and the barrier film has the construction LDPE (low density polyethylene)/EVA tie/nylon/EVOH+nylon/nylon/EVA tie/EAO. The overall thickness of the laminate of this construction can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7225B™ can be used as a lidstock (non-forming) web.

H7525B™ is a laminate having the construction PET//adhesive//coextruded barrier film, where the PET is a biaxially oriented polyester film, and the barrier film has in one embodiment the construction LDPE (low density polyethylene)/EVA/LLDPE tie/EVOH/LLDPE tie/EVA/EAO. The overall thickness of the laminate of this construction can be any of several gauges, being typically about 2.5 mils. The LDPE is the surface of the barrier film adhered, by the adhesive, to the PET film. The EAO typically acts as the heat sealant layer of the film, and finished laminate, and in packaging made from the laminate, the EAO will form the inner or sealant surface of the package, facing the contained product, and the PET will form the outer or skin surface of the package. H7525B™ can be used as a lidstock (non-forming) web.

CP04140™ is a laminate having the construction BOPP//adhesive/monolayer LLDPE film. A typical gauge for the laminate is about 1.8 mils. The LLDPE typically acts as the heat sealant layer of the finished laminate, and in packaging made from the laminate, the LLDPE will form the inner or sealant surface of the package, facing the contained product, and the BOPP will form the outer or skin surface of the package.

CPM4090™ is a laminate having the construction BOPP//adhesive/monolayer LLDPE+LDPE film. A typical gauge for the laminate is about 2 mils. The LLDPE+LDPE layer typically acts as the heat sealant layer of the finished laminate, and in packaging made from the laminate, the LLDPE+LDPE will form the inner or sealant surface of the package, facing the contained product, and the BOPP will form the outer or skin surface of the package.

T7225B™ film has the construction EAO/EAO/LLDPE tie/nylon/EVOH/nylon/EVA tie/EVA tie/nylon. The first layer of EAO typically acts as the heat sealant layer of the film, and in packaging made from the laminate, the EAO will form the inner or sealant surface of the package, facing the contained product, and the nylon of the last layer will form the outer or skin surface of the package. T7225B™ is used as a lidstock (non-forming) web.

Referring to the drawings, the first side panel 12 has a top portion 9, a first side edge 31, a second side edge 33, and a lower portion 17. The second side panel 14 has a top portion 11, a first side edge 35, a second side edge 37, and a lower portion 18. The first and second side panels 12 and 14 are joined together along their respective first and second side edges by a seal. As shown, first side edge 31 of first side panel 12 is joined to first side edge 35 of second side panel 14 by a seal 30. Second side edge 33 of first side panel 12 is joined to second side edge 37 of second side panel 14 by a heat seal 32. The second end 34 of the pouch 7 can be either a seal or a fold. Where a single web is used to make the pouch, second end 34 will typically be a fold, although even after the web is folded, a seal such as a heat seal can optionally be installed in the area of the fold. Where two webs of film are used to make panels 12 and 14, second end 34 will be a seal that joins panels 12 and 14 together along their respective lower portions 17 and 18. The two webs can be from the same material, or can be different in composition, structure, etc.

B. Discrete Laminate

Figure 4:
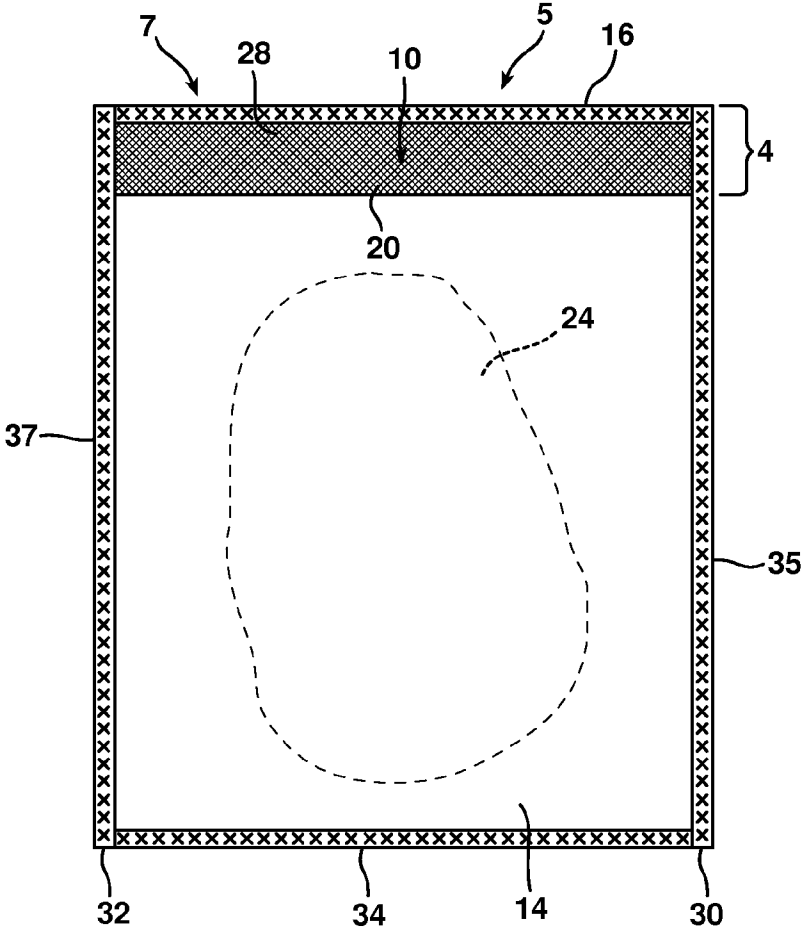
FIG. 4 is a back view of the package of FIG. 1, viewed along lines 4-4 of FIG. 1.
Figure 3:
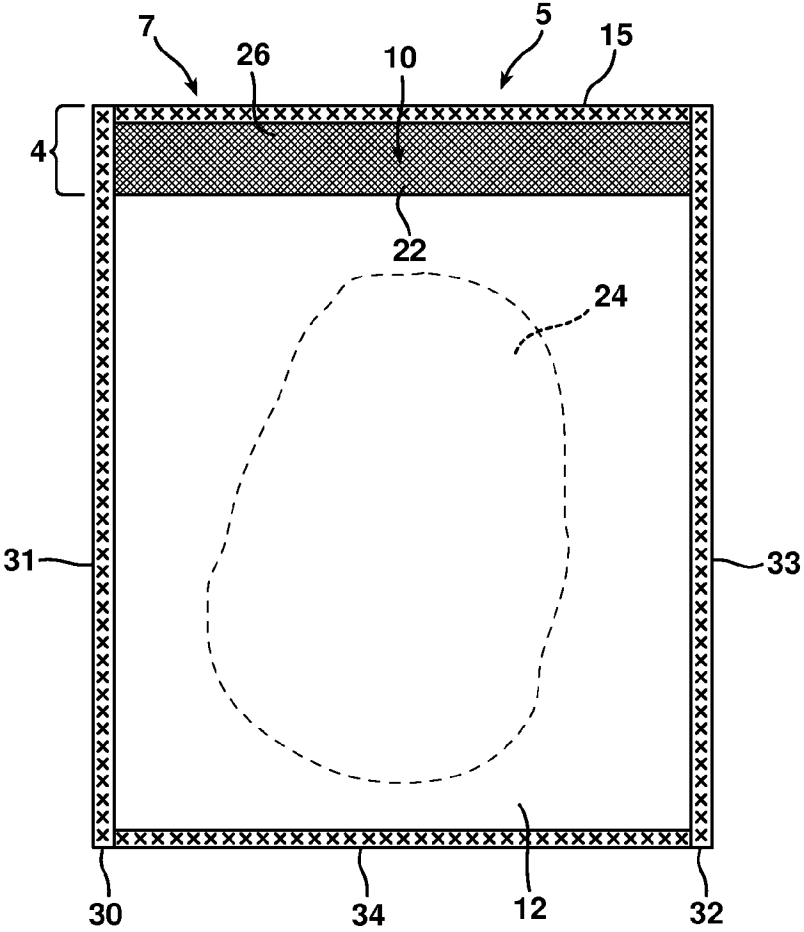
FIG. 3 is a front view of the package of FIG. 1, viewed along lines 3-3 of FIG. 1.

A discrete laminate 4 includes a panel section 6, and a tape 8 including a base strip 10 and a PSA layer 19. Discrete laminate 4 is anchored to the first end of first panel 12. The laminate, panel section, tape, base strip, and PSA layer can each be of any suitable dimension and shape, and will typically be longer in length than in width, with the length being e.g. greater than two times the width, e.g. greater than 3, 4, or 5 times the width. A typical dimension for the discrete laminate is a width of from about 1 to 1.5 inches and a length of about 4 to 10 inches. The strip 10 will be shorter in one dimension than the pouch and package. For example, the strip can extend across the transverse width of a pouch made in e.g. a HFFS or VFFS process, but will be significantly narrower than the length of the package (see e.g. FIGS. 3 and 4). In one embodiment, the strip will occupy less than 50%, such as less than 40%, less than 30%, less than 20%, or less than 10% of the length of the package.

Panel section 6 (e.g. FIGS. 27A to 27D) provides a device that can be manually grasped and pulled away to open the package, and access the contents of the package. The size of the package, type of materials used for the pouch and the strip, the seal strength of the materials used in the strip, and the type of product being packaged can all have some effect on the choice of the optimal length and dimensions of the various components of the package.

Base strip 10 comprises a first surface 23 and a second surface 25. In one embodiment, at least one of these first and second surfaces comprises a sealant. In another embodiment, both of these first and second surfaces comprises a sealant. The first surface 23 is optionally sealed to the inner surface 27 of the first side panel 12, and the second surface 25 is optionally sealed to the inner surface 29 of the second side panel 14. Either or both of the sealants are in one embodiment an easy open sealant. In another embodiment, only the first layer comprises a sealant, either an easy-open sealant, or a relatively strong sealant. The strip can be of multilayer or monolayer construction.

When a product 24 is placed in the pouch 7, by any suitable process such as processes herein disclosed, and the pouch 7 is closed, the package 5 is made.

The base strip and the PSA layer can each be of any suitable thickness. The base strip can for example have a thickness of between 2.0 and 5.0 mils, such as between 2.5 and 4.5 mils, between 3.0 and 4.0 mils, or any thicknesses therebetween. Factors such as the composition of the base strip, arrangement of layers within the base strip, and flexural modulus of the materials used may affect the choice of appropriate thickness of the base strip. The PSA can also have any suitable thickness, typically 0.5 mils, e.g. between 0.1 mil and 1 mil, or 0.2 mils and 0.8 mils, etc.

Any suitable web, including any of the hybrid materials of the type described herein for web materials, e.g. H7225B or a non-barrier analog of such material, can be used to make the panel section 6 and base strip 10, provided that the material chosen for the panel section exhibits an easy-open functionality as described herein. In embodiments where no seal is required between surfaces 25 and 29, a seal between surfaces 23 and 27 can be made either before or after the finished package is made.

In some embodiments, the PSA layer covers the entire first outer surface 23 of the base strip. The PSA serves to adhere the base strip to the inner surface 67 of the panel section 6. In accordance with the invention, the PSA layer also provides, after a package has been made, a reclosability function as described further herein.

The discrete laminate 4 is anchored to the first side panel. In one embodiment, base strip 10 is anchored to the inner surface 27 of first side panel 12 in anchor region "A". In embodiments where the PSA covers the entire first outer surface 23, there is no clear area on the outer surface of the base strip.

In the embodiments disclosed in the drawings, a second portion of the first outer surface of the base strip is substantially free of pressure sensitive adhesive, and the first portion of the first outer surface of the base strip closer to the first end of the pouch than the second portion. The second portion of the first surface is anchored to the inner surface of the first side panel at anchor region "A".

In some embodiments, the first portion of the first outer surface of the base strip is closer to the first end of the pouch than the second portion. The portion of the first surface coated with PSA can be at one terminal portion of the strip, either closest to the first end of the package, or furthest from the first end of the package. Alternatively, the first portion can be disposed intermediate from, and spaced apart from, the two longitudinal (with respect to the first and second ends of the package) ends of the strip, such that clear areas of the base strip are present on both sides of the intermediate portion coated with PSA. Thus, the PSA layer can be coextensive with the first surface of the base strip, or can extend along only one or more terminal or intermediate portions of the strip, and the first surface of the strip can consequently have no clear areas, one clear area, or two or more clear areas.

Alternatively, discrete laminate 4 is anchored to the first side panel by:

- anchoring a second part of the outer surface 66 of the panel section 6 to the inner surface 27 of the first side panel 12.
- anchoring a second portion of the first surface 23 of the base strip 10 to the inner surface 27 of the first side panel 12, and a second part of the inner surface 67 of the panel section 6 to the outer surface 65 of the first side panel 12.
- anchoring a second part of the inner surface 67 of the panel section 6 to the outer surface 65 of the first side panel 12.
- anchoring a second portion of the second surface 25 of the base strip to the outer surface 66 of the first side panel 12.

C. Opening Mechanisms and Strip Construction

The package of the invention can be easily manually opened. Any suitable mechanism or combination of mechanisms for obtaining this functionality and feature can be used according to the invention. The following are examples of such mechanisms.

1. Adhesive Failure

In this embodiment, second surface 25 of base strip 10 and inner surface 29 of second side panel 14 each comprises a polymeric composition that, when surface 25 is sealed to surface 29, forms an easy-open seal. This seal provides an interface that breaks apart upon manually opening the package. The interlaminar bonds between layers of the base strip itself (where the strip is of multilayer construction), the cohesive strength of each layer within the strip or of the single layer of a monolayer strip, and the anchor that holds first surface 23 of base strip 10 to inner surface 27, are stronger than the seal that holds surface 25 to surface 29.

In some embodiments, the polymeric composition of surfaces 25 and 29 will be the same or similar. Useful in these embodiments are the peel systems disclosed in U.S. Pat. No. 4,189,519 (Ticknor) (blend of EVA or EMA or EEA with crystalline isotactic polybutylene, and optionally with anhydride grafted EVA); U.S. Pat No. 4,252,846 (Romesberg et al.) (blend of EVA and HDPE, optionally with IO or polybutylene (PBU)); U.S. Pat. No. 4,550,141 (Hoh) (blend of IO and polypropylene/ethylene copolymer (EPC)); U.S. Pat. No. 4,666,778 (Hwo) (three component blend of PE, that can be LLDPE, LDPE, MDPE, or HDPE, or EVA or EMA, with PBU, and PP or EPC); U.S. Pat. No. 4,882,229 (Hwo) (butene-1 polymer or copolymer blended with modified or unmodified LDPE); U.S. Pat No. 4,916,190 (Hwo) (blend of butylene polymer or copolymer, with PE polymer or copolymer (LLDPE, LDPE, MDPE, EVA, EMA, EEA, EBA, or HDPE), with propylene polymer or copolymer); U.S. Pat. No. 4,937,139 (Genske, et al.) (propylene polymer or copolymer blended with HDPE); U.S. Pat. No. 5,547,752 (Yanidis) (blend of PBU and IO); and U.S. Pat. No. 5,997,968 (Dries et al.) (blend of Component 1 (a copolymer of ethylene and propylene or ethylene and butylene or propylene and butylene or ethylene and another -olefin having 5 to 10 carbon atoms or propylene and another -olefin having 5 to 10 carbon atoms or a terpolymer of ethylene and propylene and butylene or ethylene and propylene and another -olefin having 5 to 10 carbon atoms) and Component 2 (HDPE, MDPE, LDPE, LLDPE or VLDPE); these U.S. patents all incorporated herein by reference in their entirety.

In other embodiments, the composition of surfaces 25 and 29 will differ, i.e. dissimilar sealants are used. Useful in these embodiments are the peel systems disclosed in U.S. Pat. No. 3,655,503 (Stanley et al.) (LDPE or MDPE sealed to polypropylene (PP), EPC, saran, nylon 6, polycarbonate (PC), polyvinyl chloride (PVC), or polyethylene oxide (PEO); PP sealed to saran, nylon 6, PC, PVC, PEO, IO, phenoxy, or EVA; or nylon sealed to IO); U.S. Pat. No. 4,729,476 (Lulham et al.) (a blend of EVA and IO sealed to IO); U.S. Pat. No. 4,784,885 (Carespodi) (PP, HDPE, or LLDPE sealed to substantially linear PE (HDPE, LLDPE) blended with a polyolefinic thermoplastic elastomer such as ethylene propylene diene monomer (EPDM), EPM, butyl rubber, halogenated butyl rubber, isoprene rubber, and styrene butadiene rubber); U.S. Pat. No. 4,859,514 ((Friedrich et al.) (IO or IO blended with EVA, sealed to a blend of EVA and ethylene butene copolymer (EBC) and PP); U.S. Pat. No. 5,023,121 (Pockat, et al.) (a blend of PBU and PP and a third polymeric material selected from EVA, LDPE, LDPE, and IO, sealed to EVA, LDPE, LLDPE, or IO ); these U.S. patents all incorporated herein by reference in their entirety.

Alternatively, the seal between surfaces 23 and 27, instead of or in addition to the seal between surfaces 25 and 29, can function as the easy-open seal.

In some embodiments, surface 25 is not sealed to surface 29, and strip 10 thus remains unattached to second side panel 14 in the finished package, except for any side seals in the package that hold the two ends of base strip 10 between the first and second side panels.

2. Delamination Failure

In this embodiment, one of the interlaminar bonds between layers of the base strip itself (where the strip is of multilayer construction) can be broken. Thus, the interlaminar bond provides the interface that will break apart upon manually opening the package. The seal between surfaces 25 and 29, and between surfaces 23 and 27, and the cohesive strength of each layer within the strip, are stronger than the interlaminar bond. Useful in this embodiment are the peel systems disclosed in U.S. Pat. No. 4,944,409 (Busche et al.), this patent incorporated herein by reference in its entirety.

3. Cohesive Failure

In this embodiment, one of the layers of the base strip itself (where the strip is of multilayer construction) or the monolayer base strip, fractures when the package is opened. The seal between surfaces 25 and 29, and between surfaces 23 and 27, and the interlaminar bonds between layers of the strip itself (where the strip is of multilayer construction) are stronger than the layer that fractures. Useful in this embodiment is the peel system disclosed in U.S. Pat. No. 6,476,137 (Longo) (internal rupture of a sealant layer comprising a blend of an ionomer having a melt flow index of less than 5, and a modified ethylene/vinyl acetate copolymer having a substantially higher melt flow index, where the melt flow indices of the two polymers in the seal layer differ by at least 10), this patent incorporated herein by reference in its entirety.

Other peel systems useful in connection with the present invention are those disclosed in U.S. Pat. No. 4,058,632 (Evans et al.), U.S. Pat. No. 4,615,926 (Hsu et al.); U.S. Pat. No. 5,128,414 (Hwo); U.S. Pat. No. 6,395,321 (Schaft et al.), U.S. Pat. No. 7,055,683 (Bourque et al.), and US Patent Publication Nos. 20030152669 (Vadhar et al.) and 2008/0260305 (Shah et al.) (disclosing as easy-open sealant), DuPont APPEEL™ resins, such as those based on EVA, modified EVA, EAA, or modified EAA; polyethylenes such as LDPE and/or EVA blended with PP; LDPE or EVA blended with polybutene-1, or random propylene/ethylene copolymer blended with polybutene-1; EVA or LDPE blended with PP; LDPE blended with EVA and PP; such blends provide an easy-open sealant when adhered to polyethylene sealants); these U.S. patents and publications all incorporated herein by reference in their entirety.

4. Failure Involving PSA

In some embodiments, a package can be made where easy-open functionality is provided in the package by the presence of an easy-open seal and an easy-open sealant, acting in combination with the PSA. Opening can involve e.g. the PSA preferentially adhering to one of two surfaces, as the two surfaces are pulled apart; or adhering to both of two surfaces as the two surfaces are pulled apart. These embodiments are used in combination with displacing or removing the panel section. When the panel section is displaced or removed, at least a portion of the pressure sensitive adhesive, as well as at least a portion of the first end 28 of the base strip is exposed, i.e. is visible to the viewer facing the first side panel. By grasping the first end 28 of the base strip after removing the panel section, and pulling towards the user, the package contents can be accessed. The package can thereafter be reclosed by adhering one of the first and second panels, or panel section, to the pressure sensitive adhesive. "First end of the base strip" herein means the end 28 of the base strip closest to the first end of the package.

Figure 2:
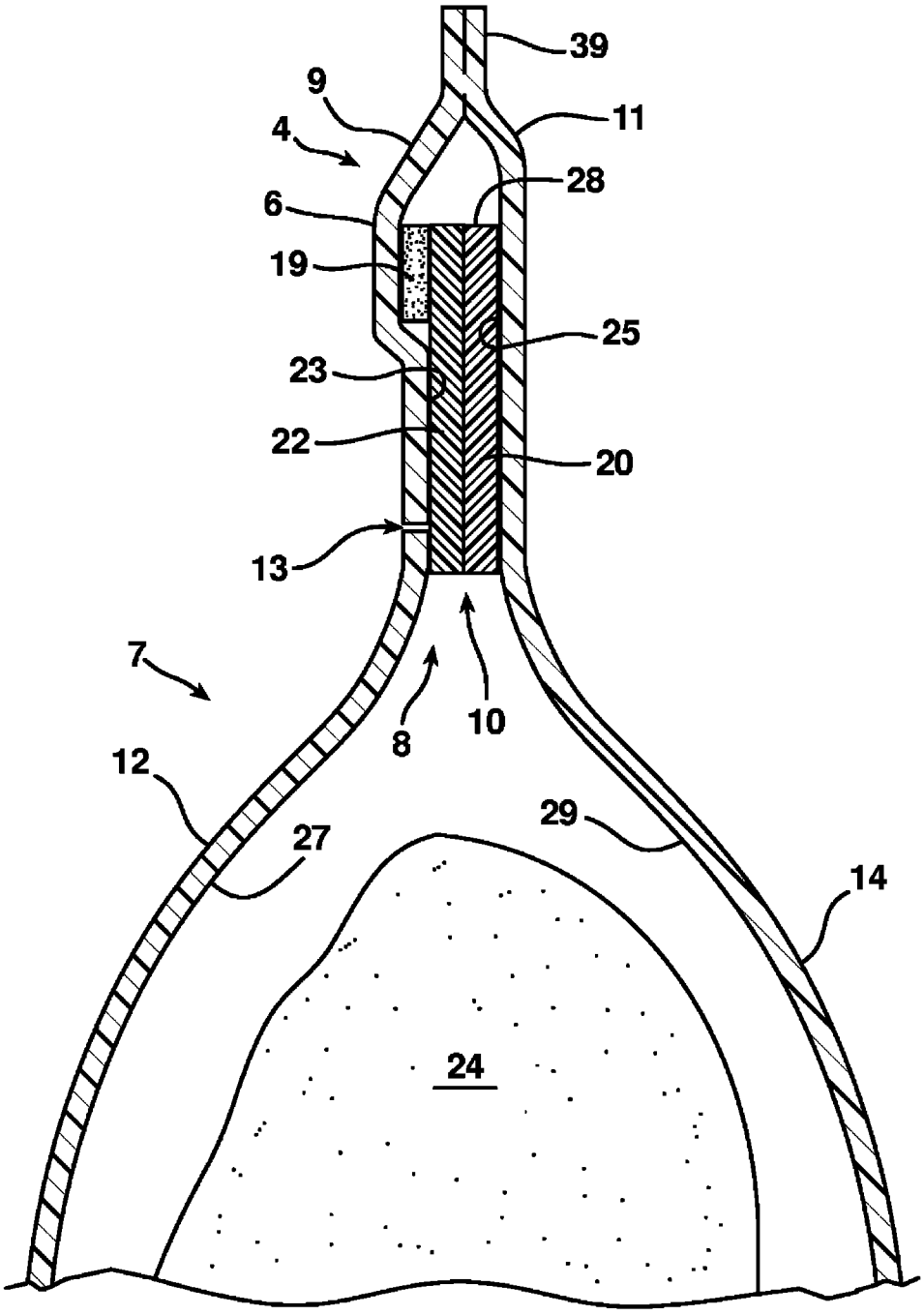
FIG. 2 is an enlarged view of the package of FIG. 1.

Optionally, especially for applications where hermeticity of the package is required before the package is first opened, a supplemental seal, of any suitable geometry, is disposed near the first end of the package, and seals the panel section to the first end of the base strip. See e.g. FIG. 2C, region "D". This seal reduces the possibility that, if the pressure sensitive adhesive becomes partially unadhered, oxygen from outside the package can enter the package. This supplemental seal is an easy-open seal. The supplemental seal can be located in the area of the base strip between the pressure sensitive adhesive and the first end of the base strip, or can be located in the area of the pressure sensitive adhesive itself. Thus, "the supplemental seal seals the panel section to the first end of the base strip" is used herein to mean sealing of the panel section to the base strip either in the region of the pressure sensitive adhesive (whether or not the pressure sensitive adhesive extends to the first end of the base strip) or in an area of the base strip between the pressure sensitive adhesive and the first end of the base strip. FIG. 2C shows an area near the first end of the base strip not coated with a pressure sensitive adhesive, and within which the supplemental seal is made.

Some clear areas may be present in the first portion of the base strip (such as an area to accommodate the supplemental seal), provided the easy-open and reclosable functionality of the package is substantially maintained.

The base strip 10 can have any suitable number of layers. In FIGS. 1 and 2, a strip 10 has two layers. Layer 20 comprises a polymeric composition that in one embodiment provides an easy-open seal when sealed at surface 25 to inner surface 29. Layer 22 comprises a polymeric composition that exhibits a relatively strong seal when sealed at surface 23 to inner surface 27. In any strip construction, alternatively layer 22 or its equivalent can provide the easy-open seal, and layer 20 or its equivalent can provide the relatively strong seal, when sealed to respective web inner surfaces. Alternatively, both 20 and 22 or their equivalents provide an easy-open seal.

Figure 5:
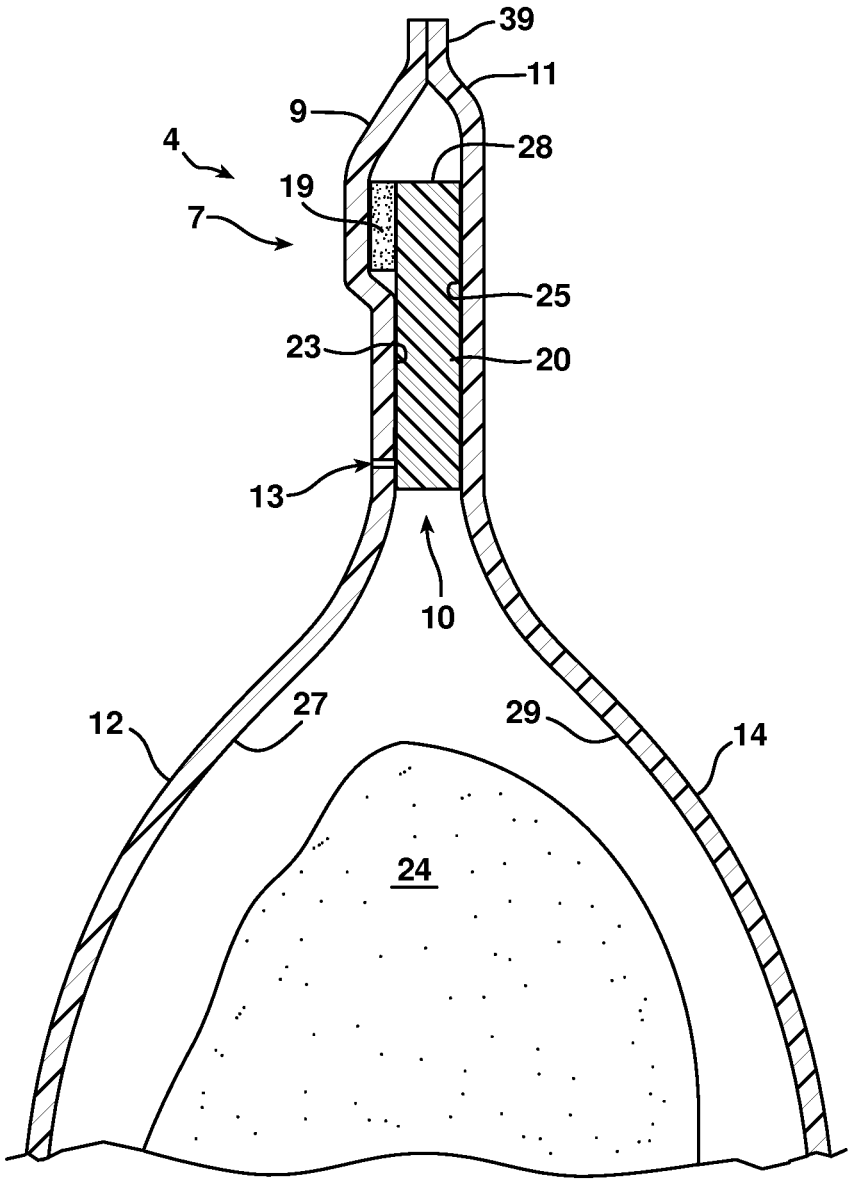
FIG. 5 an enlarged view of a portion of the package of FIG. 1 according to another embodiment.

Alternatively, (FIG. 5), base strip 10 is of monolayer construction. Layer 20 comprises a polymeric composition and includes first outer surface 23 and second outer surface 25 that can be like those disclosed herein for a multilayer base strip.

In any of these alternatives, the surface of the strip facing inner surface 29 in some embodiments is not sealed to inner surface 29 except at any side seals of the package.

Figure 2A:
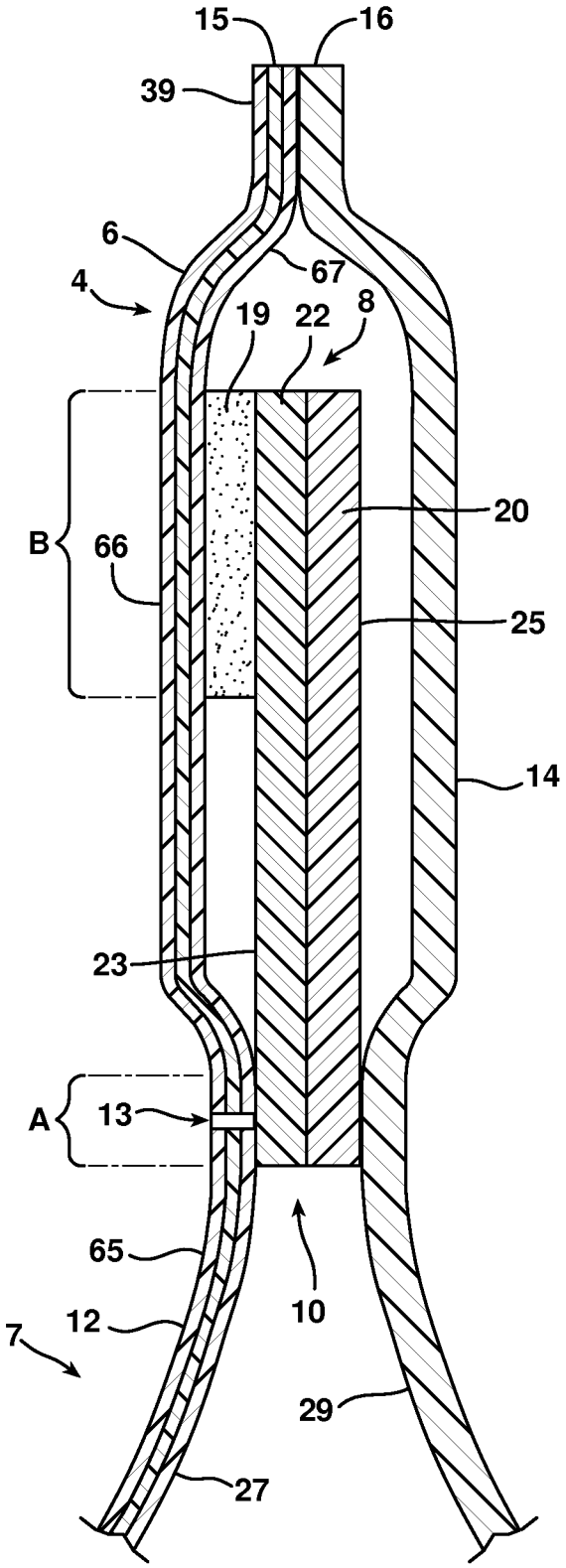
FIG. 2A is an enlarged cross-sectional view of a portion of FIG. 1.

Referring to FIG. 2A, strip 10 is adhered to a portion of the inner surface 67 of panel section 6, with a PSA, at adhesive region "B". During manufacture of the package, discrete laminate 4 is anchored to a portion of first side panel 12. In one embodiment, strip 10 is anchored to the inner surface 27, e.g. with a relatively strong heat seal, at anchor region "A". The second surface 25 of strip 10 is in one embodiment sealed to inner surface 29 of second side panel 14 with an easy-open seal.

Figure 6:
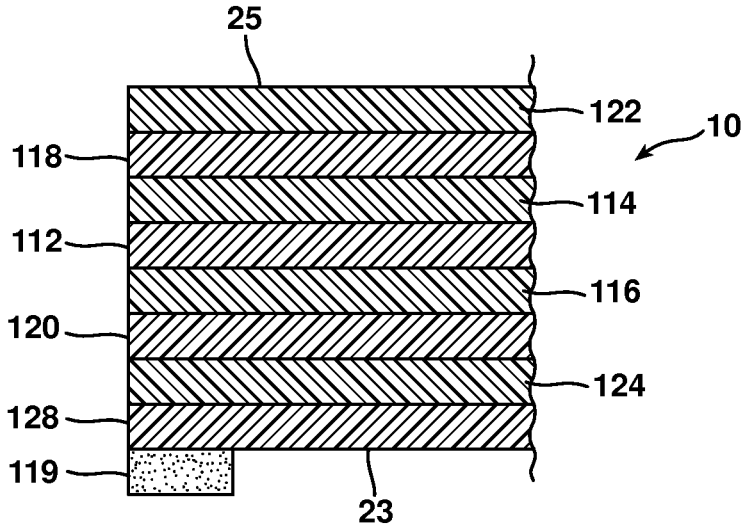
FIG. 6 is a cross-sectional view of a tape.

A representative film structure "A1" suitable for use as the base strip 10 according to the invention is shown in FIG. 6. In one embodiment, this film has the composition shown in Table 1.

TABLE 1

(Example 1)

| Layer | Composition | Gauge (thickness %) | Gauge (mils) | Gauge (μm) |
|---|---|---|---|---|
| 122 | EZ1 | 25.00 | 0.50 | 12.7 |
| 118 | AD1 | 7.50 | 0.15 | 3.8 |
| 114 | 80% NY1 + 20% NY2 | 7.50 | 0.15 | 3.8 |
| 112 | OB1 | 10.0 | 0.20 | 5.1 |
| 116 | 80% NY1 + 20% NY2 | 7.50 | 0.15 | 3.8 |
| 120 | AD1 | 7.50 | 0.15 | 3.8 |
| 124 | 65% AD2 + 35% PE1 | 17.50 | 0.35 | 8.9 |
| 128 | PE1 | 17.50 | 0.35 | 8.9 |

This example of a material suitable as the base strip 10 or panel section 6 is a coextruded barrier film with an easy-open sealant.

The coextruded barrier film with easy-open sealant, identified in Example 1, is currently used as a barrier/easy-open component of various laminated materials that also include a polyester film component, sold commercially by the Cryovac business unit of Sealed Air Corporation, under designations including H52XXBZ, and H72XXBZ. These are each alternative choices for making base strip 10 or panel section 6. The coextruded barrier film is in each case laminated, by a polyurethane adhesive or the like, to a biaxially oriented, chemically treated PET film. The easy-open layer of the coextruded barrier film faces the interior of the final package. The layer of the coextruded barrier film on the opposite face of the film from the easy-open sealant, is adhered via the polyurethane adhesive to the PET film. In the discrete laminate of the invention, PSA is disposed on the outer surface of the PET, and a panel section comprising any suitable material having an easy-open sealant or providing an easy-open functionality, is adhered by the PSA to the PET.

The H52XXBZ, and H72XXBZ are sold as primary packaging materials, i.e. webs that form the main body of the package, but not as a base strip or panel section of a discrete laminate, as described herein, to be used in combination with a primary packaging material.

Materials that can be used as a base strip or panel section of a discrete laminate of the invention can include the H52XXBZ, and H72XXBZ materials described herein, such as H5225BZ, H5230BZ, H5235BZ, or H5240BZ, having an overall thickness of 2.5, 3.0, 3.5, and 4.0 mils respectively, and a thickness of the coextruded barrier film of 2.0, 2.5, 3.0, and 3.5 mils respectively. When used according to the invention, the easy-open sealant layer 122 of A1 exhibits a peel force of typically about 2 pounds/inch (ASTM F88). Layer 128 of A1 yields a peel force of typically 8 pounds/inch.

The resins disclosed in Table 1, and other resins referred to elsewhere in the present application, are identified in Table 2.

TABLE 2

| Material Code | Tradename Or Designation | Source(s) |
|---|---|---|
| AD1 | PLEXAR ™ PX1007 ™ | Equistar |
| AD2 | BYNEL ™ 39E660 ™ | DuPont |
| EM1 | LOTADER ™ 4503 ™ | Arkema |
| EZ1 | APPEEL ™ 72D727 | DuPont |
| NY1 | ULTRAMID ™ B33 01 | BASF |
| NY2 | GRIVORY ™ G21 | EMS |
| OB1 | SOARNOL ™ ET3803 | Nippon Gohsei |
| PE1 | PE ™ 1042cs15 | Flint Hills |
| PE2 | PETROTHENE ™ NA 345-013 ™ | LyondellBasell |
| PE3 | AFFINITY ™ PT 1450G1 ™ | Dow |
| PE4 | MARFLEX ™ 1019 ™ | Chevron Phillips |
| PET1 | MYLAR ™ 822 ™ | DuPont Teijin |
| PET2 | MYLAR ™ M34 ™ | DuPont Teijin |

AD1 is a maleic anhydride modified EVA that acts as a polymeric adhesive (tie layer material).
AD2 is a maleic anhydride modified EVA that acts as a polymeric adhesive (tie layer material).
EM1 is ethylene/methyl acrylate copolymer with a methyl acrylate content of about 20%.
EZ1 is a compound polymer blend of 65% ionomer (SURLYN ™ 1650SB), 30% EVA (ELVAX ™ 3134Q), and 5% polybutylene (MONTELL ™ PB8640), each by weight of the blend.
NY1 is nylon 6 (polycaprolactam).
NY2 is an amorphous copolyamide (6I/6T) derived from hexamethylene diamine, isophthalic acid, and terephthalic acid.
OB1 is EVOH with about 38 mole % ethylene.
PE1 is LDPE.
PE2 is LDPE.
PE3 is a branched, single-site catalyzed ethylene/octene copolymer with a density of about 0.902 grams/cubic centimeter.
PE4 is LDPE.
PET1 is a chemically treated biaxially oriented polyester.
PET2 is a saran-coated biaxially oriented polyester.
All percentages herein are by weight unless indicated otherwise.

Example 1 as shown has a total thickness ranging from about 2.0 mils to 3.5 mils.

Core layer 112 of the above film structure can comprise any suitable oxygen barrier material, such as EVOH, and can be blended in any suitable proportion with other polymeric materials or organic or inorganic additives as desired. In one embodiment, intermediate layers 114 and 116 can each comprise 100% semicrystalline polyamide such as nylon 6.

In another embodiment, Intermediate layers 114 and 116 each comprise a blend of an amorphous polyamide and a semicrystalline polyamide.

Tie layers 118 and 120 can comprise any suitable polymeric adhesive that functions to bond two layers together, e.g. EVA, EAO, LDPE, EMA, and anhydride grafted derivatives of these polymers. Tie layers 118 and 120 can be the same, or can differ.

Bulk layer 124 can comprise a suitable polyolefin, such as an EAO; and/or a polymeric adhesive such as those disclosed herein for tie layers 118 and 120.

In one embodiment, first outer layer 122 functions as an easy-open sealant layer of the film, and provides a surface 25 that can be sealed to the inner surface 29. Layer 122 can comprise any suitable material or blend of materials that provides an easy-open peelable seal when adhered to the inner surface 29. Layer 122 comprises EZ1 or any suitable resin or resin blend that provides an easy-open peelable sealant.

Second outer layer 128 can function as a sealant layer of the film, and provides a surface 23 that can be sealed to the inner surfaces 27 and 67. Layer 128 can comprise any suitable material or blend of materials that provides a relatively strong seal when adhered to inner surfaces 27 and 67. Layer 128 comprises PE1 or any EAO such as EXACT™ 3024, a single-site catalyzed linear ethylene/butene copolymer from ExxonMobil with a density of 0.905 g/cc; or AFFINITY™ PL 1888G, a single-site catalyzed branched ethylene/octene copolymer from Dow with a density of 0.9035 g/cc.

Additional materials that can optionally be incorporated into one or more of the film layers, as appropriate, include antiblock agents, slip agents, antifog agents, fillers, pigments, dyestuffs, antioxidants, stabilizers, processing aids, plasticizers, fire retardants, UV absorbers, etc.

Alternatively, layer 122 can be sealed to inner surfaces 27 and 67, and layer 128 can be sealed to inner surface 29.

In any of these embodiments, the PSA layer (19, 119, 219) will occupy a portion of the surface of the strip that faces and contacts inner surface 67 of panel section 6. The invention is characterized by the fact that:

- the package before initial opening does not have a PSA on the exterior surface of the package,
- before opening the package, the PSA is in contact with the inner surface of the panel section of the discrete laminate of the package, and not in direct contact with the product inside the package,
- after opening the package, the surface of the base strip on which the PSA is coated forms a portion of the outer surface of the package,
- before opening the package, the PSA is not in direct contact with the outer surface of the first side panel, the outer surface of the panel section, or of the outer surface of the second side panel,
- a portion of the panel section acts functionally like a release liner for the PSA (in some embodiments there is no discrete release liner separate from the functional effect of the panel section),
- once the package is opened, the PSA is on the outside of the package on a strip that acts functionally like an extension of the first side panel,
- In some embodiments, after opening the package, the second side panel can be folded over and the inner surface of an end segment of the second side panel can be brought in contact with the exposed PSA to reclose the package,
- In some embodiments, after opening the package, the panel section and the sec- and side panel can be folded over and the exposed PSA can be brought in contact with the outer surface of the first side panel.
- because the PSA of the opened package, although exposed to the outside environment, faces away from the product, the chance of degradation of the PSA by contact with the product is reduced.

In general, panel section 6, strip 10, the first and second side panels can each have any total thickness desired, and each layer can have any thickness desired, so long as the strip and package provide the desired functionalities. Typical total film thicknesses are from 0.1 mils to 15 mils, such as 0.2 to 12 mils, such as 0.5 mils to 10 mils, 0.8 mils to 8 mils, and 1 mil to 4 mils. Suitable gauges include 1.5 mils, 2 mils (as in Example 1); and 3 mils.

Figure 7:
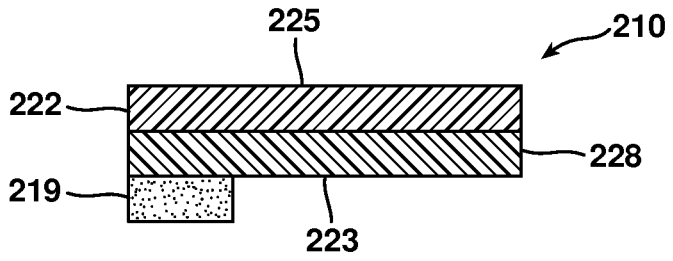
FIG. 7 is a cross-sectional view of a tape according to another embodiment.

FIG. 7 shows, in another embodiment, a two layer film 210 having a first outer layer 222 compositionally and functionally like layer 122 of FIG. 6, with a first outer surface 225; and having a second outer layer 228 compositionally and functionally like layer 128 of FIG. 6, with a second outer surface 223.

Two, three, four, five, six, seven, and eight layer films can thus alternatively be produced, that each include the layers described above with respect to the film strip of FIG. 7, with additional layers as needed, using suitable polymers such as olefin homopolymers or copolymers.

In some embodiments, such as the base strip of FIG. 7, an oxygen barrier layer is not necessary, for example in the packaging of produce. In these embodiments, the web or webs that comprise the pouch will typically also not have an oxygen barrier layer. In contrast, embodiments of film strip 10 that include an oxygen barrier layer will typically be suitable in connection with web or webs for the pouch that include an oxygen barrier layer.

Figure 2B:
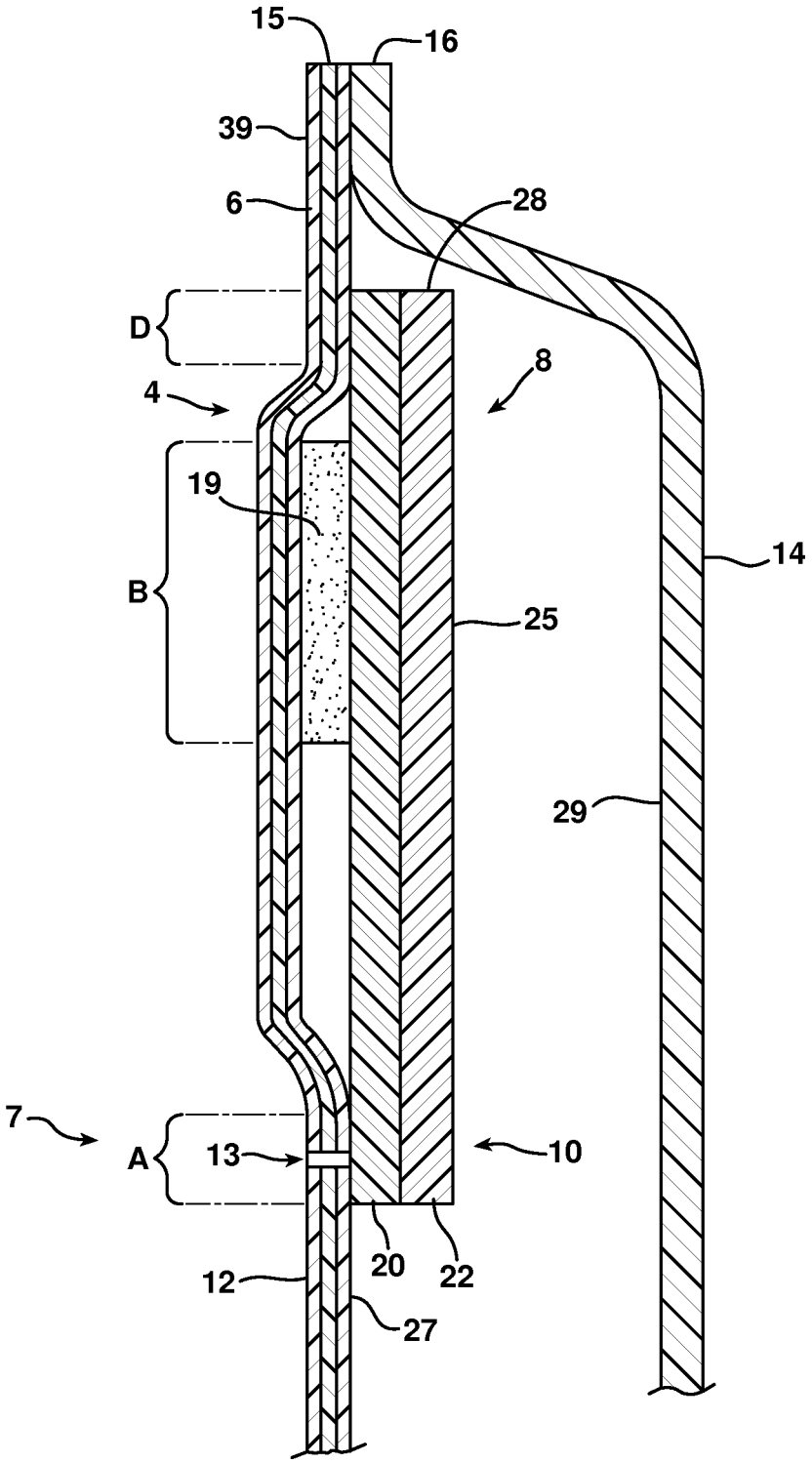
FIG. 2B is an enlarged cross-sectional view of another embodiment of a portion of FIG. 1.
Figure 2C:
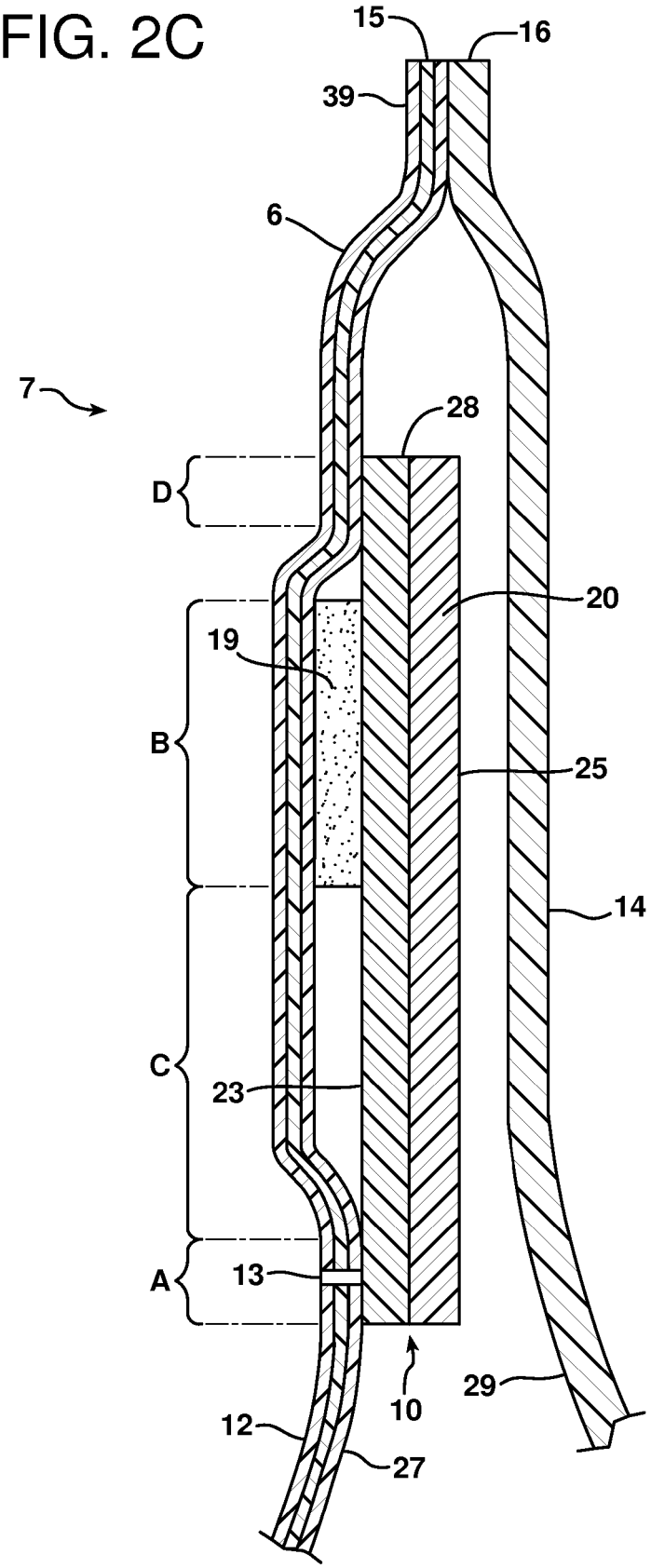
FIG. 2C is an enlarged cross-sectional view of another embodiment of a portion of FIG. 1.

FIG. 2B is similar to FIG. 2A, but in which 1) the surface of the strip providing an easy-open seal faces the inner surface 27 instead of inner surface 29; 2) a portion of the strip is sealed to a portion of the inner surface 27 with an easy-open seal, at anchor region "A", 3) another portion of the strip is sealed to a portion of the inner surface 67 of panel section 6 with an easy-open seal, at seal region "D", and 4) the second surface 25 of strip 10 is not sealed to inner surface 29 of second side panel 14, except by side seals. The embodiment of FIG. 2B offers the benefit of more usable space inside the package, because there is no seal (except at the sides of the package) of surface 25 to surface 29, and therefore more space is available for product.

For many products, it is important to ensure hermeticity of the package during storage and distribution. Hermeticity is achieved in various embodiments of the invention where a seal (either easy-open or strong seal) adheres the first side panel to the strip in region "A", and a seal adheres the second side panel to the strip (FIG. 2A); or where a seal adheres the first side panel or panel section to the strip in regions "A" and "D", even though no seal adheres the second side panel to the strip (FIG. 2B) except at the side edges of the package.

In each of the embodiments of the package and process disclosed herein, a non-hermetic or hermetic package can be made in accordance with the invention.

In one embodiment, layer 20 comprises a sealant that provide a relatively strong seal when layer 20 is sealed to surface 27. An example of a material suitable as a base strip for this embodiment is a barrier film with a sealant that provides a relatively strong seal, and is currently used as, a barrier/sealant component of various laminated materials that also include a polyester film component, sold commercially by the Cryovac business unit of Sealed Air Corporation, under designations including H52XXB, and H72XXB. These are sold as primary packaging materials, i.e. webs that form the main body of the package, not as a base strip to be used in combination with a primary web.

2. Method of Making a Package

A. Horizontal Form/Fill/Seal (HFFS)

HFFS packaging systems are generally well known to those of skill in the packaging industry, and can be used to make packages of the present invention.

Referring to FIGS. 8, and 9A through 9C, lay-flat web 300 is unwound from roll 302, then advanced to forming plow 304 to convert lay-flat web 300 to folded web 305 (typically a centerfold film). The second end of each of the pouches to be made will comprise a second end fold 306. Second end fold 306 therefore is equivalent to second end 34 of FIG. 1. This second end fold can be optionally sealed, or left as a folded second end of the pouch. Side seals 308 are made to define a plurality of vertically arranged pouches 309. Each pouch 309 is cut off from the trailing edge of web 300 by an appropriate cutting mechanism (not shown) such as a knife, at position 311, a product (not shown in FIGS. 8A and 8B, but see product 24 in FIGS. 1 to 5) is inserted or dropped into the open mouth 312 of each pouch, and the pouch mouth 312 is then closed by a suitable sealing mechanism such as a heat sealer (not shown) to create a seal 314.

Discrete laminate 310, equivalent to discrete laminate 4 of FIGS. 1 to 5, can be introduced into the HFFS process in a number of ways. For example, discrete laminate 310 can be unwound from a roll 315 in the vicinity of roll 302, and disposed on lay-flat web 300 prior to, or as web 300 is being folded into folded web 305. The discrete laminate is disposed on the web such that the discrete laminate overlaps the lay-flat web sufficient to allow the discrete laminate to be anchored to the web. Discrete laminate 4 in this embodiment becomes part of the folded web.

Discrete laminate 310 includes a base strip, at least a first portion of the first surface of the base strip coated with a pressure sensitive adhesive, and a second portion of the first surface of the base strip optionally substantially free of PSA. The first portion is closer to a longitudinal end of the pouch, e.g. the first end of the pouch, than the second portion.

The first portion of the first surface of the strip is adhered by the pressure sensitive adhesive to the panel section (see FIGS. 2A and 2B). The second portion of the first surface of the base strip is anchored to the inner surface of the folded web at a second location on the folded web, by a suitable sealing mechanism such as a heat sealer (not shown). Optionally, the second surface of the strip is sealed to the inner surface of the folded web. Discrete laminate 310 would thus be installed on the pouch in the same overall HFFS process that achieves production of the pouch, loading of a product into the pouch, and completion of the final package. Discrete laminate 310 is incorporated onto the pouch material and after cutting and sealing as described hereinabove, comprises an extension of the first side panel of each pouch as shown in FIGS. 8A, 8B, and FIGS. 1 to 5.

Figure 9A:
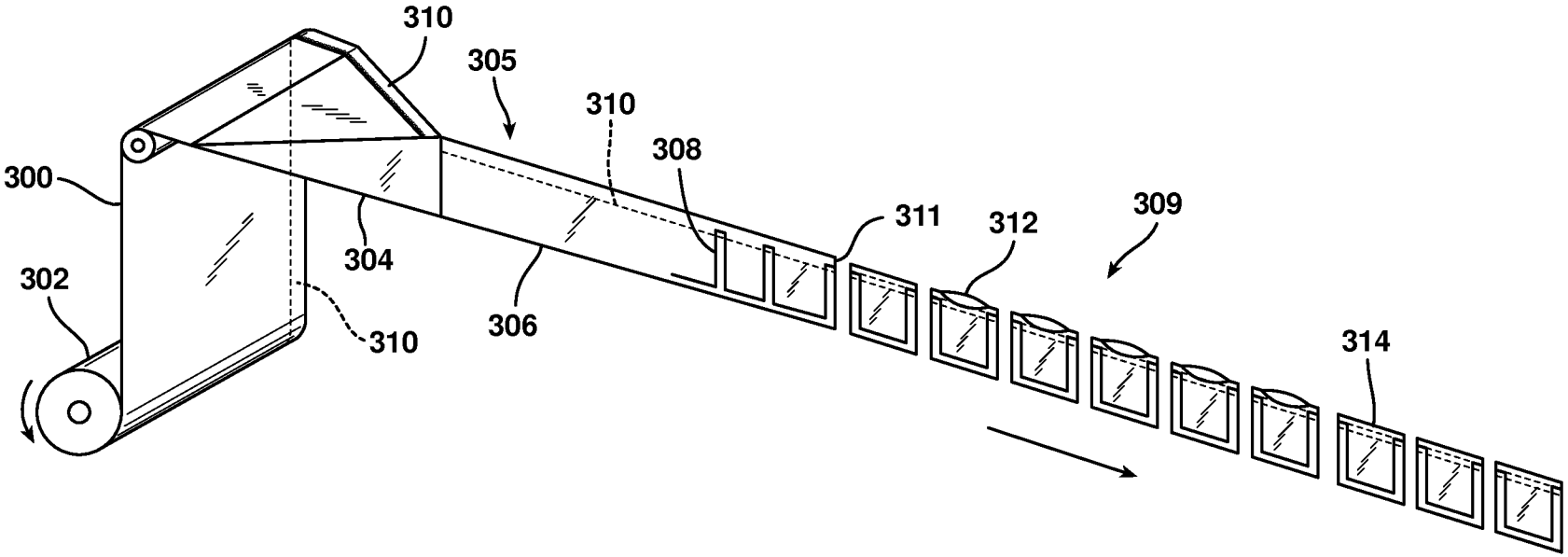
FIG. 9A is a perspective view of a HFFS process and apparatus for making a package according to another embodiment.

Alternatively, and referring to FIG. 9A, discrete laminate 310 is shown as being preinstalled on the lay-flat web prior to the start of the HFFS packaging process. This can be accomplished off-site from the processor, e.g. by the supplier of the web roll 302.

Figure 8:
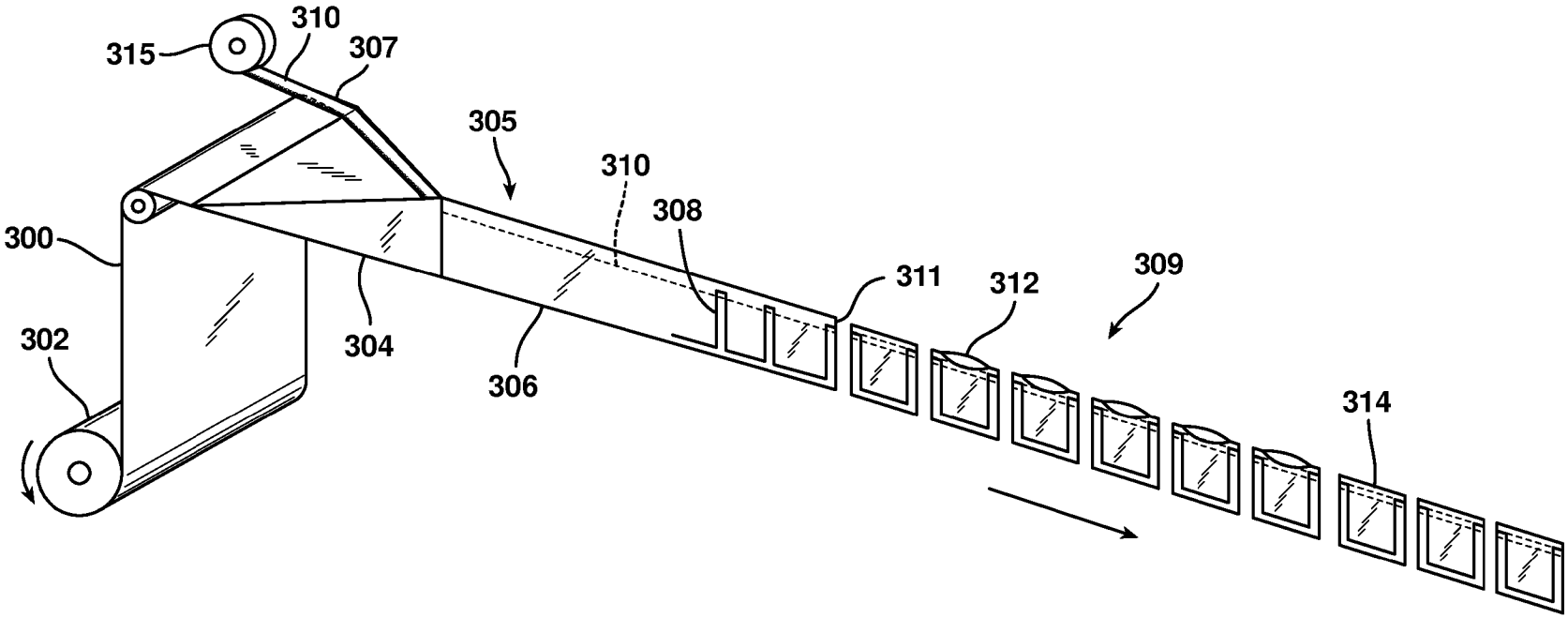
FIG. 8 is a perspective view of a HFFS process and apparatus for making a package.
Figure 9B:
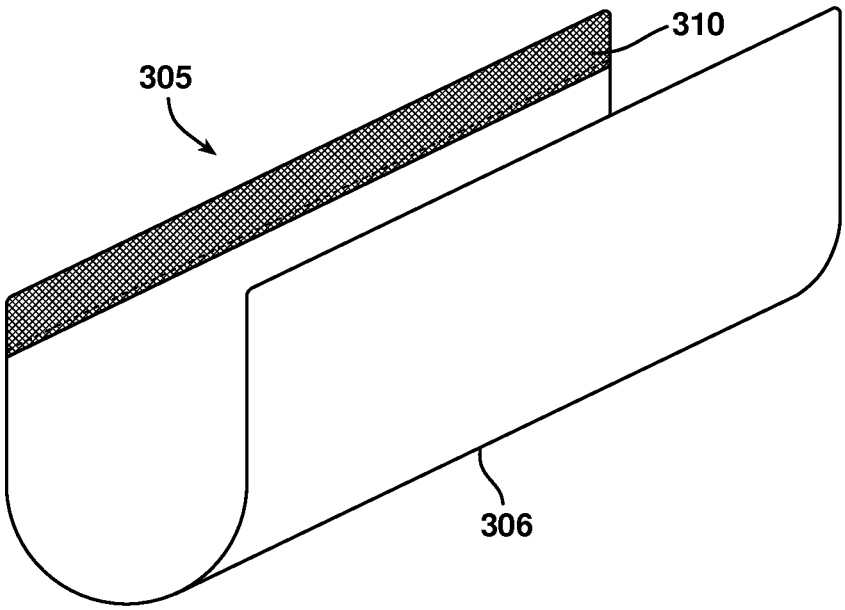
FIG. 9B is a perspective view of a section of folded web.

FIG. 9B is a perspective view of a section of folded web as shown in the HFFS process and apparatus of FIGS. 8 and 9A, as the lay-flat web is folded to create folded web 305. The discrete laminate 310 is shown disposed, and optionally attached to, an inner surface 27 of one panel 12 of the folded web 305, such that upon sealing the web to create a pouch, the discrete laminate functions as an extension of the panel.

Figure 9C:
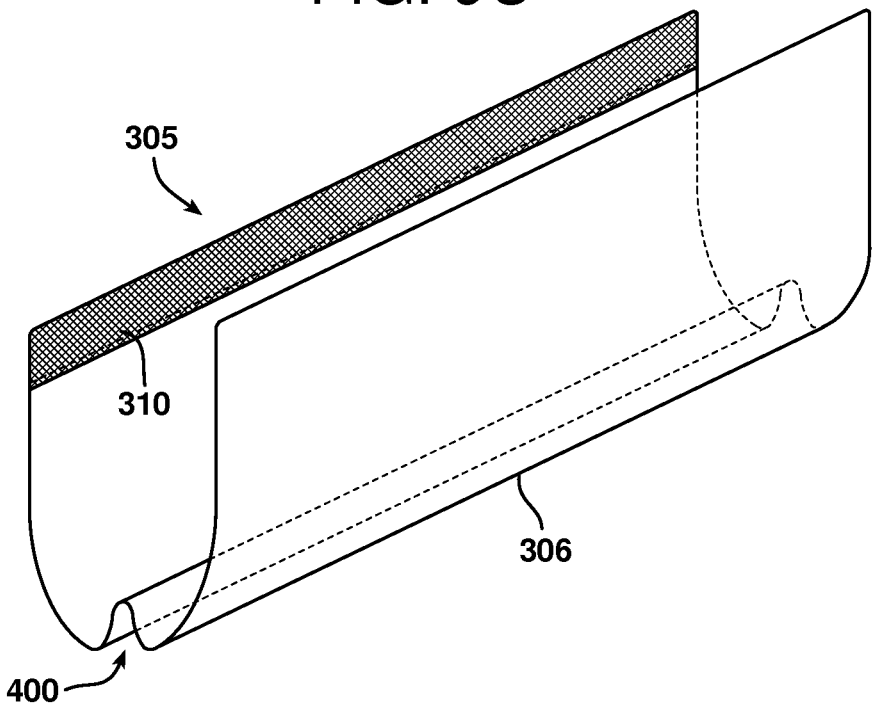
FIG. 9C is a perspective view of a section of a gusseted folded web.

The embodiment of FIG. 9C is similar to FIG. 9B, but additionally shows an optional gusset 400 that can be made in the second end fold 306 of the folded web. The gusset can be optionally thereafter heat sealed. A gusseted second end provides a stand-up pouch feature in the final package. Gusseting can be accomplished by any suitable means known to those of skill in the art, such as a second forming plow (not shown) placed in-line in the manufacturing line at a position downstream of the forming plow 304. The bottom area of the folded web takes on a generally "W" shape, i.e. a gusseted shape, in cross-section, with the outside legs of the "W" extending upwardly, and two parallel reverse folds to create the gusseted bottom. Seal opening or holes are previously punched in the inner legs of the "W" shape and aligned with one another so that the two outside plies can be sealed together through these holes. When the seals are made the panels are sealed to one another through the holes. One or more static plows may be mounted above the seal zone to form the gussets. Gusset holes can be die punched by a static die at a hole-punch station which intermittently punches at least two holes at a predetermined position designed to be in general alignment with the side seal, adding rigidity to the gusset portion of the final package. This added rigidity enables the final package to stand up by itself when placed on a flat surface.

B. Vertical Form/Fill/Seal (VFFS)

Figure 10:
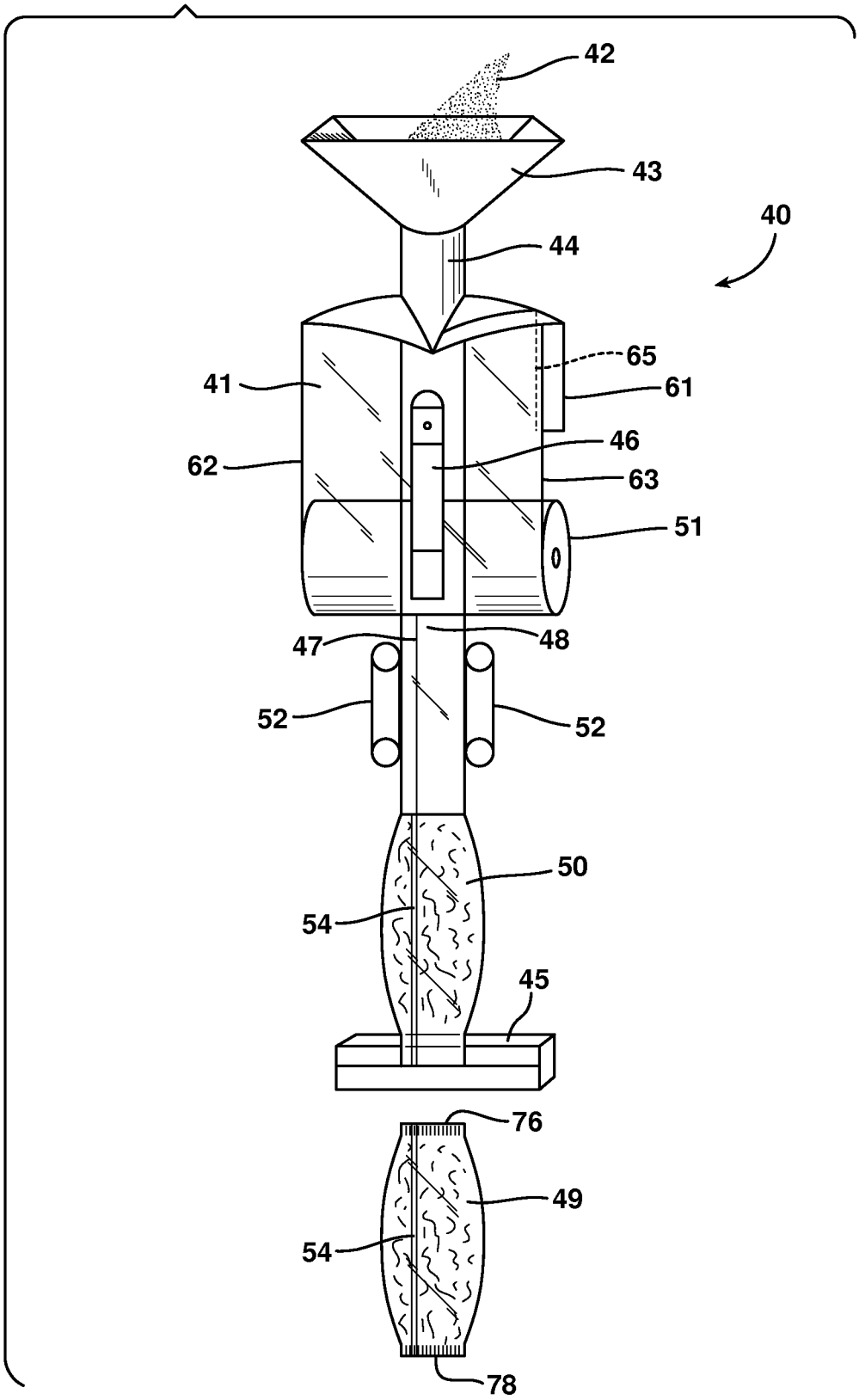
FIG. 10 is an elevational view of a VFFS process and apparatus for making a package.

FIG. 10 schematically illustrates a VFFS apparatus that can be used in conjunction with the apparatus and process according to some embodiments of the present invention. VFFS packaging systems are generally well known to those of skill in the art, and described for example in U.S. Pat. No. 4,589,247 (Tsuruta et al), U.S. Pat. No. 4,656,818 (Shimoyama et al.), U.S. Pat. No. 4,768,411 (Su), and U.S. Pat. No. 4,808,010 (Vogan), all incorporated herein by reference in their entirety.

Apparatus 40 utilizes a lay-flat web 41 as a rollstock. Product 42 is manually or mechanically supplied to apparatus 40 from a source (not illustrated), from which a predetermined quantity of product 42 reaches the upper end portion of forming tube 44 via funnel 43, or other conventional means. The packages are formed in a lower portion of apparatus 40, and web 41 from which the packages are formed is fed from feed roll 51 over certain forming bars (not illustrated), is wrapped about forming tube 44 (sometimes known as a "sailor's collar" or "forming collar") and is provided with a longitudinal fin seal or lap seal 47 by longitudinal heat sealing device 46, resulting in the formation of a vertically-oriented folded web in the form of a tube 48. Transverse heat seal bars 45 operate to close and seal horizontally across the lower end of vertically-sealed tube 48, to form a pouch 49 which is thereafter packed with product 42. Film drive belts 52, powered and directed by rollers, as illustrated, or by suitable alternative motive means, advance tube 48 and pouch 49 a predetermined distance, after which seal bars 45 close and simultaneously seal horizontally across the lower end of vertically-sealed tube 48 as well as simultaneously sealing horizontally across the upper end of sealed pouch 49, to form a product packaged in sealed pouch 49. The next pouch 50, thereabove, is then filled with a metered quantity of product 42, and advanced, and the packaging cycle is repeated. It is conventional to incorporate with the seal bars 45 a cut-off knife (not shown) which operates to sever a lower sealed pouch 49 from the bottom of upstream pouch 50.

Figure 11:
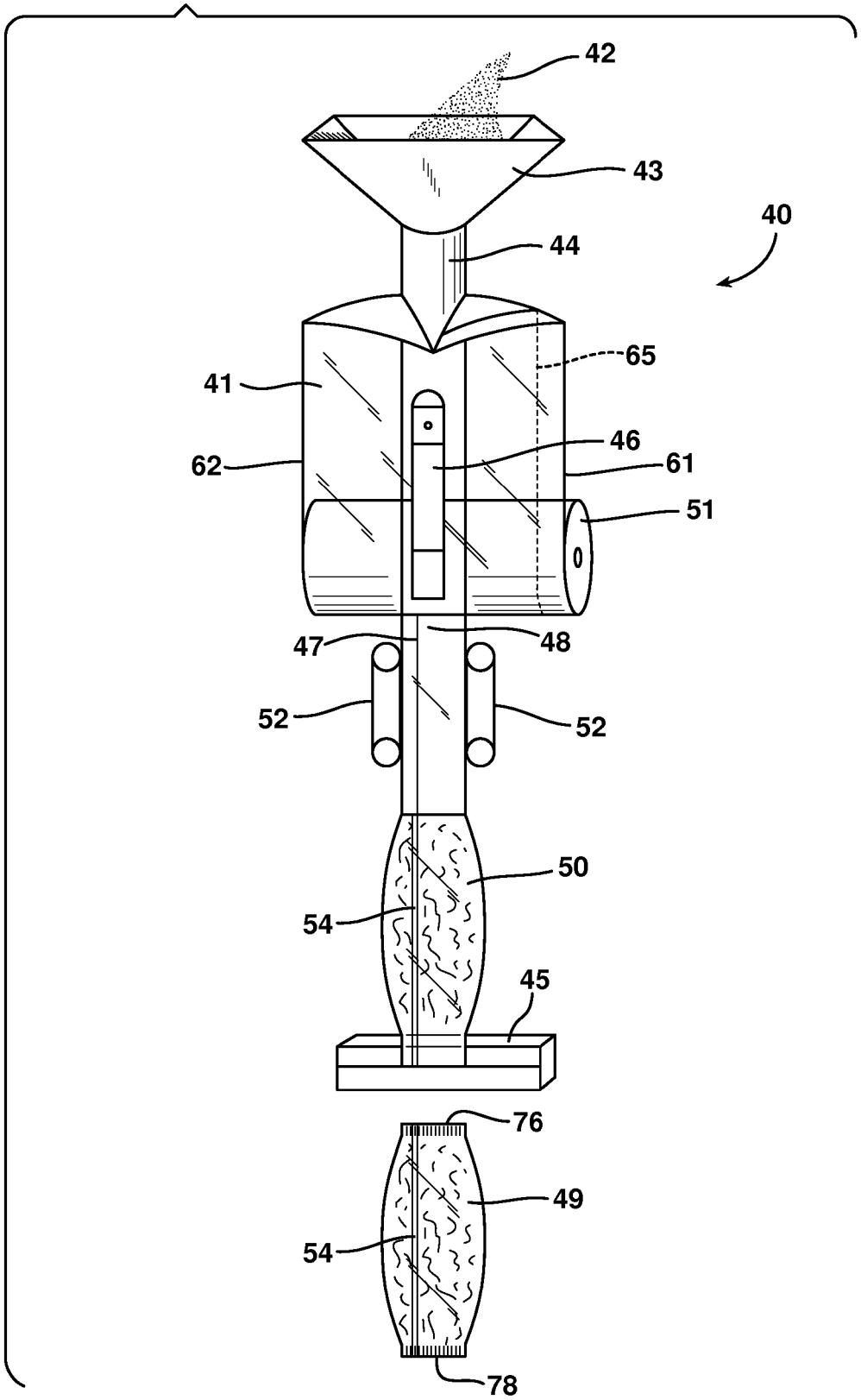
FIG. 11 an elevational view of a VFFS process and apparatus for making a package according to another embodiment.

Lay-flat web 41 of FIGS. 10 and 11 will in operation travel upward, e.g. vertically upward from roll 51 to the forming tube 44, and then downward, e.g. vertically downward for the remaining process steps. Discrete laminate 54 is unwound from roll 51 (FIG. 12) to dispose discrete laminate 54 in overlapping relationship onto web 41 before, or as, web 41 is wrapped about forming tube 44. When longitudinal seal 47 is made, discrete laminate 54 becomes part of the folded web. As with the HFFS process, a coat of PSA will cover a first portion of the base strip 10 of discrete laminate 54.

Figure 12:
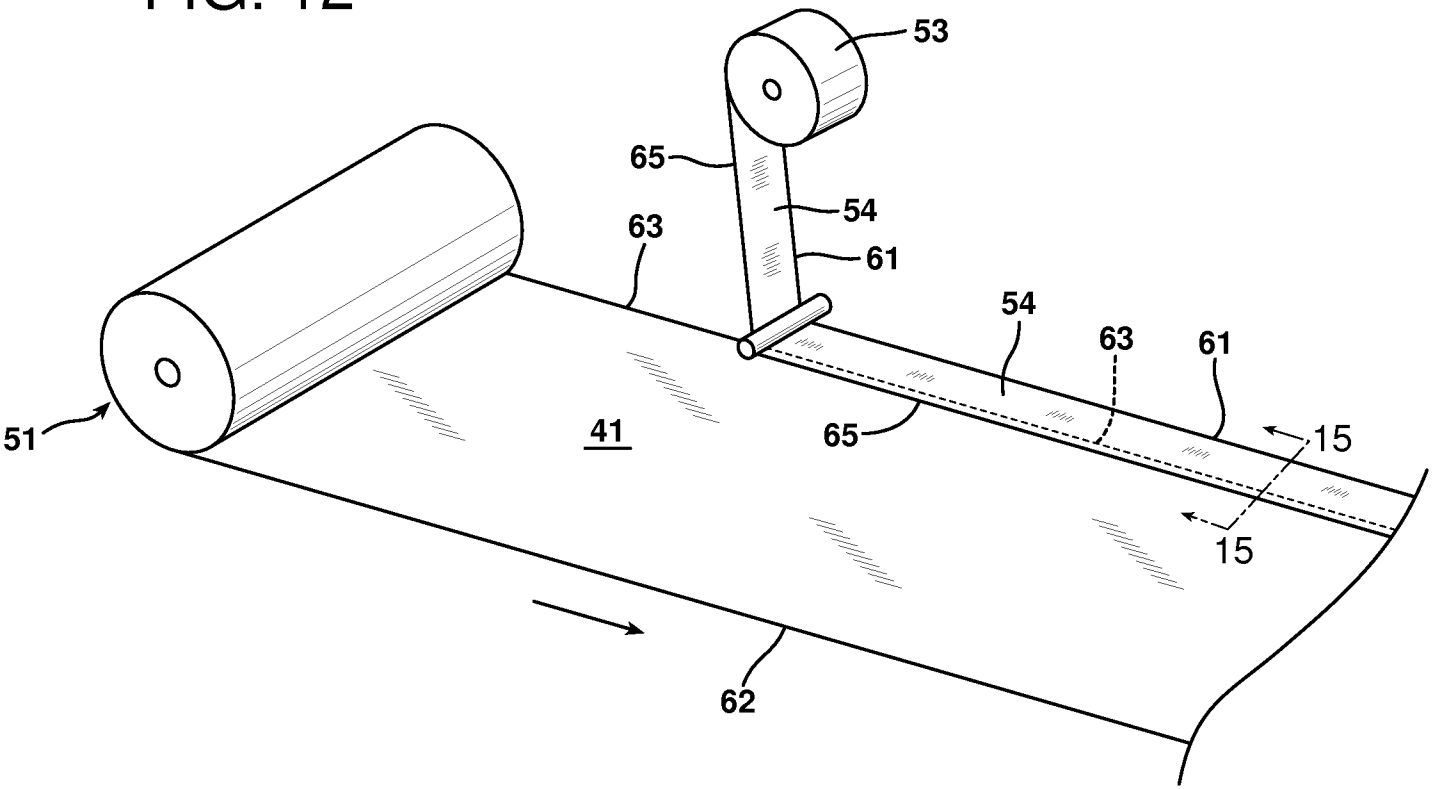
FIG. 12 is a perspective view of a roll of lay-flat web and a roll of a discrete laminate.

FIG. 12 discloses the roll 51 of lay-flat web 41 according to one embodiment of the invention. Discrete laminate 54 is fed from roll 51 onto a portion of lay-flat web 41.

Figure 13:
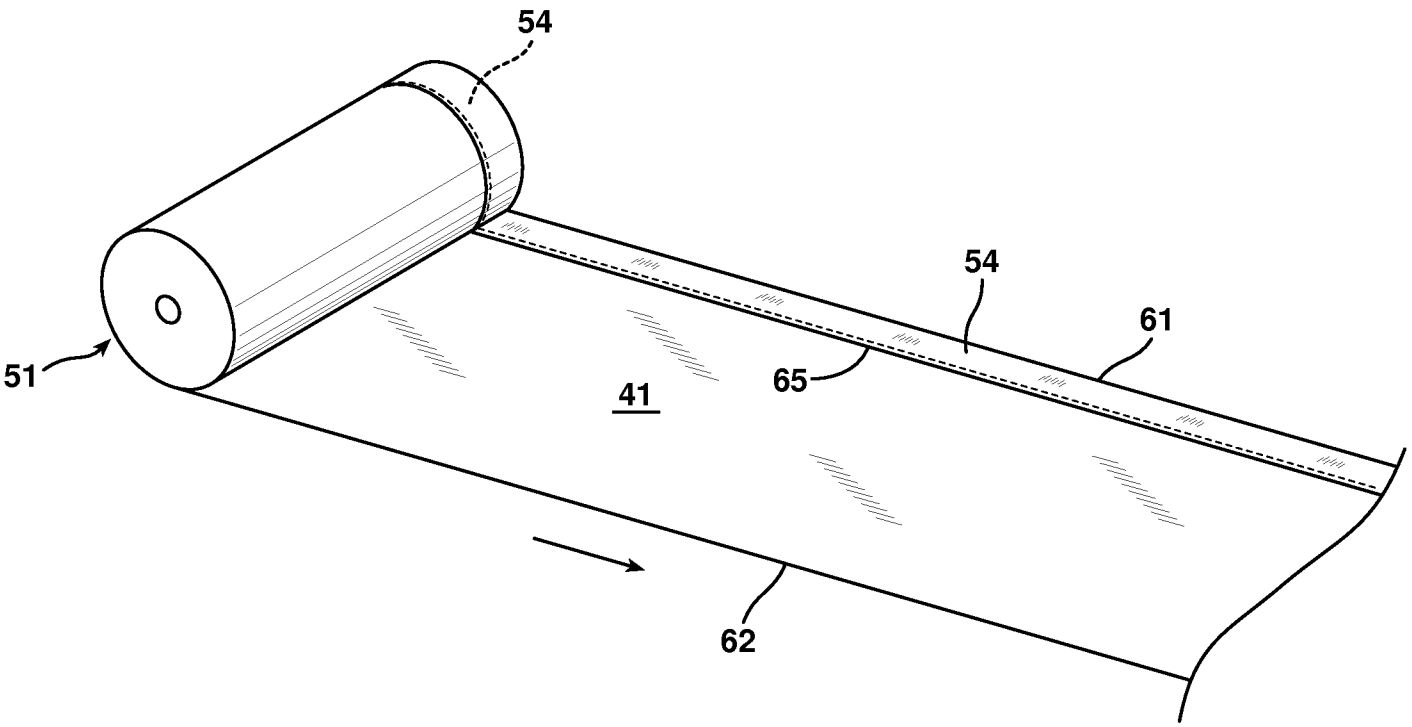
FIG. 13 is a perspective view of a roll of lay-flat web and a discrete laminate according to another embodiment.

Alternatively, and referring to FIGS. 11 and 13, discrete laminate 54 is already pre-anchored on the lay-flat web prior to the start of the VFFS packaging process. This can be accomplished off-site from the processor, e.g. by the supplier of the feed roll 51.

In some embodiments, at least one of the web and the discrete laminate carries a registration device. Printed indicia can be in the form of registration marks, such as eye-spots. Those skilled in the art will be familiar with the use of eye-spots and registration marks in processing web material in packaging operations. Registration marks are printed in uniformly spaced fashion along or near an edge of the web or tape, and facilitate the controlled production of packages of the invention, and can be printed in conjunction with other decorative printing.

Figure 14:
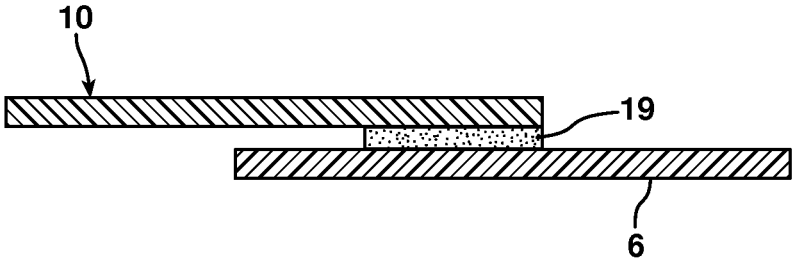
FIG. 14 is a side view of a discrete laminate.

FIG. 14 shows a discrete laminate 4 of the invention, which can be used in the various processes and packages disclosed herein, e.g. as a discrete laminate 54 of FIGS. 12 and 13. Discrete laminate 4 includes tape 8 including base strip 10 selectively coated with PSA layer 19; and panel section 6 including an inner surface comprising an easy-open sealant.

Figure 15:
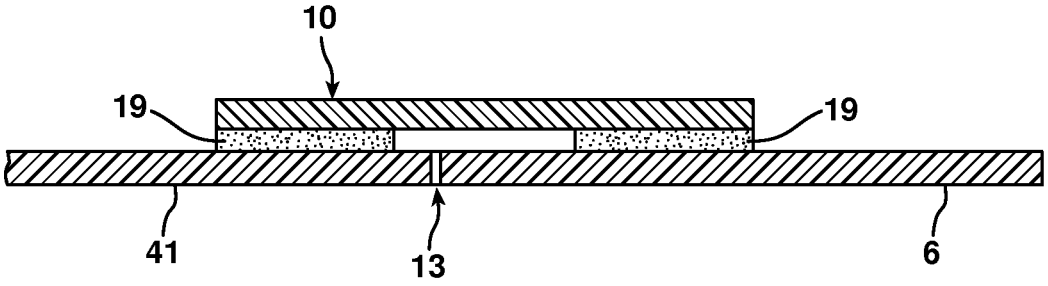
FIG. 15 is a view of a discrete laminate and a portion of a lay-flat web taken along lines 15-15 of FIG. 12.

FIG. 15 shows a discrete laminate 54 of the invention (see also FIG. 12) that has been anchored to lay-flat web 41. In the embodiment shown in FIG. 15, a PSA coat is used to anchor the discrete laminate to the lay-flat web at a second portion of a first surface of base strip 10. Alternatively, the discrete laminate can be sealed at a second portion of a first surface of base strip 10 to lay-flat web 41. Joint 13 represents the gap between and juxtaposition of a second end of panel section 6, and a first longitudinal edge 63 of the lay-flat web that will become a first end of first side panel 12 in the package of the invention. The exact dimension of joint 13 can vary depending on manufacturing tolerances when combining the discrete laminate with a web.

Figure 31:
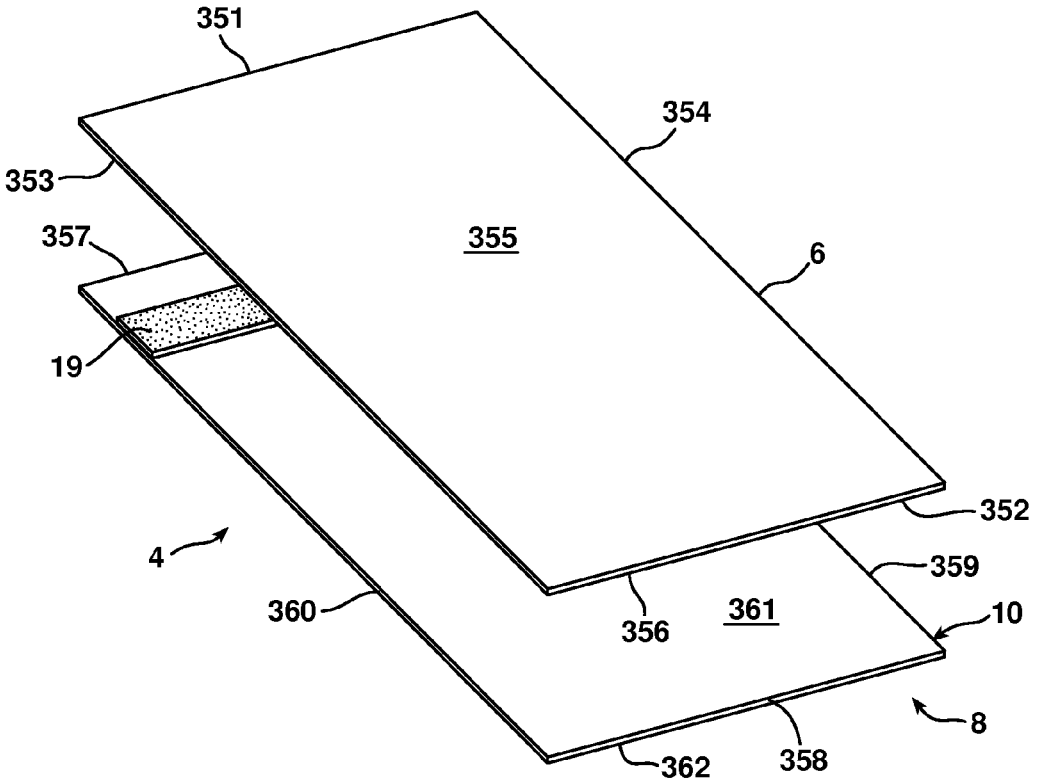
FIG. 31 is a perspective, blown-up view of the discrete laminate.
Figure 32:
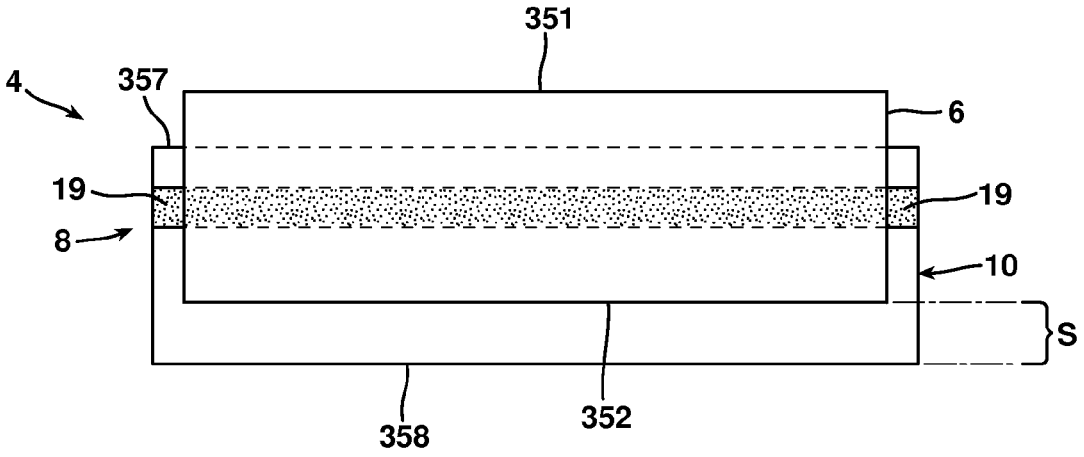
FIG. 32 is a plan view of the discrete laminate.

FIGS. 31 and 32 show a discrete laminate 4 in accordance with the various embodiments of the invention. The discrete laminate includes a panel section 6 including an outer surface 355, an inner surface 356, a first side edge 353, a second side edge 354, a first end 351, and a second end 352; and a tape 8 including a base strip 10 including a first surface 361, a second surface 362, a first side edge 360, a second side edge 359, a first end 357, a second end 358, and a PSA layer 19 coated on at least a first portion of the first surface 361 of the base strip 10. Each of the components of discrete laminate 4 can have any suitable dimensions, and in some embodiments base strip 10 and panel section 6 can be congruent, provided that the first end 351 of panel section 6 extends beyond the first end 357 of base strip 10. As shown in FIG. 32, base strip 10 includes a splice area "S" that extends beyond the second end 352 of panel section 6; and panel section 6 includes an area that extends beyond the first end 357 of base strip 10. These extended areas in some embodiments serve as areas that can be anchored to a web or first side panel of a package of the invention; or, in the case of the panel section, serve as an upper or end portion of a first side panel of a package that can function as part of an opening or removable flap. In some embodiments, both the first and second ends of the panel section can extend beyond the first and second ends respectively of the base strip.

Figure 16:
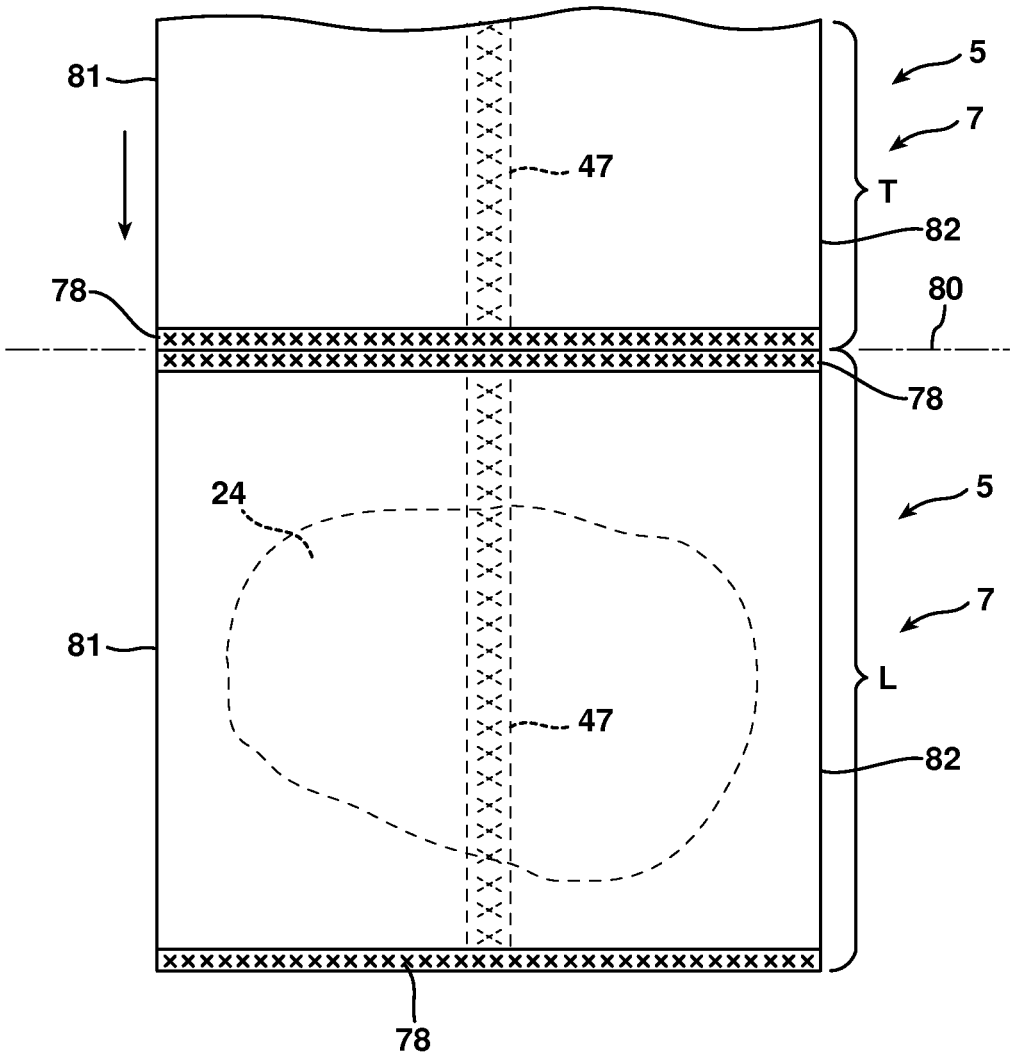
FIG. 16 is an elevational view of two consecutive pouches in a VFFS embodiment.

Although for purposes of illustration FIG. 32 shows the first and side edges of the base strip as extending beyond the first and side edges of the panel section, typically in packages of the invention the first and second side edges of the panel section will be congruent with the first and second edges respectively of the base strip. In FIG. 16, a first or leading pouch "L" includes a transverse bottom and top seals 78, folded side edges 81 and 82, and longitudinal seal 47. Second or trailing pouch "T" has features similar to leading pouch "L". Leading pouch "L" is severed from upstream pouch "T" at cut line 80, and the seals 78 are made by suitable sealing equipment commonly used in VFFS packaging processes, such as heat sealing equipment, not shown. The discrete laminate is not shown in FIG. 16.

Figure 17:
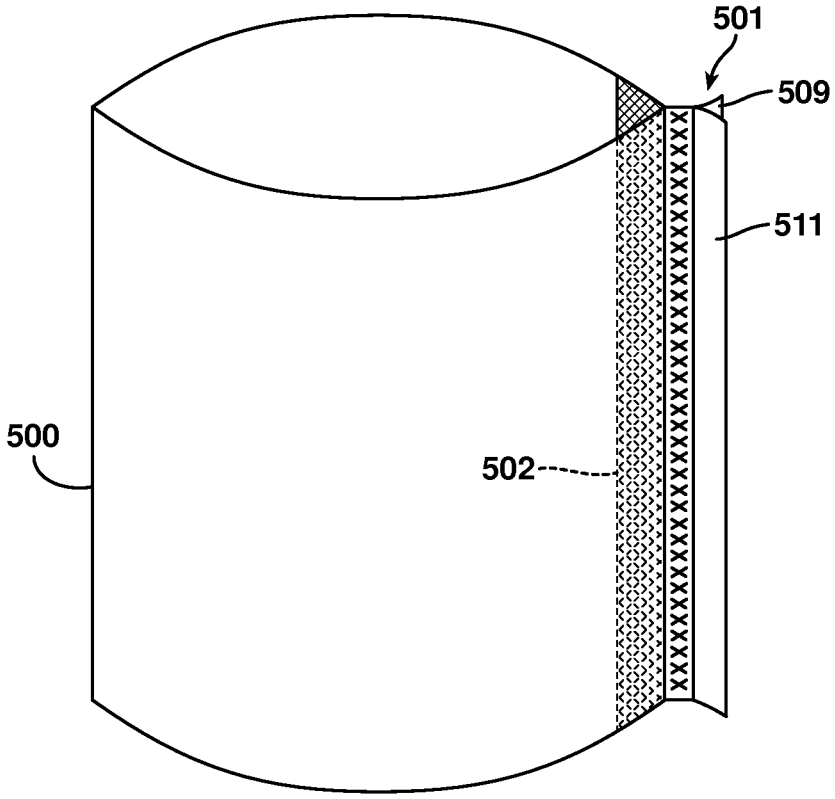
FIG. 17 is a perspective view of a folded web for use in the invention.

FIG. 17 shows folded web 500 with a discrete laminate 502 anchored to the folded web, and fin seal 501, formed as disclosed hereinabove, and prior to a step of making transverse seals in the folded web. A finished package made according to FIG. 17 will thus look like the packages of FIGS. 3 and 4, when these are viewed at right angles to their position in FIGS. 3 and 4, i.e. with the discrete laminate 4 to the right side of each package, and the second end 34 representing a fold. The embodiment of FIG. 17 thus provides a method of producing packages on a VFFS apparatus where the longitudinal seal of the package effectively becomes the first end of the finished package (discounting any unsealed material between the longitudinal seal and the top edge of the package). The apparatus and methodology of U.S. Pat. No. 6,293,073 (Caudle) this patent incorporated herein by reference in its entirety, can be utilized in combination with the teachings herein, to produce packages according to this embodiment. A point of distinction is that in the present invention, the transverse seals will typically (although not necessarily) be rectilinear, whereas the trans-verse seals disclosed in Caudle '073 are wavy or sinusoidal.

Figure 18:
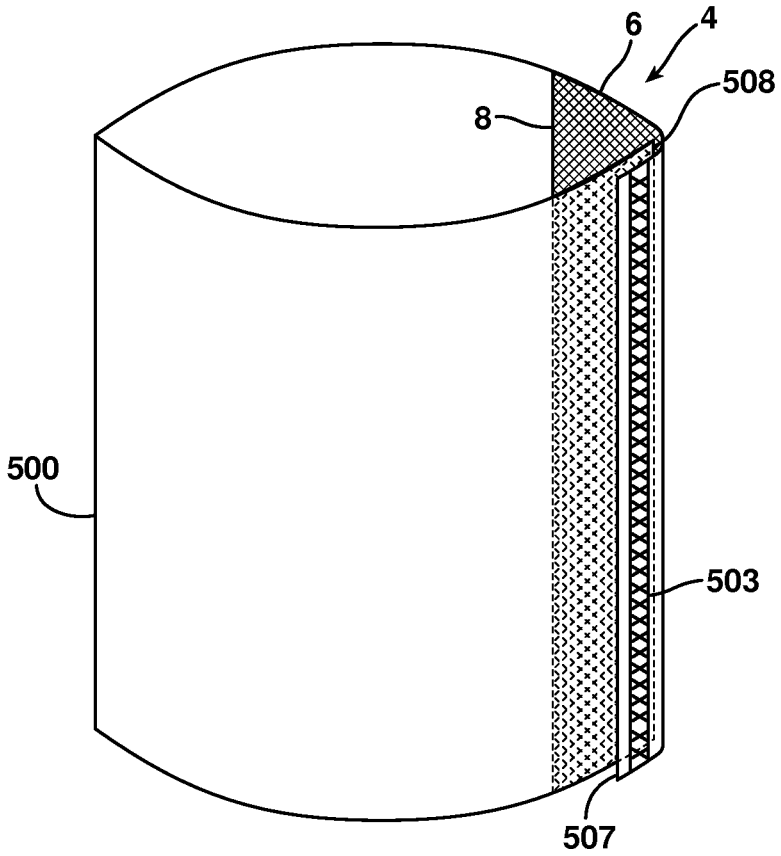
FIG. 18 is a perspective view of a folded web for use in the invention.
Figure 29:
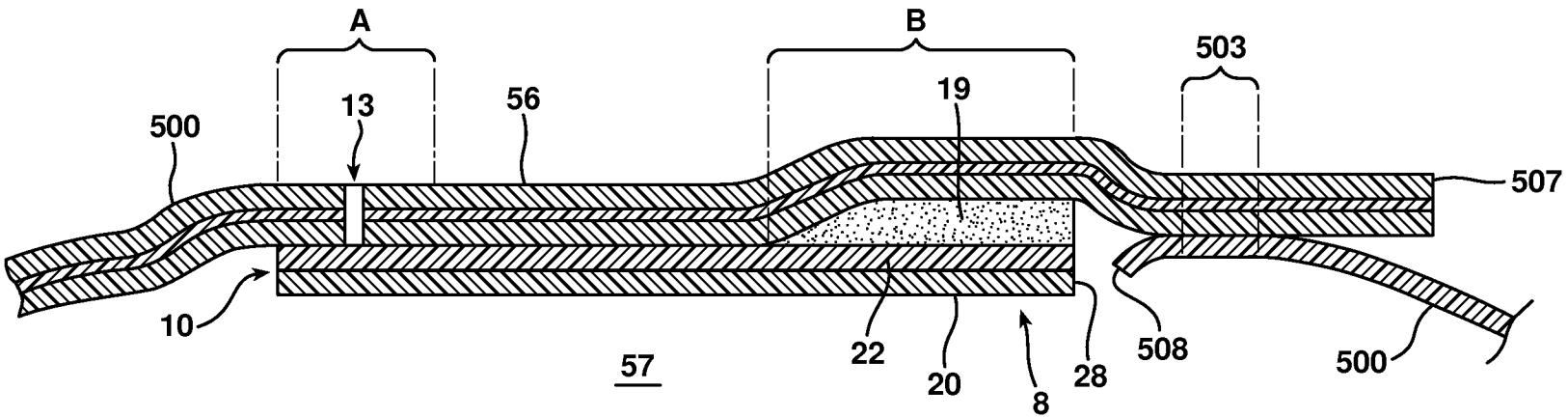
FIG. 29 is a cross sectional view of an alternative embodiment.

Alternatively (FIG. 18), a package like the embodiment of FIG. 17 is shown, but where a lap seal 503 is shown. In this as well as the other processes disclosed herein, a lap seal can be used in lieu of a fin seal when making a longitudinal seal according to the invention (see also FIG. 29). A finished package 5 according to FIG. 18 has a product therein; the two longitudinal ends of the package are each closed by a transverse seal; the lap seal runs down the middle or spine of the package, bounded on both ends by the transverse seals; and the discrete laminate is anchored to an interior surface of the folded web.

C. Lidstock/Formed Web

Figure 19:
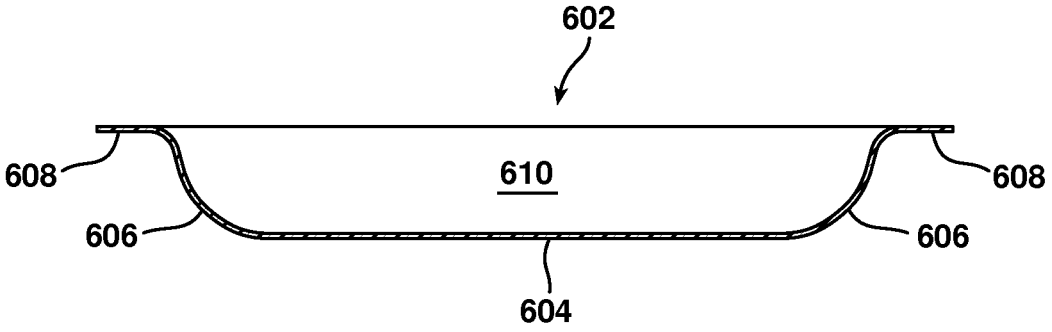
FIG. 19 is a side view of a tray for use in connection with the invention.
Figure 20:
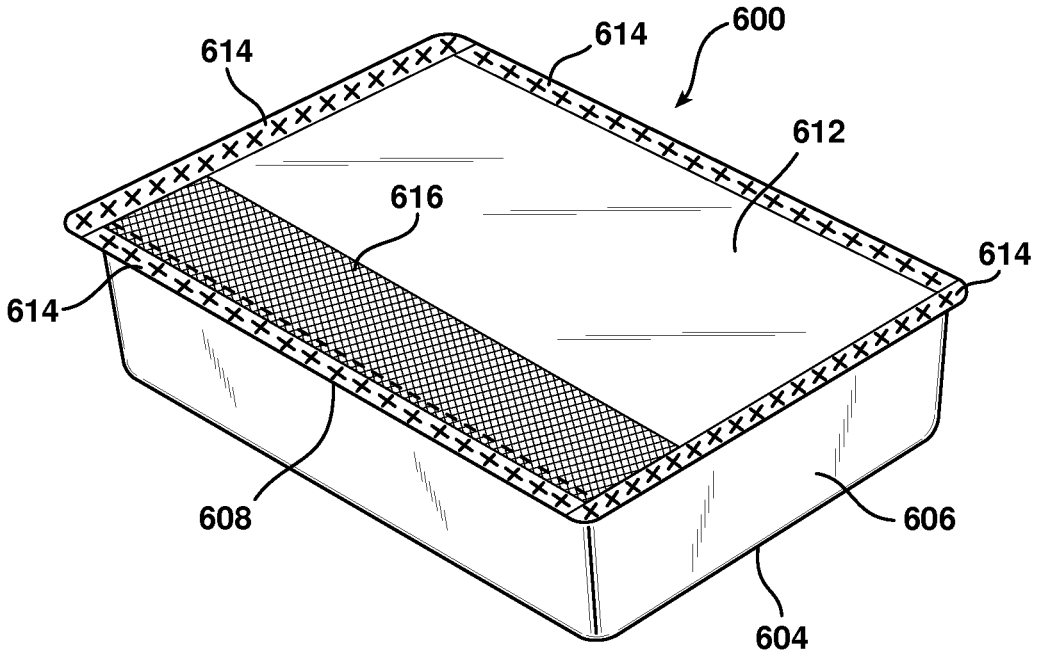
FIG. 20 is a perspective view of a package.
Figure 21:
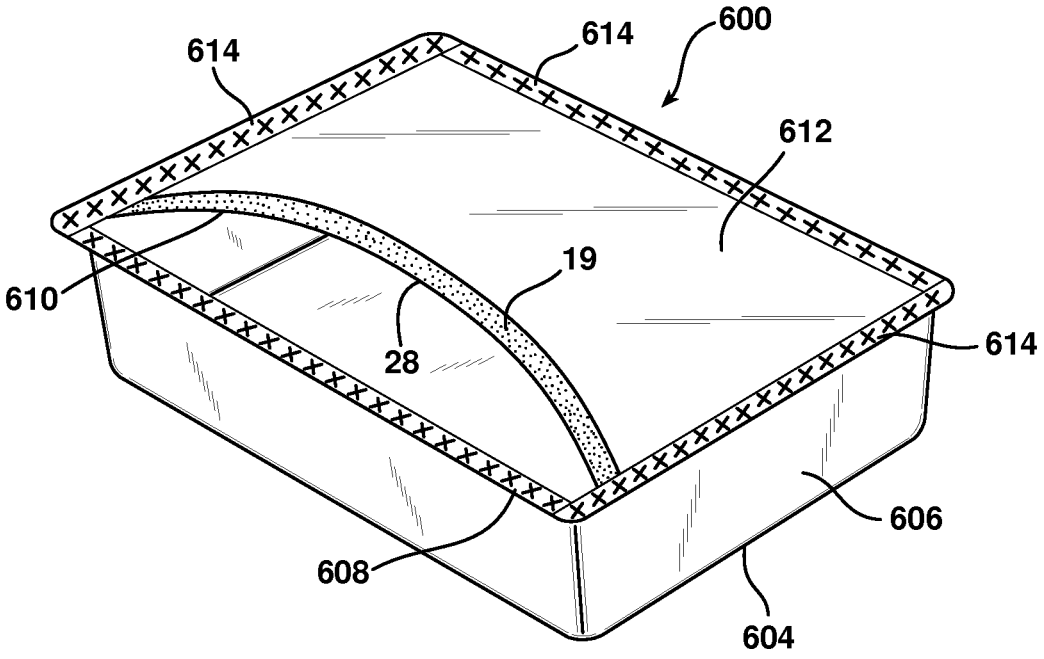
FIG. 21 is a perspective view of the package of FIG. 20 in an opened condition.

FIGS. 19, 20, and 21 illustrate in another embodiment the use of a formed web, e.g. a tray, and a non-formed web, e.g. a lidstock, used in connection with the invention. Tray 602 will typically be made during the packaging process. Thermoforming equipment, available from e.g. Multivac, Tiromat, Ulma or Rapid Pak, is used to convert flat thermoplastic forming web into formed pockets to create trays for containing product such as food, various industrial and consumer items and sterile medical products. Trays are formed from a lower web by heat and pressure, and can be loaded with product manually or automatically on the machine. After that, the packages are vacuumized or backflushed with modified atmosphere (if required), hermetically sealed to an upper web, separated, and removed for distribution or storage. Alternatively, pre-formed trays can be used.

Each tray 602 has a tray bottom 604, tray sides 606, and a tray flange 608 along its perimeter to which the lidstock 612 can be sealed. Tray bottom 604 and tray sides 606 define tray cavity 610. Prior to any thermoforming step, tray 602 can be of any suitable thickness, e.g. from 2 to 30 mils thick, and any suitable construction.

If a pre-made tray is used according to the invention, it can be rigid or semi-rigid, can be in the form of a flat or shaped tray, and can be made from any suitable material, including solid or expanded embodiments, such as PP, polystyrene, polyamide, 1,4-polymethylpentene (e.g. TPX™ available from Mitsui), or crystallized polyethylene terephthalate (CPET). A tray liner can optionally be used that adheres to the surface of the pre-made tray on which the product is to be placed. This liner can be of any suitable design, and can be a multi-layer structure with at least one layer with gas-barrier properties. Such a liner can be adhered to the tray by heat lamination, extrusion lamination, extrusion coating, adhesives, corona treatment, etc. Tray 602 can be a flexible or semi-rigid, or rigid formed web.

Referring to FIGS. 20 and 21, a package includes tray 602 to which lidstock 612 has been sealed with perimeter seal 614. Lidstock 612 includes a lay-flat web 611 (see FIGS. 22 and 23) formulated to function as a lid on a formed web, and can be any suitable monolayer or multilayer thermoplastic film as described herein with respect to webs useful in connection with the present invention. Lidstock 612 also includes discrete laminate 616 having an easy-open sealant on the inner surface thereof. Discrete laminate 616 has the easy-open characteristics and composition such as discussed herein with respect to the discrete laminate of HFFS or VFFS packages. The panel section (see also FIG. 28A) can be pulled away from the package, and the first side panel can be grasped in the area below PSA layer 19 so that the package is easily opened and product can be removed as desired. After removing the product, the package can be reclosed, where the formed web is flexible, by folding the flexible formed web over, contacting the PSA. The formed web will typically have a flange or header that extends from the web. In some embodiments, e.g. where the formed web is rigid or semi-rigid, a line of weakness such as a series of perforations, slits, etc. can be installed on the underside of the formed web in the area of the flange. When the panel section is removed to open the package, the package can be reclosed by folding the formed web over at the line of weakness, allowing the formed web to contact the PSA to reclose the package. In the case of a flexible formed web, it may not be necessary to install a line of weakness in the formed web to facilitate reclosing of the package.

Figure 22:
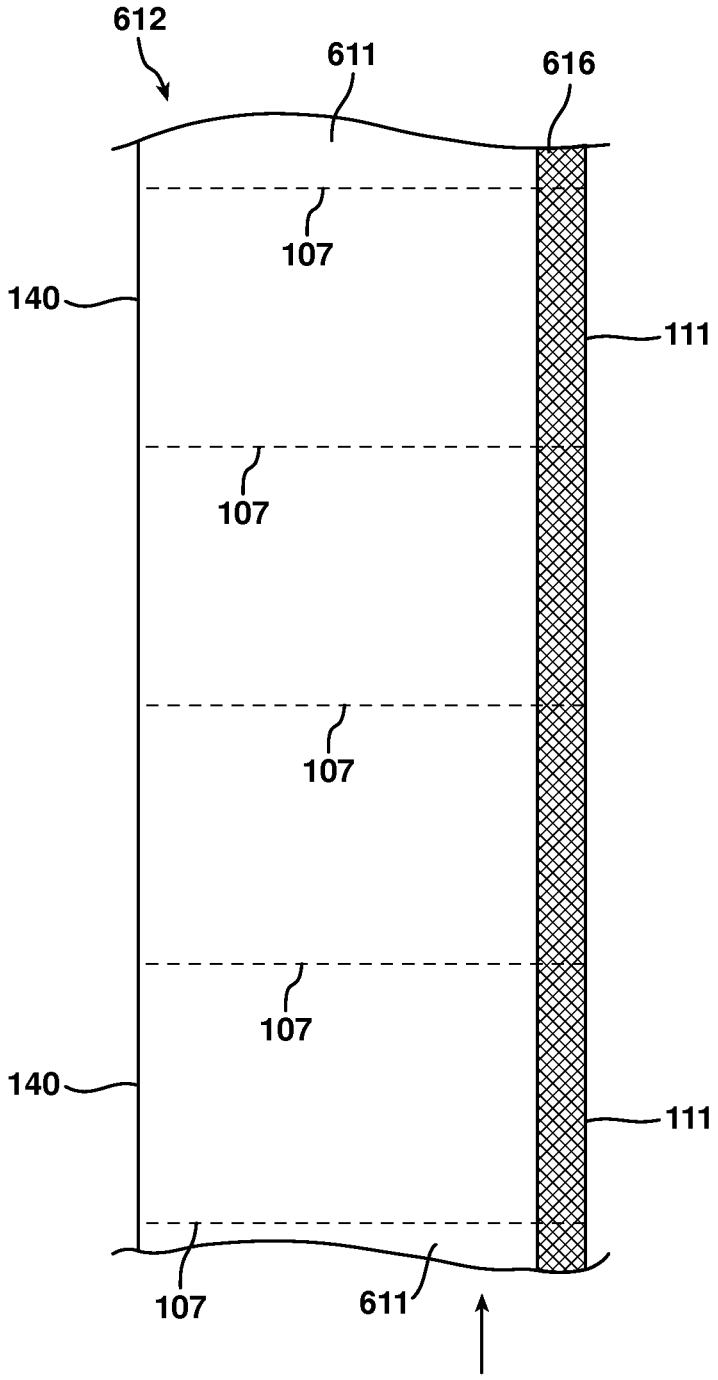
FIG. 22 is a plan view of a lidstock.

Referring to FIG. 22, discrete laminate 616 has a first lateral edge 111. As shown, discrete laminate 616 has been anchored to the lay-flat web 611 to produce lidstock 612. Dotted lines 107 indicate the location at which lidstock 612 is sealed and cut, e.g. perimeter heat sealed and cut, in registered fashion by otherwise conventional means as discussed herein, e.g. in thermoforming equipment, to create individual packages. Lines 107 represent what will become the side edges and seals of individual packages when lidstock 612 is advanced into a packaging system where it is progressively fed over filled trays, sealed to the trays, and cut to create finished packages. Lines 111 and 140 also represent what will become the first and second end respectively of individual packages. Lay-flat web 611, as rolled up, and as it feeds into thermoforming equipment, has a first lateral edge 140. Discrete laminate 616 can be preanchored on lay-flat web 611 by the supplier of the lidstock, as in the embodiments of FIGS. 9A, 11 and 13. Alternatively, discrete laminate 616 can be anchored to the lay-flat web 611 during the packaging process, as in the embodiments of FIGS. 8, 10, and 12.

Figure 23:
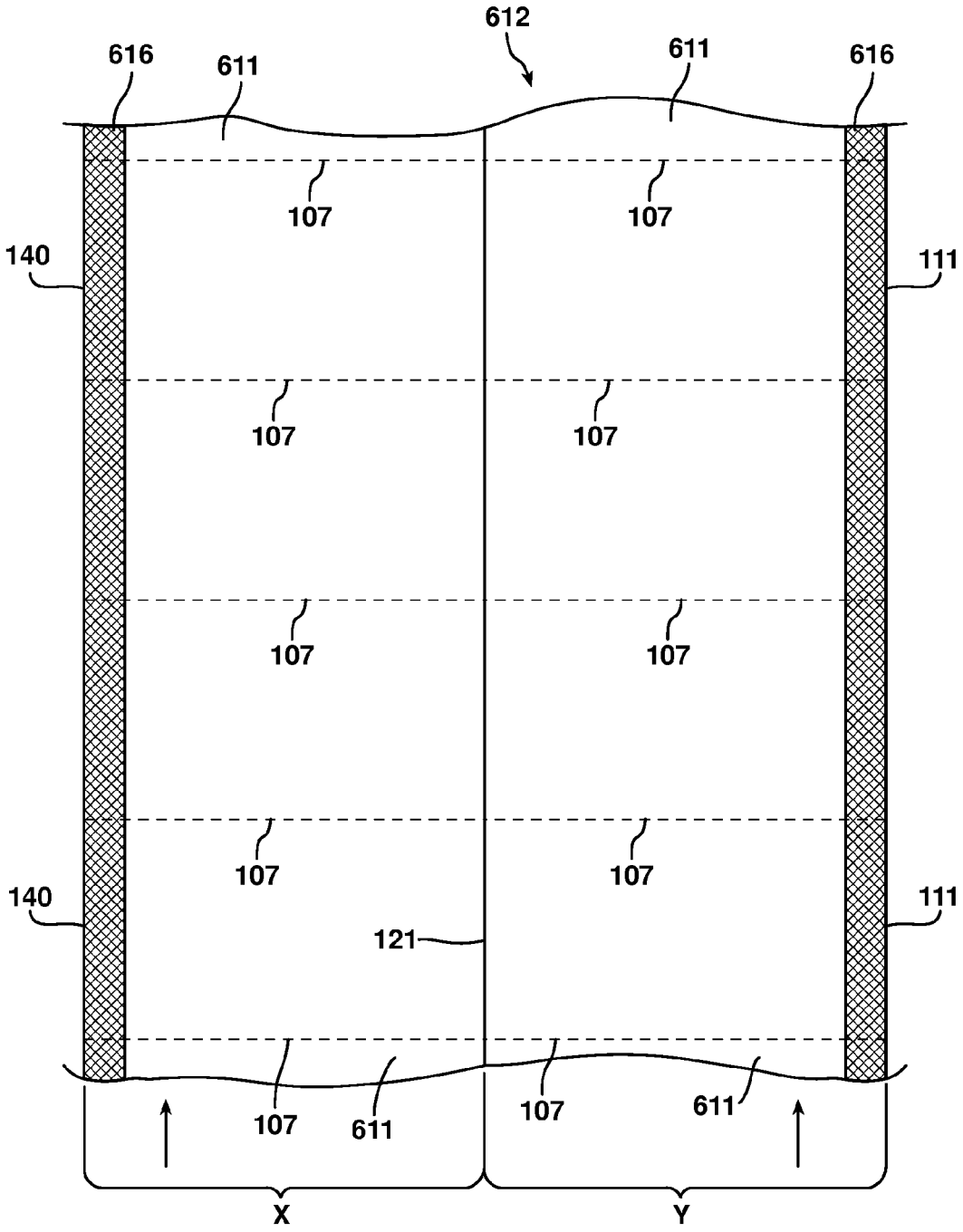
FIG. 23 is a plan view of a lidstock according to another embodiment.

FIG. 23 shows an alternative embodiment of FIG. 22, in which the lidstock is produced as described above, but "two across", so that when run in a packaging machine, with suitable machine die set-ups, two, four, etc. packages can be made simultaneously. In addition to the seal and cut steps at locations 107, the web is cut longitudinally along line 121, so that individual packages made from the longitudinal portion "X" of FIG. 23 will have a second end 121; and individual packages made from the longitudinal portion "Y" of FIG. 23 will have a second end 121.

D. Continuous Horizontal Packaging

Figure 25:
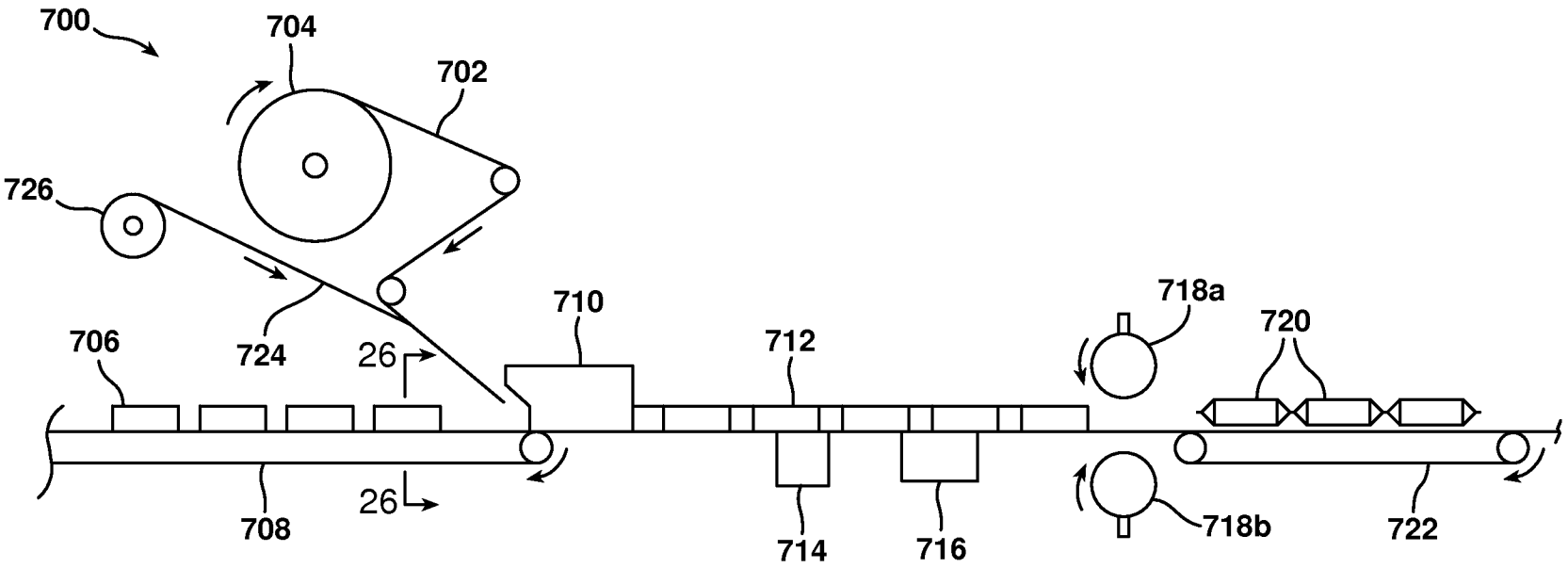
FIG. 25 is an elevational view of a continuous horizontal packaging process and apparatus for making a package.
Figure 26:
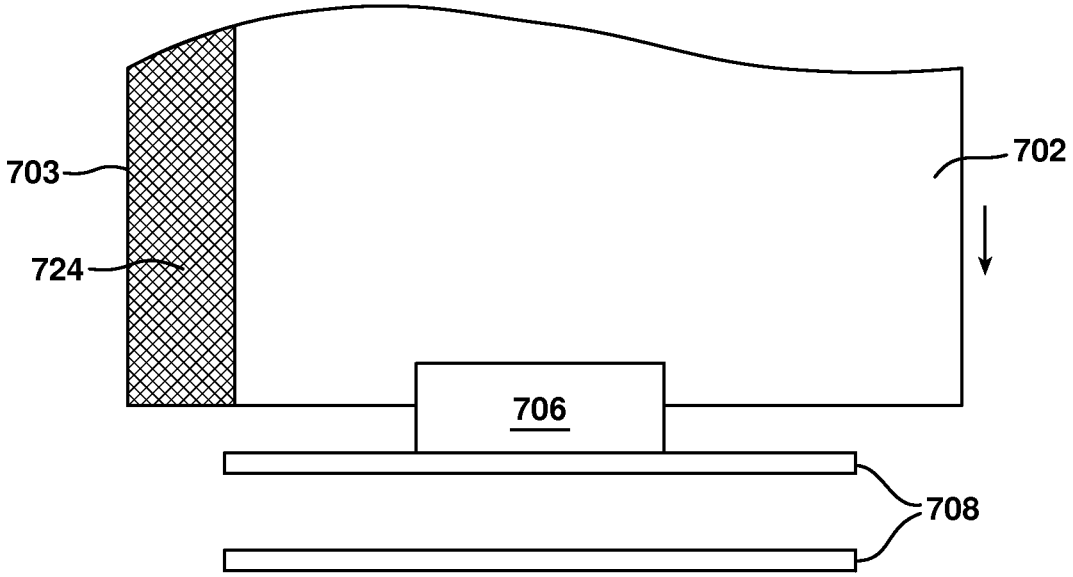
FIG. 26 a front end view of the apparatus of FIG. 25, viewed along lines 26-26 of FIG. 25.
Figure 27A:
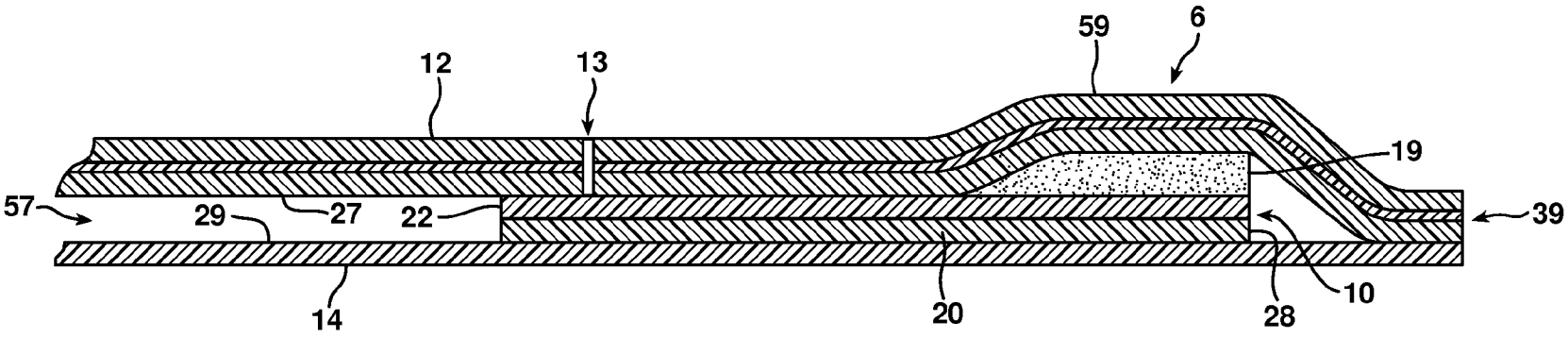
FIGS. 27A, 27B, 27C, and 27D are each cross-sectional views of a portion of the package, showing a sequence for opening the package.
Figure 27B:
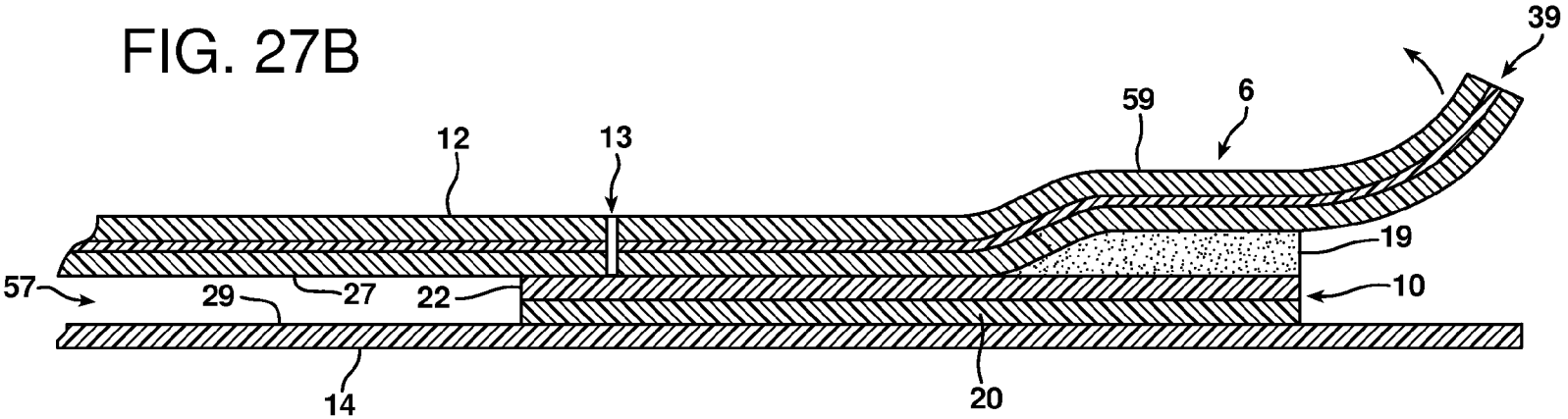
Figure 27C:
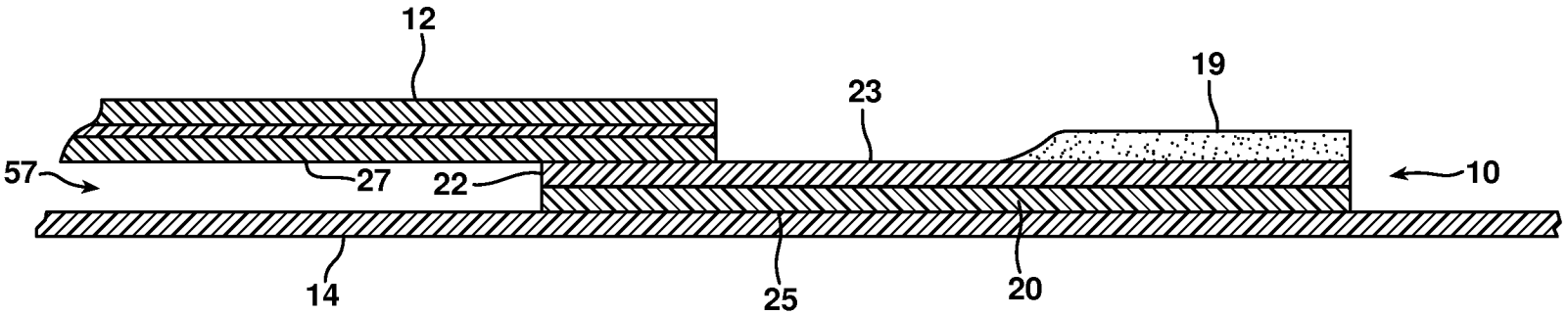
Figure 27D:
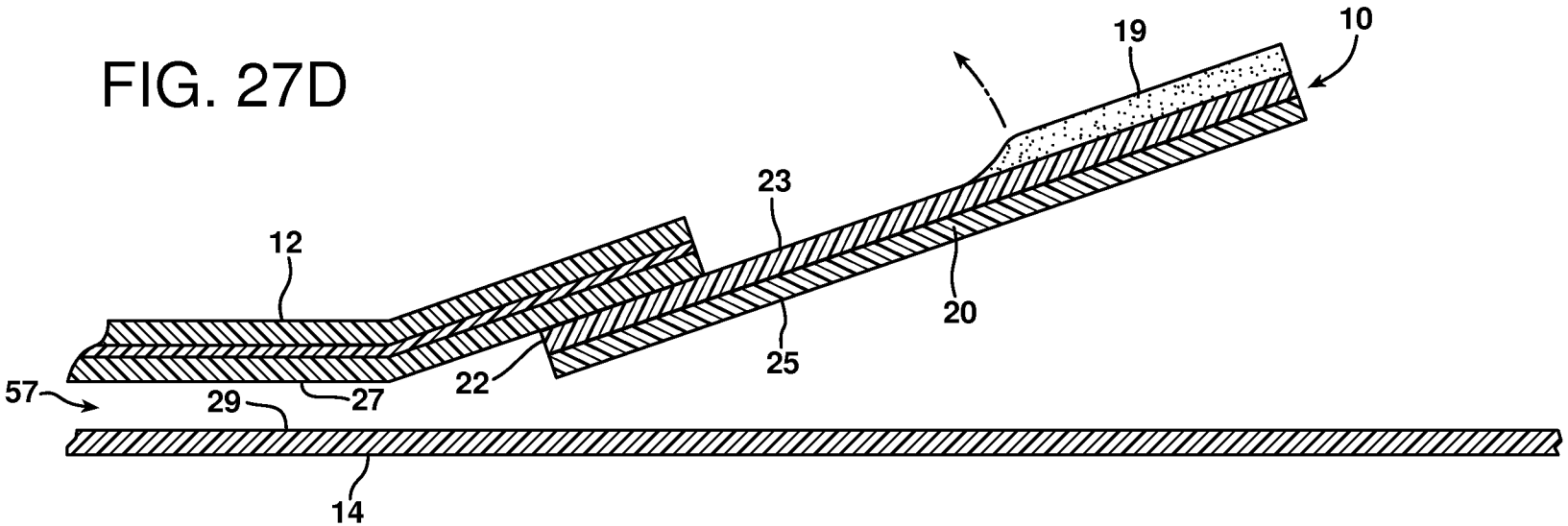

In another embodiment, and referring to FIGS. 25 and 26, the package of the invention can be made using a continuous HFFS process and apparatus such as those used for packaging bakery and other goods, sometimes known as Flow Wrap, Flow-Wrap or Flow wrapping machines or systems, and available from manufacturers/suppliers such as Ilapak, ULMA, and Bosch.

FIG. 25 shows such a process and apparatus 700, but one in which a discrete laminate 724 is installed into a package. Lay-flat web 702 is drawn from roll 704 and advanced to forming device 710. As this occurs, a series of products 706 is advanced along conveyor 708 to forming device 710, and discrete laminate 724 is drawn from roll 726 and advanced to forming device 710. Web 702, with the discrete laminate in some embodiments anchored thereto either before or during forming of the web in the forming device, is formed by forming device 710 into folded web 712. The discrete laminate becomes part of the folded web. This folded web will be like the folded web described above with respect to VFFS embodiments, but in a substantially horizontal orientation. Folded web 712 wraps around products 706. A longitudinal sealing device that can be part of forming device 710 forms a lap or fin seal (of the type disclosed above with respect to VFFS embodiments) on the folded web, typically at the bottom of the folded web. The lap or fin seal is typically a heat seal. An alternative is to have a separate sealing device 714 to produce the lap or fin seal. The products travel downstream from forming device 710 or sealing device 714 to trans-verse sealing device 716 where the folded web is transversely sealed in areas of the folded web between adjacent products. Such seals are typically heat seals. The products are advanced from transverse sealing device 716 to cutting device 718*a* and 718*b*, where the formed and longitudinally and transversely sealed folded web is severed in areas of the folded web between adjacent products, in or near the transverse seals, such that individual packages 720 are produced.

Alternatively, the sealing function of transverse sealing device 716 and the cutting function of cutting device 718*a* and 718*b* can be combined at a single station, rather than being performed at separate locations on the production path.

Web 702 and discrete laminate 724 can be of any suitable dimension and composition, such as those disclosed herein. As discrete laminate 724 is fed to forming device 710, it can be brought into contact with, and optionally anchored to a surface of web 702. This embodiment is shown in FIGS. 25 and 26, where discrete laminate 724 is shown as anchored to web 702 as it progresses toward forming device 710. First longitudinal edge 703 of discrete laminate 724 can be seen in FIG. 26. Alternatively, discrete laminate 724 can be fed into forming device 710, and then incorporated into folded web 712 by anchoring the discrete laminate to the interior or exterior surface of the web, in a manner and format analogous to the embodiment of the VFFS pouch and package of FIGS. 10, 17 and 18, but in a horizontal rather than vertical position. In another embodiment, discrete laminate 724 can be pre-applied to web 702 by the supplier of the web, analogous to the embodiment of the VFFS pouch and package of FIGS. 11 and 13, and the HFFS pouch and process of FIG. 9A.

E. Side Seal Bags

Figure 33:
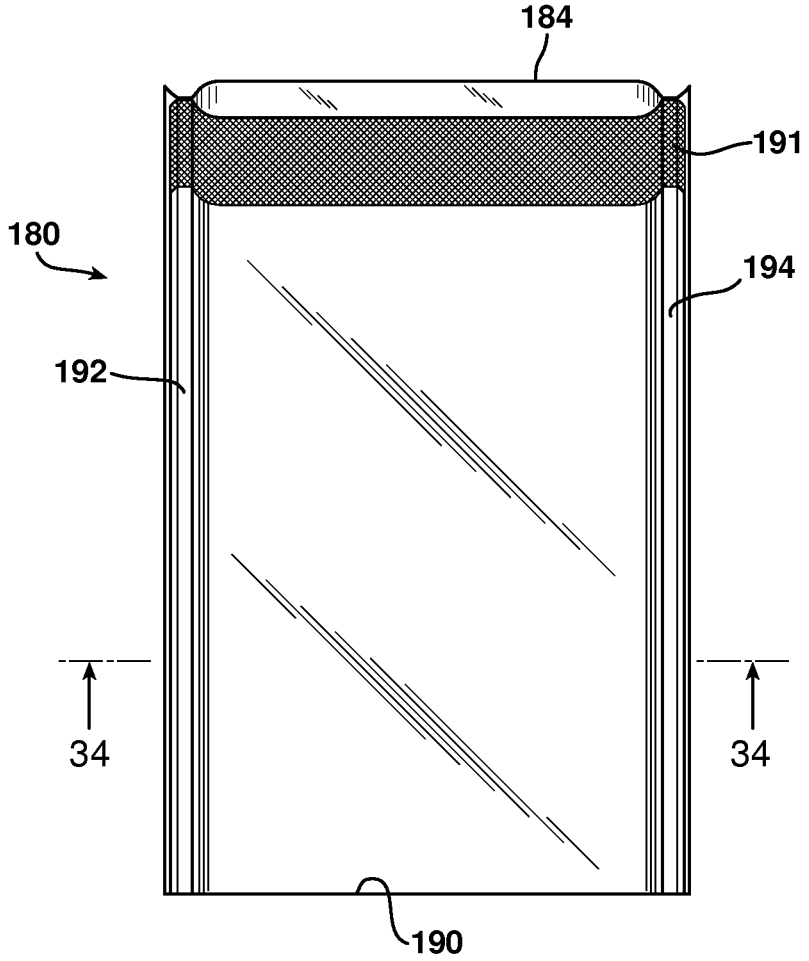
FIG. 33 is a plan view of another embodiment of the invention.
Figure 34:
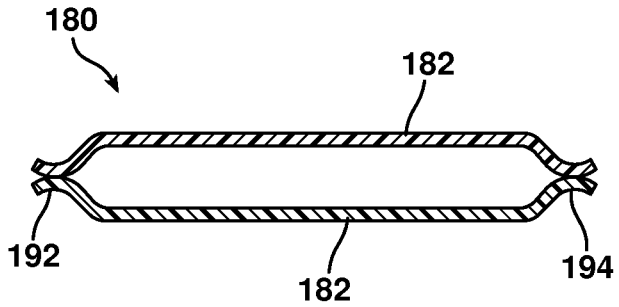
FIG. 34 is a cross sectional view of FIG. 33.

In one embodiment, and referring to FIGS. 33 and 34, the package of the invention can be made using otherwise conventional bag making equipment and processes. Bags are often made as side seal bags. The side seal bag has a factory-made heat seal at opposite bag edges. The bag bottom is formed by one of two folds of film created during the extrusion of bag tubing during manufacture. The opposite fold of film is slit to form a bag mouth. The bag is typically made from a long length of bag tubing. A method of making side seal bags is disclosed in US 2008/0138478 A1 (Ebner et al.), this patent incorporated herein by reference in its entirety.

FIGS. 33 and 34 illustrate bag 180. FIG. 33 illustrates a side seal bag 180, in a lay-flat view; FIG. 34 illustrates a cross-sectional view taken through section 34-34 of FIG. 33. With reference to FIGS. 33 and 34 together, side seal bag 180 comprises a web 182, first edge 184 defining an open mouth, edge fold 190, first side seal 192, and second side seal 194. Discrete laminate 191 is installed on the individual bag, or on a slit bag tube that is then cut and sealed at predetermined intervals to make a series of side seal bags 180, by any suitable process such as any of those disclosed herein.

A bag can be made by extruding a thermoplastic tube to make a bag tubing; slitting the tubing at one longitudinal edge thereof to make a slit bag tubing; anchoring the discrete laminate as described herein to the slit bag tubing; and transversely cutting and sealing the bag tubing at predetermined intervals to make a plurality of individual bags each with the discrete laminate disposed thereon. The discrete laminate can function as described herein for other embodiments and processes, in providing an easy-open and reclosable package. Some of the steps set out in US 2008/0138478 A1, for making a bag, are optional with respect to the present invention; such steps including irradiation and orientation of the tubing.

In the various embodiments disclosed herein, the discrete laminate can be anchored to the first side panel of a web, pouch, or package in a number of different configurations. An example is that shown in FIGS. 2A and 2B. Alternatives are shown in FIGS. 35 to 38.

Figure 35:
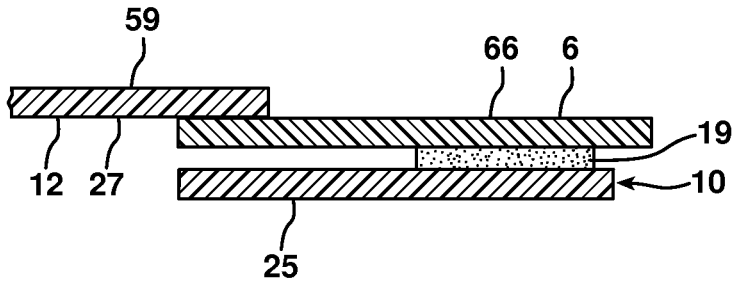
FIG. 35 is an elevational view of a discrete laminate and a portion of a lay-flat web.

FIG. 35 shows the discrete laminate anchored to the first side panel 12 by anchoring a second part of the outer surface 66 of panel section 6 to the inner surface 27 of first side panel 12.

Figure 36:
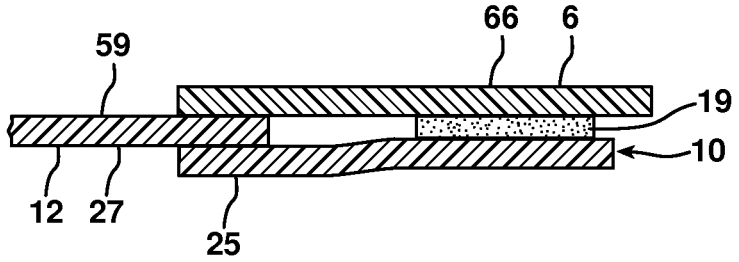
FIG. 36 is an elevational view of a discrete laminate and a portion of a lay-flat web.

FIG. 36 shows the discrete laminate anchored to the first side panel 12 by anchoring a second portion of the first surface of the base strip 10 to the inner surface 27 of first side panel 12, and/or a second part of the inner surface 67 of panel section 6 to the outer surface 59 of first side panel 12.

Figure 37:
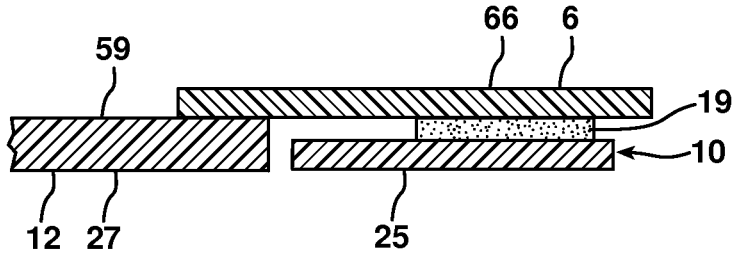
FIG. 37 is an elevational view of a discrete laminate and a portion of a lay-flat web.

FIG. 37 shows the discrete laminate anchored to the first side panel 12 by anchoring a second part of the inner surface 67 of panel section 6 to the outer surface 59 of first side panel 12. A joint 13 defines the juxtaposition of the second end of base strip 10 and the first end of first side panel 12.

Figure 38:
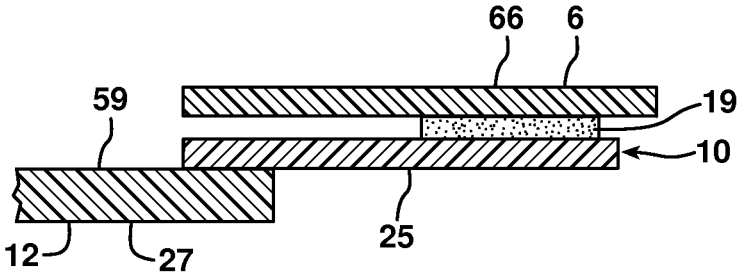
FIG. 38 is an elevational view of a discrete laminate and a portion of a lay-flat web.

FIG. 38 shows the discrete laminate anchored to the first side panel 12 by anchoring a second portion of the second surface of the base strip 10 to the outer surface 59 of first side panel 12.

For each of these alternatives, In the event that the anchor is in the form of a seal, appropriate sealants should be present at surfaces to be anchored by sealing.

For some of these alternatives, a joint 13 is not present in the sense of the joint of FIG. 37. Instead, the base strip 10 and/or panel section overlaps the first side panel as shown in FIGS. 35, 36 and 38.

Method of Operation

In opening the package of FIGS. 27A to 27D, an end or edge of panel section 6 is manually grasped and pulled away from the package. The end of strip 10 closest to the first end 39 of the package is then grasped and pulled away from the second side panel 14, breaking through the easy-open seal (if any) between the second surface 25 of base strip 10, and the inner surface 29 of the second side panel 14, to access product in the interior 57 of the package. During this opening sequence, the anchor in region "A" between surfaces 23 and 27 of first side panel 12 will typically remain intact, such that a portion of the strip 10 stays on and in contact with surface 27. PSA layer 19 is exposed when the package is opened in each of these embodiments. To reclose the package, and depending on the geometry of the respective components of the package, a portion of the second side panel can be folded over to contact the PSA; or the upper portion of the second side panel, along with an upper portion of the first side panel with the base strip anchored thereto, can be folded over such that the PSA contacts the outer surface of the first side panel. The package can typically be opened and reclosed several times. When the package is opened, the PSA is positioned facing the outside of the package. This is useful especially with food products where it is undesirable to have the PSA facing the interior of the package, and thus potentially in contact with the product.

Figure 28B:
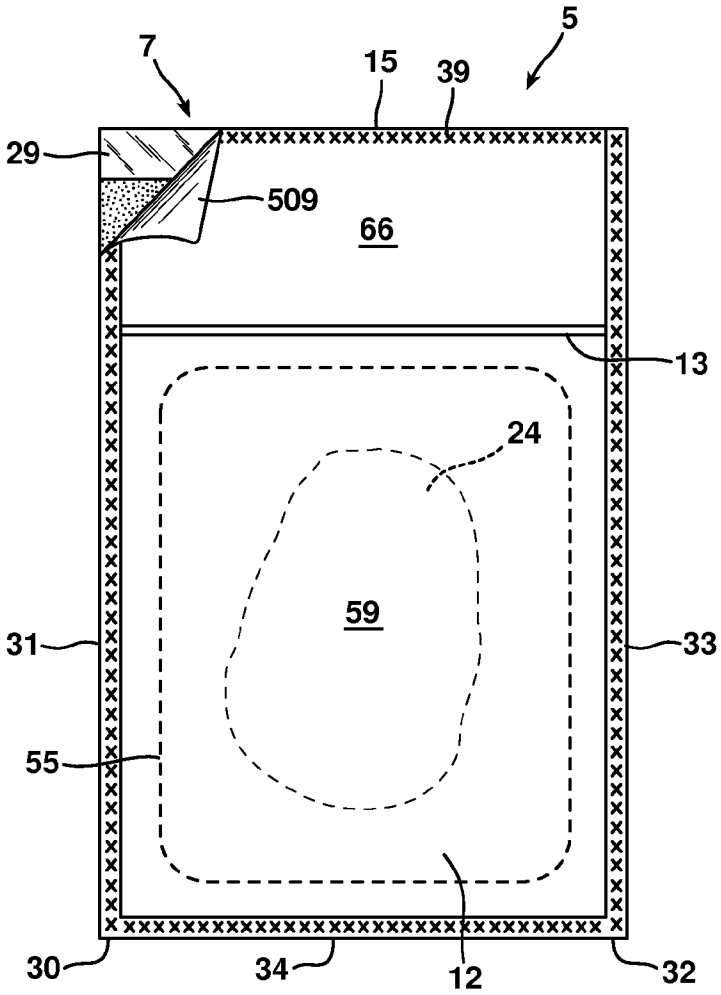
FIGS. 28A, 28B, and 28C are each plan views of the package, showing a sequence for opening the package.
Figure 28A:
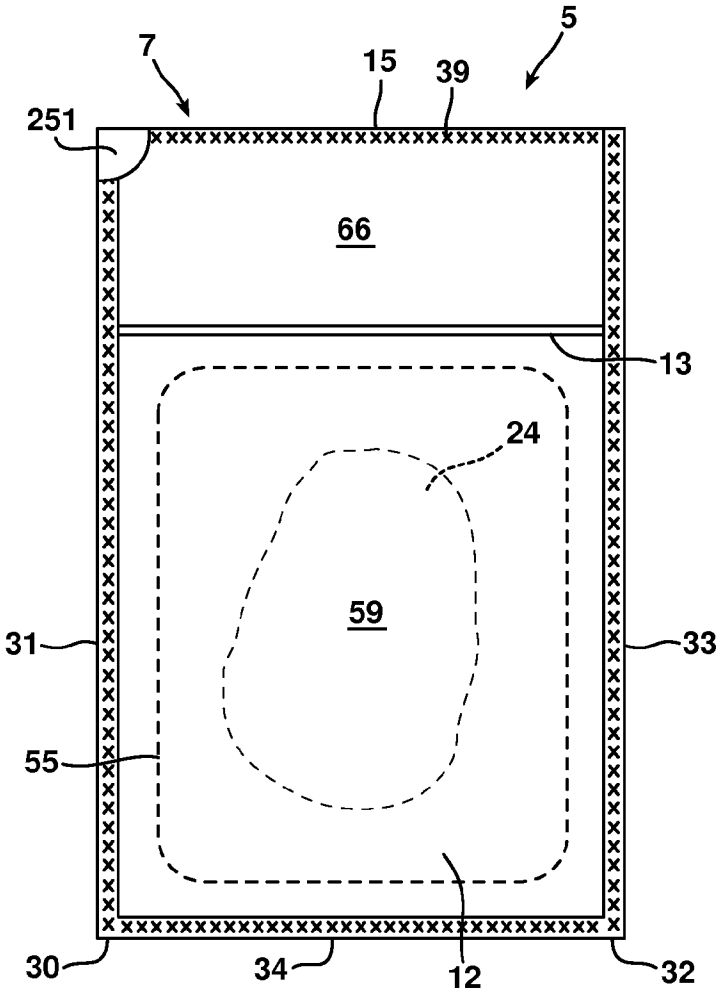
Figure 28D:
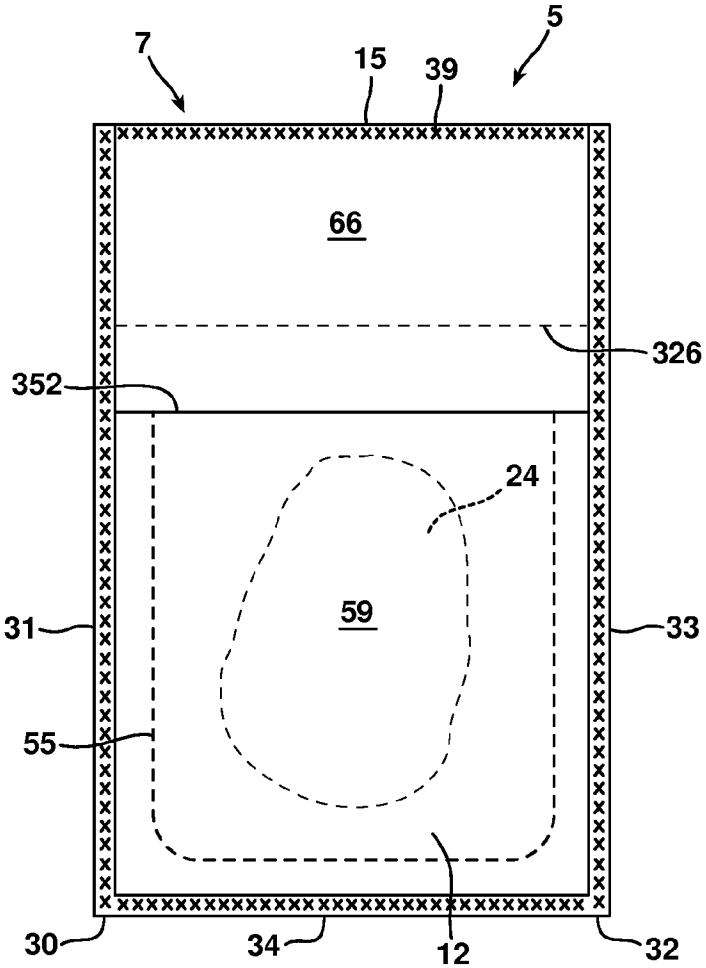
FIGS. 28D and 28E are each plan views of another embodiment of the package, showing a sequence for opening the package.
Figure 28C:
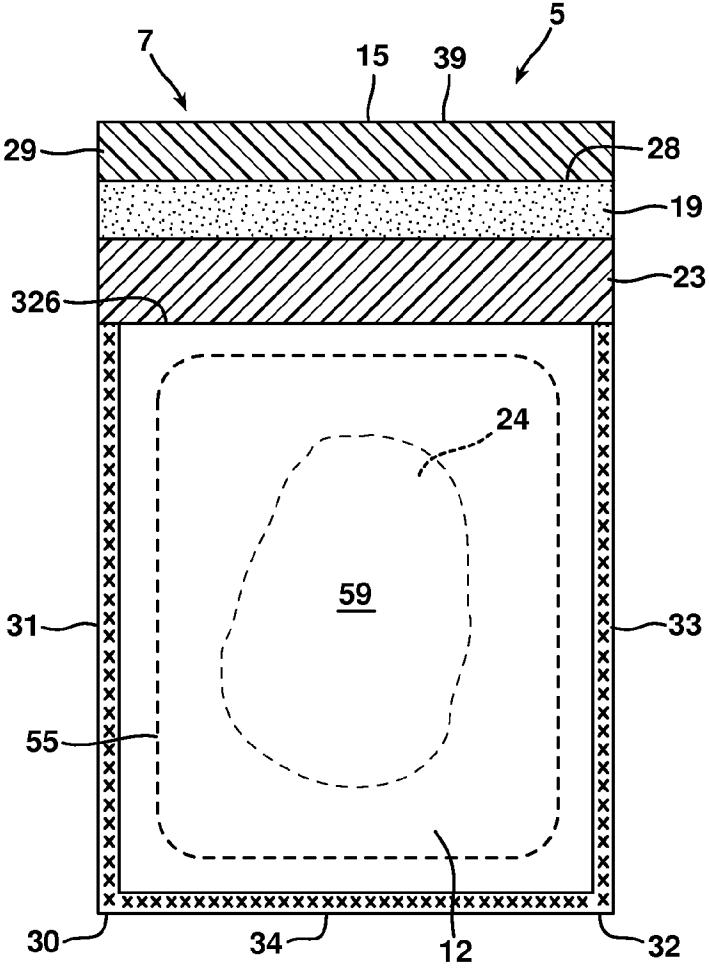

FIGS. 28A to 28C show in plan view a package opening sequence. To facilitate opening, an unsealed area 251 can be installed in a corner of panel section 6 at its first end 15, where it contacts the second side panel. This area can be used to initiate opening. Panel section 6 (see FIG. 2A), now functioning as an opening flap 509, is peeled away along the easy-open seal from the first end of the package and is completely removed. The PSA layer 19 is thus exposed (see FIG. 28C). The tape 8 is then pulled away from the second side panel to access the contents of the package. The package can be reclosed as described herein for FIGS. 27A to 27D.

Figure 28E:
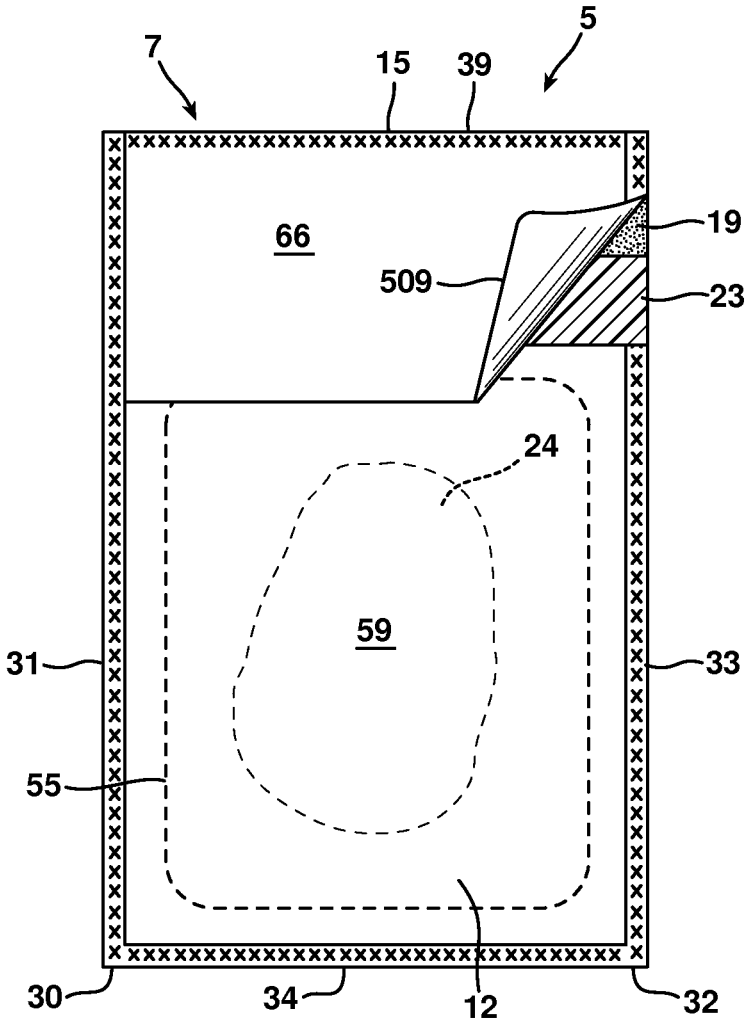

In an alternative mode, and referring to FIGS. 28D and 28E, the panel section 6 can overlap the first side panel. The panel section can then be removed by grasping the lower edge of the panel section and pulling it up over the PSA layer and toward the first end of the package, as shown in FIG. 28E. The panel section is completely removed, and the resultant opened package will appear as in FIG. 28C.

Method of Applying a PSA Layer to a Base Strip

Figure 30:
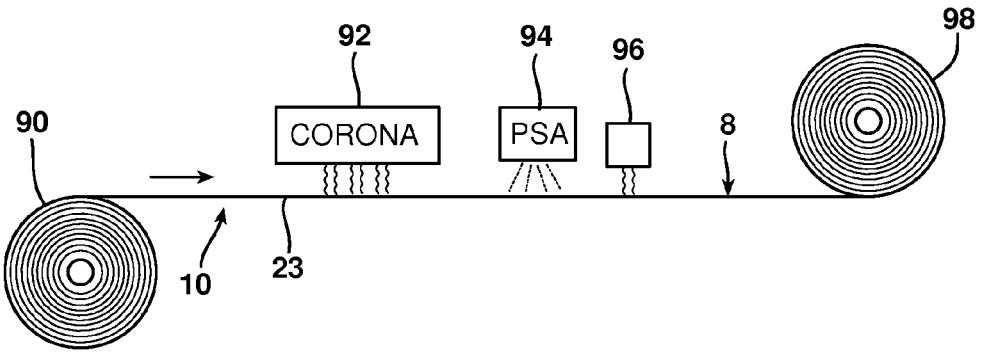
FIG. 30 is an apparatus and process for making a tape.

FIG. 30 shows a method of applying a PSA layer to a base strip to make a tape, comprising the following steps:

1) advancing base strip 10 by suitable motive means (not shown, and well known in the art, such as a motor) from roll 90.

2) Optionally, corona treating surface 23 using a conventional corona treater 92 in preparation for the application of a PSA to the treated surface. The PSA may adhere to strip 10 without corona treatment. However, in this embodiment, depending on the materials chosen, the PSA may, upon opening of a package, exhibit cohesive failure, or alternating adhesive failure, i.e. some of the PSA may adhere to strip 10, and some to surface 67 of panel section 6.

3) applying a coating of PSA 19 to substantially the entire surface 23 of strip 10. A conventional PSA applicator 94 is shown applying PSA to now corona treated surface 23. As an alternative, a release liner, such as a silicone-coated liner can be coated with PSA, and the PSA-coated liner is then laminated to corona treated strip 10. When the liner is removed, the PSA remains with the strip 10. The PSA can be of any suitable composition and thickness. The thickness of the coating of PSA may vary from one portion of the coated surface to another. This is acceptable as long as the finished package functions in its intended way with respect to its reclosability.

4) optionally providing, in a selected portion of surface 23, a clear area.

5) curing the coating of PSA. Curing can be accomplished by any suitable process, taking into account the type of PSA being used, including hot air drying by a conventional hot air dryer 96.

6) advancing resulting tape 8 to take-up roll 98.

The application of PSA to the strip, and the assembling of a package incorporated a panel section and a PSA coated strip, can be done at a single location, but more practically will typically be done at two or more separate locations, with the assembling of the package by a packager using pre-provided discrete laminate prepared elsewhere and provided in advance of the packaging process.

Method of Applying a Panel Section to a Tape to Make a Discrete Laminate

Figure 24:
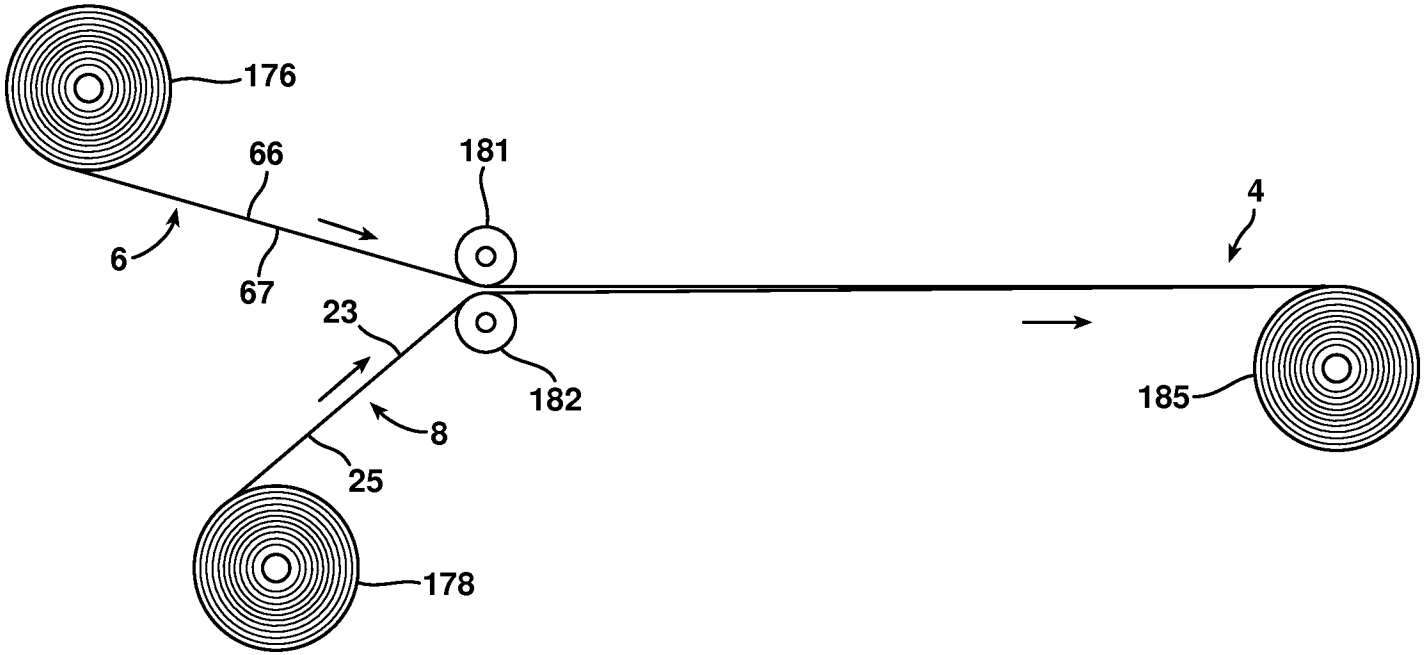
FIG. 24 is a schematic view of an apparatus and process for making a discrete laminate.

FIG. 24 shows a method of applying a panel section to a tape to make a discrete laminate, comprising the following steps:

1) advancing tape 8 including base strip 10 and PSA layer 19 by suitable motive means (not shown, and well known in the art, such as a motor) from roll 178.

2) advancing panel section 6 from roll 176.

3) bringing tape 8 and panel section 6 together at nip rolls 181,182, such that the PSA adheres the tape to the panel section.

4) advancing resulting discrete laminate 4 to take-up roll 185. A seal could optionally be used to attach the tape to the panel section.

Method of Application of the Discrete Laminate to a Web

The discrete laminate can be applied to a web such as a lay-flat web in a number of ways.

In one embodiment, the discrete laminate can be completely assembled, either at the package facility where it will be used to make packages, or at a supplier or converter location. The discrete laminate can then be adhered or anchored to a web as disclosed herein. Anchoring in this embodiment is accomplished e.g. by sealing an extended second end of the panel section of the discrete laminate to a surface of the web, and/or by anchoring an extended second end of the base strip of the discrete laminate to a surface of the web.

In another embodiment, the panel section and tape are not brought together initially, and the panel section is sealed to one surface of a web, and the tape is separately anchored to an opposite surface of the web, so that the PSA on the base strip adheres to an inner surface of the panel section. Attachment of the panel section and tape to the web can be done simultaneously, or sequentially with attachment of the panel section either before or after attachment of the tape. In this embodiment, the panel section and tape can be congruent, although they do not have to be.

PACKAGE EXAMPLES

Example 1

A package is made in accordance with the embodiment illustrated in FIG. 2C and described herein, in a horizontal form/fill/seal system. First and second side panels 12 and 14 each comprises T7225B. The panel section 6 comprises H5230BZ, a laminate having the construction:

| | | |
|---|---|---|
| chemically treated PET | polyurethane adhesive | coextruded barrier film |

where the PET (PET1) is a biaxially oriented polyester film, and the coextruded barrier film has the construction:

| Layer 1 | Layer 2 | Layer 3 | Layer 4 | Layer 5 | Layer 6 | Layer 7 | Layer 8 |
|---|---|---|---|---|---|---|---|
| EZ1 | AD1 | 80% NY1 + 20% NY2 | OB1 | 80% NY1 + 20% NY2 | AD1 | PE2 | PE2 |
| 0.63 | 0.19 | 0.19 | 0.25 | 0.19 | 0.19 | 0.44 | 0.44 |

The overall thickness of the coextruded barrier film is about 2.50 mils. Layer gauges in mils for each layer are indicated below each layer. Layer 8 is the layer of the barrier film adhered, by the polyurethane adhesive, to the PET film. Layer 1 is the easy-open heat sealant layer of the film, and provides the inner or sealant surface of the panel section, facing the interior of the package, and the PET forms the outer surface of the panel section. The thickness of the PET film is about 0.48 mils, and the thickness of the polyurethane adhesive is about 0.20 mils. The overall thickness of the laminate is about 3.18 mils.

The base strip 10 of the tape is an extrusion laminated film that has the construction:

| Layer 1 | Layer 2 | Layer 3 | Layer 4 | Layer 5 |
|---|---|---|---|---|
| 85% PE3 + 15% PE4 | EM1 | PET2 | EM1 | PE4 |
| 0.75 | 0.25 | 1.50 | 0.25 | 0.75 |

The overall thickness of the base strip is about 3.5 mils. Layer gauges in mils for each layer are indicated below each layer. Layer 5 is the layer of the base strip to which the PSA is pattern coated. Layer 1 is the layer of the base strip facing the interior of the package.

Before the package is made, a PSA (acResin® A 204 UV) carrying 15% tackifier (FORAL® 85 synthetic resin) by weight of the total PSA/tackifier composition is pattern coated on a first portion of layer 5 of the base strip, the PSA/tackifier composition is UV-cured, and the resulting tape adhered by the PSA to the easy-open surface (layer 1 of the coextruded barrier film of the H5230 BZ laminate in this example) of the panel section while the latter is in a lay-flat condition. The discrete laminate 4 made up of the base strip 10, PSA layer 19, and panel section 6 is then anchored to the web making up the first and second side panel (in this example, T7225B), and specifically anchored to a portion of the web that will constitute the first side panel.

Example 2

A package like that of package example 1 is made, but in which 25% tackifier is used in the PSA/tackifier composition.

Example 3

A package like that of Example 1 is made, but in which the base strip comprises the eight layer material identified in Table 1, Example 1, having an easy-open sealant layer comprising EZ1.

The easy-open sealant layer (layer 122 in Table 1) is the layer of the base strip facing the interior of the package.

Before the package is made, a PSA (acResin® A 204 UV) carrying 15% tackifier (FORAL® 85 synthetic resin) by weight of the total PSA/tackifier composition is pattern coated on a first portion of layer 128 of the base strip, the PSA/tackifier composition is UV-cured, and the resulting tape adhered by the PSA to the easy-open surface (layer 1 of the coextruded barrier film of the H5230 BZ laminate making up the panel section) while the latter is in a lay-flat condition. The discrete laminate 4 made up of the base strip 10, PSA layer 19, and panel section 6 is then anchored to the web making up the first and second side panel (in this example, T7225B), and specifically anchored to a portion of the web that will constitute the first side panel.

Example 4

A package like that of package example 3 is made, but in which 25% tackifier is used in the PSA/tackifier composition.

Example 5

A package like that of package example 1 is made, but in which the base strip comprises the same material as panel section 6, i.e. H5230BZ.

Before the package is made, a PSA (acResin® A 204 UV) carrying 15% tackifier (FORAL® 85 synthetic resin) by weight of the total PSA/tackifier composition is pattern coated on a first portion of layer 8 of the coextruded barrier film of the H5230BZ comprising the base strip, the PSA/tackifier composition is UV-cured, and the resulting tape adhered by the PSA to the easy-open surface (layer 1 of the coextruded barrier film of the H5230BZ) of the panel section while the latter is in a lay-flat condition. The discrete laminate 4 made up of the base strip 10, PSA layer 19, and panel section 6 is then anchored to the web making up the first and second side panel, and specifically anchored to a portion of the web that will constitute the first side panel.

Example 6

A package like that of package example 5 is made, but in which 25% tackifier is used in the PSA/tackifier composition.

Example 7

A package like that of package example 1 is made, but in which the panel section comprises the eight layer material identified in Table 1, Example 1, having an easy-open sealant layer comprising EZ1.

Before the package is made, a PSA (acResin® A 204 UV) carrying 15% tackifier (FORAL® 85 synthetic resin) by weight of the total PSA/tackifier composition is pattern coated on a first portion of layer 5 of the base strip, the PSA/tackifier composition is UV-cured, and the resulting tape adhered by the PSA to the easy-open surface (layer 122) of the panel section while the latter is in a lay-flat condition. The discrete laminate 4 made up of the base strip 10, PSA layer 19, and panel section 6 is then anchored to the web making up the first and second side panel, and specifically anchored to a portion of the web that will constitute the first side panel.

Example 8

A package like that of package example 7 is made, but in which 25% tackifier is used in the PSA/tackifier composition.

Example 9

A package like that of package example 7 is made, but in which both the panel section and the base strip comprise the eight layer material identified in Table 1, Example 1, having an easy-open sealant layer comprising EZ1.

Before the package is made, a PSA (acResin® A 204 UV) carrying 15% tackifier (FORAL® 85 synthetic resin) by weight of the total PSA/tackifier composition is pattern coated on a first portion of layer 128 of the base strip, the PSA/tackifier composition is UV-cured, and the resulting tape adhered by the PSA to the easy-open surface (layer 122) of the panel section while the latter is in a lay-flat condition. The discrete laminate 4 made up of the base strip 10, PSA layer 19, and panel section 6 is then anchored to the web making up the first and second side panel, and specifically anchored to a portion of the web that will constitute the first side panel.

Example 10

A package like that of package example 9 is made, but in which 25% tackifier is used in the PSA/tackifier composition.

Example 11

A package like that of package example 7 is made, but in which the base strip comprises H5230BZ.

Before the package is made, a PSA (acResin® A 204 UV) carrying 15% tackifier (FORAL® 85 synthetic resin) by weight of the total PSA/tackifier composition is pattern coated on a first portion of layer 8 of the coextruded barrier film of the H5230BZ base strip, the PSA/tackifier composition is UV-cured, and the resulting tape adhered by the PSA to the easy-open surface (layer 122) of the panel section while the latter is in a lay-flat condition. The discrete laminate 4 made up of the base strip 10, PSA layer 19, and panel section 6 is then anchored to the web making up the first and second side panel, and specifically anchored to a portion of the web that will constitute the first side panel.

Example 12

A package like that of package example 5 is made, but in which 25% tackifier is used in the PSA/tackifier composition.

The above descriptions are those of embodiments of the invention. All parts and percentages are by weight, unless otherwise indicated or well understood in the art. Except in the claims and the specific examples, or where otherwise expressly indicated, all numerical quantities in this description indicating amounts of material, reaction conditions, use conditions, molecular weights, and/or number of carbon atoms, and the like, are to be understood as modified by the word "about" in describing the broadest scope of the invention. Any reference to an item in the disclosure or to an element in the claim in the singular using the articles "a," "an," "the," or "said" is not to be construed as limiting the item or element to the singular unless expressly so stated. All references to ASTM tests are to the most recent, currently approved, and published version of the ASTM test identified, as of the priority filing date of this application. Each such published ASTM test method is incorporated herein in its entirety by reference.

Terms referring to polymers, such as polyester, polyamide, and polyolefin, refer herein to both homopolymers and copolymers thereof, unless otherwise specified.

With reference to the drawings, the flow of materials is in the direction of the arrows.

Those of skill in the art will recognize that the drawings herein are not necessarily to scale, and certain features of the invention may be graphically exaggerated for clarity.

Both the web or webs used in the manufacture of the package according to the invention, and the strip and tape of the discrete laminate of the invention, can be made by any suitable process, including coextrusion, extrusion coating, extrusion lamination, and conventional lamination using polyurethane or other adhesives. These manufacturing processes are well known in the art. Extrusion can be done in annular or flat dies. The extrudate can be hot blown or cast, and optionally solid-state oriented as desired. Chemical or electronic crosslinking of one or more layers of the webs or the strip can be done. Both web and discrete laminate can be advanced by suitable motive means (not shown, and well known in the art, such as a motor) from their respective rolls.

A package according to the invention can optionally carry printed indicia, which can be decorative or informational in nature. Decorative printed indicia can include a logo, a trademark, product information, etc. with text and/or graphics.

Printed indicia can be in the form of a message e.g. "easy open" or "open here". This can be printed in scattered process (i.e. registration is not required) on or near the first end of the package. The message is surface printed or reverse printed.

In the embodiments disclosed herein, the first end of the package can be sealed, typically where two webs are used to make the package.

The present invention, including the package and methods as disclosed herein, is provided in several embodiments in the absence of a: plastic zipper closure; press-to-close or slide zipper; interlocking closure; reclosable fastener with interlockable fastener elements; interlocking rib and groove elements having male and female profiles; interlocking alternating hook-shaped closure members, and the like. None of these aforementioned closures, zippers, elements, etc. is present in the package of the invention.

The package of the invention is provided in several embodiments herein in the absence of a discrete release liner, in the finished package, for a PSA layer or coating.

The package of the invention is provided in several embodiments herein in the absence of a die cut in the panel section, and/or in the absence of a die cut in the first side panel.

Although the first and second side panels are shown in various embodiments as having the same length, the second side panel can be longer than the first side panel, i.e. extend beyond the first end of the first side panel. The extended portion can accommodate a hang tab with a hole therein.

What is claimed is:

1. An easy-open and reclosable package comprising:

a) a pouch comprising i) a first and second side panel each comprising an outer and inner surface, a first and second side edge, and a first and second end, the first and second side panels joined together along their respective first and second side edges with a seal;

ii) a first end;

iii) a second end defined by the second ends of the first and second side panels respectively; and iv) a discrete laminate having a first and second end, the discrete laminate comprising (a) a tape comprising (i) a base strip comprising a first and second surface, a first and second side edge, and a first and second end, at least one of the first and second surfaces of the base strip comprising a sealant, and (ii) a pressure sensitive adhesive coated on at least a first portion of the first surface of the base strip, and (b) a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section, the panel section and the second side panel are joined together along at least a portion of their respective first and second side edges with an easy-open seal;

the first end of the panel section is joined to the second side panel with an easy-open seal, the first end of the panel section extends beyond the first end of the base strip;

the discrete laminate is anchored to the first side panel, when the package is opened, the package can thereafter be reclosed by adhering the first or second side panel to the pressure sensitive adhesive; and a second part of the outer surface of the panel section is anchored to the inner surface of the first side panel; and b) a product disposed in the pouch.

2. The easy-open and reclosable package of claim 1 wherein both the first and second surfaces of the base strip comprise a sealant.

3. The easy-open and reclosable package of claim 1 wherein at least one of the first and second surfaces of the base strip comprises an easy-open sealant.

4. The easy-open and reclosable package of claim 1 wherein the second surface of the base strip is sealed to the inner surface of the second side panel with an easy-open seal.

5. The easy-open and reclosable package of claim 1 wherein the first surface of the base strip is sealed to the inner surface of the panel section.

6. An easy-open and reclosable package comprising:

a) a pouch comprising i) a first and second side panel each comprising an outer and inner surface, a first and second side edge, and a first and second end, the first and second side panels joined together along their respective first and second side edges with a seal;

ii) a first end;

iii) a second end defined by the second ends of the first and second side panels respectively; and iv) a discrete laminate having a first and second end, the discrete laminate comprising (a) a tape comprising (i) a base strip comprising a first and second surface, a first and second side edge, and a first and second end, at least one of the first and second surfaces of the base strip comprising a sealant, and (ii) a pressure sensitive adhesive coated on at least a first portion of the first surface of the base strip, and (b) a panel section comprising an outer and inner surface, a first and second side edge, and a first and second end, the inner surface comprising an easy-open sealant, wherein the at least first portion of the first surface of the base strip is adhered by the pressure sensitive adhesive to a first part of the inner surface of the panel section, the panel section and the second side panel are joined together along at least a portion of their respective first and second side edges with an easy-open seal;

the first end of the panel section is joined to the second side panel with an easy-open seal, the first end of the panel section extends beyond the first end of the base strip;

the discrete laminate is anchored to the first side panel, when the package is opened, the package can thereafter be reclosed by adhering the first or second side panel to the pressure sensitive adhesive; and a second portion of the first surface of the base strip is anchored to the inner surface of the first side panel; and b) a product disposed in the pouch.

7. The easy-open and reclosable package of claim 6 wherein both the first and second surfaces of the base strip comprise a sealant.

8. The easy-open and reclosable package of claim 6 wherein at least one of the first and second surfaces of the base strip comprises an easy-open sealant.

9. The easy-open and reclosable package of claim 6 wherein at least one of the first and second surfaces of the base strip is sealed to the inner surface of the first or second side panel respectively with an easy-open seal.

10. The easy-open and reclosable package of claim 6 wherein the first surface of the base strip is sealed to the inner surface of the panel section.

* * * * *